US006431246B1

(12) United States Patent
Peterson

(10) Patent No.: US 6,431,246 B1
(45) Date of Patent: Aug. 13, 2002

(54) MODULAR HORIZONTAL WINDOW BLIND

(76) Inventor: James M. Peterson, 3107 N. Broadmoor, San Bernardino, CA (US) 94208

( * ) Notice: Subject to any disclaimer, the term of this patent is extended or adjusted under 35 U.S.C. 154(b) by 0 days.

(21) Appl. No.: 09/393,229

(22) Filed: Sep. 9, 1999

Related U.S. Application Data

(63) Continuation-in-part of application No. 09/151,547, filed on Sep. 11, 1998, now Pat. No. 6,009,931.

(51) Int. Cl.[7] ..... E06B 9/305

(52) U.S. Cl. ..... 160/168.1 R; 160/176.1 R; 160/902

(58) Field of Search ..... 160/168.1 R, 176.1 R, 160/173 R, 177 R, 178.3 R, 902; 248/262

(56) References Cited

U.S. PATENT DOCUMENTS

| | | | |
|---|---|---|---|
| 1,878,186 A | | 9/1932 | Rudolph |
| 2,390,826 A | | 12/1945 | Cohn et al. |
| 3,181,595 A | | 5/1965 | Pender |
| 3,327,765 A | | 6/1967 | Strahm et al. |
| 3,605,852 A | | 9/1971 | Vecchiarelli |
| 3,918,513 A | | 11/1975 | Englund et al. |
| 4,623,012 A | | 11/1986 | Rude et al. |
| 4,697,630 A | | 10/1987 | Rude |
| 4,699,196 A | | 10/1987 | Elliott |
| 4,828,002 A | | 5/1989 | Ashby |
| 5,184,660 A | | 2/1993 | Jelic |
| 5,228,491 A | | 7/1993 | Rude et al. |
| 5,232,037 A | | 8/1993 | Fraser |
| 5,285,838 A | | 2/1994 | Rapp et al. |
| 5,293,921 A | | 3/1994 | Marocco |
| 5,297,608 A | | 3/1994 | Rap et al. |
| 5,339,716 A | | 8/1994 | Sands et al. |
| 5,645,685 A | | 7/1997 | Furhman |
| 5,662,154 A | | 9/1997 | Drake, III |
| 6,009,931 A | * | 1/2000 | Peterson |

FOREIGN PATENT DOCUMENTS

| | | |
|---|---|---|
| FR | 1075601 | 10/1954 |
| NL | 6616583 | 5/1968 |

* cited by examiner

*Primary Examiner*—Blair M. Johnson
(74) *Attorney, Agent, or Firm*—Knobbe, Martens, Olson & Bear, LLP

(57) ABSTRACT

A window blind having a plurality of substantially identical mounting blocks that are adapted to receive a mounting rod in an aperture formed in each of the mounting blocks wherein the mounting rod is comprised of a plurality of mounting rod sections that can be connected together by sleeves so as to form a mounting rod of a variety of lengths. At one end of the mounting rod, a tilt actuator block is attached. The tilt actuator block has a gearing mechanism such that user manipulation of a pair of cords will result in rotation of the mounting rod. The plurality of slats are attached to the mounting section. The mounting blocks further include a guide plate that receives the lift cord wherein the guide plate has an aperture that allows the lift cord to be extended vertically downward from the mounting section to be connected to the horizontal slats. As each of the components of the mounting section 102 are substantially identical, the component can be used to manufacture mounting sections incorporating both tilting mechanisms and lifting mechanisms for window blinds of a variety of lengths.

65 Claims, 29 Drawing Sheets

200
136
120
222
216
212
214
210
200
202
212
204
146a
146b
116
126
122
124
230
232
226
164
140
156
170
104
224
174
176

MODULAR HORIZONTAL WINDOW BLIND

RELATED APPLICATIONS

This application is a continuation-in-part of U.S. application Ser. No. 09/151,547, filed Sep. 11, 1998 now U.S. Pat. No. 6,009,931.

BACKGROUND OF THE INVENTION

1. Field of the Invention

The present invention relates to horizontal window blinds and, more particularly, concerns horizontal window blind designs having modular components which can be used to manufacture window blinds of varying sizes in an efficient manner.

2. Description of the Related Art

Horizontal window blinds are commonly used window coverings. Typically, the horizontal window blinds consist of a head rail member, that contains both a tilting mechanism and a lifting mechanism, and a plurality of horizontal slats that are connected to the head rail and are arranged in parallel so as to be able to be positioned in front of the window when the head rail member is mounted to the window frame. The slats are generally mounted on string ladders which are attached to the tilting and lifting mechanisms contained within the head rail. The string ladders are essentially comprised of two vertical string members having a connecting piece extending therebetween. The slats are generally positioned on or captured by the string ladders so that the outer edges of the slats are positioned inside of the vertical strings with the slats resting on or between the horizontal connecting pieces of the string ladders.

The lifting mechanism is generally comprised of at least two lifting strings that are adapted to be threaded through openings formed at the outer ends of each of the slats and are then anchored in a bottom rail. The lifting strings are attached to a pulley and catch mechanism or a roller and lock mechanism such that the operator, by pulling on a drawstring, can either raise or lower the slats. The tilting mechanism is generally comprised of a relatively small dimensioned rotatable member that is positioned within the head rail so as to extend across the width of the window. Typically, a rod is attached to a gear mechanism such that user rotation of the tilt rod induces the rotatable member to rotate within the head rail. The outer support strings of the ladders are attached to the rotatable member such that rotation of the rotatable member results in vertical displacement of one outer support string relative to the other thereby causing the slats interposed therebetween to rotate or tilt.

Hence, a user can vary the amount of light entering a room by manipulating the tilting mechanism so as to adjust the slats in the rotational or tilted position. The position of the slats typically can continuously vary between a first position, where the plane of the slats is essentially perpendicular to the plane of the window thereby allowing light to enter through the blinds, and a second position, where the plane of the slats is essentially parallel to the plane of the window thereby preventing light from entering through the blinds.

While horizontal window blinds of the type described above are commonly used, there are several difficulties associated with these window blinds. Initially, many of the components used in prior art window blinds are expensive to manufacture and are relatively easily damaged. For example, the head rail is typically made out of relatively thin metal, such as aluminum or steel, that can be easily damaged during assembly, shipping, or installation. Damaged head rails will often interfere with the correct operation of the tilting mechanism or the lifting mechanism thereby preventing the blind from operating correctly.

In particular, the head rail itself must be cut to the desired length. The cutting process, however, often results in the walls of the head rail becoming bent. As components have to be positioned within the head rail, bent or deformed head rail walls often can prevent correct installation of the components within the head rail. Moreover, to even form the head rails, expensive equipment must often be used. For example, the head rail must not only be cut to size but also pressed into the desired shape. Hence, a window blind manufacturer must purchase both presses and shears to form the head rail member and the act of forming the head rail often results in damage to the head rail that complicates the assembly of the window blind.

Moreover, the assembly of most commonly available prior art window blinds is very time consuming and labor intensive which results in relatively high assembly costs. For example, in many prior art window blinds, intricate gear mechanisms typically interconnect the user actuating tilt rod to the rotatable member positioned within the head rail. This intricate gear mechanism can require a considerable amount of effort to install this intricate mechanism within the head rail. In general, the components that are to be mounted within the head rail generally have to be positioned within a confined opening defending by the head rail itself As the head rails are only several inches in cross-section and depth, there is not a lot of room for an assembler to handle and interconnect the components within the head rail. Hence, the assembly and positioning of the components in the head rail can be a very time consuming task for the assembler due to the limited amount of space within the head rail.

A further difficulty that adds to the expense of manufacturing prior art window blinds is that different sizes of blinds often require different size components. This often requires the manufacturer to stockpile large, unwieldy, difficult to store raw components. For example, large pieces of the materials used to form the head rails must be stored so that these pieces can be subsequently cut and shaped to form head rails adapted to fit different sizes of windows. As the material is thin and the raw pieces are typical quite long, the material often gets damaged in storage which results in both significant wastage of material and time consuming efforts to reshape the material for subsequent use.

A further difficulty stems from the fact that window blinds are preassembled in a factory in standard or custom sizes and then shipped to the job site in an assembled format. However, the head rails can also be easily damaged during shipment due to the thinness of the materials used to form the head rail. Once the head rail is damaged, it may no longer be possible to mount the head rail in a window frame or the damage to the head rail may impair the correct operation of the lifting and tilting mechanisms contained within the head rail. As a consequence, damaged head rails are typically returned to the manufacturer for repair adding to the manufacturers costs. An additional difficulty relating to shipping is that the assembled head rails of the prior art are typically made out of metal materials and are quite heavy. As such, the overall shipping costs of the window blinds of the prior art can be quite expensive.

Yet another difficulty of window blinds of the prior art is that the head rails must be almost exactly the right size to be correctly mounted within the window. Typically, the head rail is mounted at either end to the window frame. If the head rail is too long, it will not fit within the window. Further, if the head rail is too short, the mounting brackets that are mounted to the sides of the window frame will generally not engage the head rail and will not securely hold the window blind to the window frame. A significant source of damage to prior art window blinds occurs when installers attempt to fit a mis-measured head rail into a window frame.

Moreover, often times the standard sized prior art window blinds are not well adapted for use with larger windows. In these circumstances, the installer must use multiple blinds to cover a single large window. This results in a window blind assembly that can have an undesirable appearance. This problem is further exacerbated by the typical construction of the window blinds which makes it difficult to produce window blinds having a width of greater than generally four feet. Hence, for larger windows, multiple blinds must be installed. However, multiple blinds often have an undesirable appearance and also require the manipulation of multiple sets of controls to adjust the blinds.

Yet another problem with window blinds of the prior art is that the head rail is often covered by a decorative valance. The decorative valance can be made of a nicer appearing material that the plain metal of the typical head rail. However, the attachment of the valance to the head rail is often unsatisfactory. Either a simple hook and loop fastener is used to secure the valance to the head rail or a more complicated catch mechanism is used. The problem with the simple hook and loop fastener is that, over time, the fastener becomes ineffective resulting in the valance not being securely fastened to the head rail. Moreover, the more complicated catch mechanisms add to the expense of the window blind and often have an undesirable appearance.

Yet another problem with window blinds of the prior art is that it is sometimes difficult to maintain the slats in a maximally closed position. In particular, when placed in the maximally closed position such that the slats are substantially aligned with the plane of the adjacent window so as to maximally block light from passing through the window blind, the forces applied by the string ladders on the tilting mechanism often produce a biased torque that urges the slats away from maximally closed position. Thus, if the tilting mechanism does not provide a sufficient amount of counteracting frictional torque, the slats of the window blind will tend to rotate away from the maximally closed position. Consequently, the light blocking effectiveness of such window blinds is often compromised.

Yet another problem with window blinds of the prior art is that they typically require a lengthy and expensive installation procedure. In particular, an installer is usually required to travel to the installation site and measure the windows so as to determine the appropriate size of the window blinds. The installer must then custom order the blinds having the appropriate dimensions, which often delays the installation by many days. The installer must then return to the installation site at a later date to install the blinds.

Hence, from the foregoing, it will be appreciated that there is a need for a window blind assembly which is simplified in design, less prone to damage, easier to install and is more readily adaptable to cover windows of different sizes. To this end, there is a need for a window blind assembly which has modular components that can be flexibly mounted together to result in the assembly of window blinds of a variety of sizes in a simple and inexpensive manner.

SUMMARY OF THE INVENTION

The aforementioned needs are satisfied by the present invention which, in one aspect, comprises a window blind adapted to cover a window of a structure, the window blind comprising: a mounting section comprising a mounting block and a tilt actuator block, wherein the mounting block and the tilt actuator block each include a recessed spool space formed therein and a first aperture extending through the spool space, wherein the mounting block and the tilt actuator block separately mount to a surface adjacent the window; a rotatable rod assembly comprising a first rotatable member rotatably captured within the spool space of the mounting block so as to extend from the first aperture of the mounting block, a second rotatable member rotatably captured within the spool space of the tilt actuator block so as to extend from the first aperture of the tilt actuator block, and an elongate rod section having a first and second end, wherein the first and second ends of the rod section respectively couple with the first and second rotatable members; and a slat assembly comprising a first and second ladder member supported by the rod assembly and further comprising a plurality of slats supported by the first and second ladder members wherein the ladder members are attached to the rotatable rod assembly so that rotation of the rod assembly results in orientation of the plurality of slats at a pitch angle that determines the amount of light that passes through the window blind.

Another aspect of the invention comprises a method of assembling and installing a window blind from a kit so as to cover a window of a structure with the window blind, the method comprising: measuring the width of the window; selecting the lengths of a plurality of slats so as to substantially match the width of the slats with the measured width of the window; assembling the plurality of slats into a slat assembly; configuring a plurality of mounting blocks each having a rotatable member captured therein to be mounted to a surface adjacent the window, wherein one of the mounting blocks includes a user input device adapted to allow a user to rotate the rotatable member captured therein; selecting the length of at least one rod section of a rod assembly so as to match the length of the rod assembly with the measured width of the window; attaching the at least one rod section with the rotatable members of the plurality of mounting blocks so as to form the rod assembly; attaching the slat assembly to the rod assembly; and attaching the plurality of mounting blocks to a mounting surface of the structure adjacent the window so as to securely position the window blind adjacent the window.

Another aspect of the invention comprises a window blind apparatus for covering a window, the apparatus comprising: a mounting assembly mounted to a surface adjacent the window; a slat assembly comprising a plurality of slats and a plurality of ladder members, wherein each ladder member comprises a first and second elongate section and a plurality of interconnecting sections that interconnect the first and second elongate sections, wherein the interconnecting sections of the ladder members support the plurality of slats; and a tilt rod assembly rotatably captured by the mounting assembly, wherein the tilt rod assembly is formed with a plurality of ladder member attachment points adapted so as to support the plurality of ladder members of the slat assembly, wherein the first and second elongate sections of the ladder members extend from the ladder member attachment points so that the first and second elongate sections of each ladder member is vertically displaced with respect to each other in response to a first rotation of the tilt rod assembly so as to vary the pitch angle of the plurality of slats positioned on the interconnecting sections of the ladder members, wherein the tilt rod assembly is adapted to reduce the horizontal distance between the first and second elongate sections of each ladder member in coincidence with an increase in the pitch angle of the plurality of slats so as to reduce the difference in the tensions of the first and second elongate sections of each ladder member to thereby inhibit the pitch angle of the plurality of slats from changing in the absence of an external torque applied by a user.

Another aspect of the invention comprises a window blind adapted to cover a window of a structure, the window blind comprising: a mounting member mounted to a surface adjacent the window; a rod assembly rotatably supported by the mounting member, the rod assembly comprising an elongate cylindrical rod section having an elongate aperture formed therein, wherein the rod section is formed with a relatively large diameter so as to increase the strength of the rod section; and a slat assembly comprising a first and second ladder member supported by the rod assembly and a plurality of slats supported by the first and second ladder members such that rotation of the rod assembly results in simultaneous rotation of the plurality of slats.

Another aspect of the invention comprises a window blind assembly comprising: a rotatable rod; a plurality of mounting blocks adapted to be mounted to a surface adjacent a window, wherein each of the plurality of mounting blocks includes an interchangeable housing having a first side face and a second side face with a first aperture and a second aperture respectively formed in the first and second side faces wherein each of the interchangeable housings also includes a first recessed space wherein the plurality of mounting blocks are adapted to engage the rotatable rod (i) through a first aperture in the first face in a first configuration, (ii) through a second aperture in a second face in a second configuration and (iii) through both the first and second apertures in a third configuration to thereby allow a standardized mounting block to be used to support the rotatable rods at the ends of the rotatable rod or in the middle of the rotatable rod; a tilt actuator block having an aperture that extends therethrough, wherein the tilt actuator block further includes a tilt mechanism that engages with the rotatable rod so as to rotate the rotatable rod in response to user activation of the tilt mechanism; and a slat assembly having a plurality of slats adapted to be positioned adjacent a window, wherein the slat assembly is coupled to the rotatable rod so that rotation of the rotatable rod in response to user activation of the tilt actuator block results in a change in the pitch angle of the plurality of slats which thereby varies the amount of light let through the slat assembly.

Another aspect of the invention comprises a window blind assembly kit adapted to permit installation of window blinds of varying sizes to windows, the kit comprising in combination: a plurality of mounting blocks adapted to be mounted to a surface of a wall adjacent a window; a tilt mechanism block adapted to be mounted to a surface of a wall adjacent a window; a tilt mechanism adapted to be positioned within the tilt mechanism block; a plurality of rod sections and connectors wherein the plurality of rod sections and connectors can be coupled together to form a rotatable rod of one of a number of possible sizes corresponding to the width of the window and wherein the plurality of rod sections can be coupled to the selected mounting blocks such that when the selected mounting blocks are secured to the surface of the wall adjacent the window, the rotatable rod is retained adjacent the surface of the wall and wherein the plurality of rod sections can be coupled to the tilt mechanism block such that user activation of the tilt mechanism results in rotation of the rotatable rod; a plurality of ladder members adapted to be attached at coupling points to the rotatable rod wherein the plurality of ladder members have two elongate members that are attached to coupling points of the rotatable rod such that rotation of the rotatable rod results in vertical displacement of one vertical member with respect to the other; a plurality of slats of a first length adapted to be engaged with the plurality of ladder members so that rotation of he rotatable member results in a change of pitch of the slats engaged with the plurality of ladder members wherein the slats can be cut to a desired length corresponding to the width of the window; an assembly rack adapted to receive the plurality of slats of the desired length to permit installation of the plurality of slats into the plurality of ladder assemblies and wherein the kit is adapted to permit a single kit to be used to form a window blind assembly that is dimensioned to fit a window of a first size selected from a range of window sizes.

Another aspect of the invention comprises a window blind apparatus for covering a window of a building, the apparatus comprising: a plurality of horizontal slats captured in at least one ladder assembly; a plurality of mounting blocks each adapted to be separately mounted to a surface of the building adjacent the window, wherein the plurality of mounting blocks each define apertures that extend therethrough; a rotatable rod having a first and a second end wherein the rotatable rod is positioned within the plurality of apertures so as to be rotatable within the apertures when the plurality of mounting blocks are mounted to the surface of the building adjacent the window so that the rod is maintained in a substantially horizontal position adjacent the window by the plurality of mounting blocks wherein the at least one ladder assembly is connected to the rotatable rod so that the plurality of slats are positioned in front of the window and so that rotation of the rod results in tilting of the plurality of slats; a tilting mechanism that is adapted to be connected to the first end of the rotatable rod such that user manipulation of the tilting mechanism results in corresponding rotation of the rotatable rod within the apertures of the plurality of mounting blocks; and a vertical adjustment mechanism that is coupled to at least one of the plurality of mounting blocks so that user manipulation of the vertical adjustment mechanism results in corresponding vertical movement of the plurality of horizontal slats.

Another aspect of the invention comprises a window blind for covering a window of a building, the apparatus comprising: a plurality of horizontal slats captured within a plurality of ladder assemblies; a plurality of interchangeable mounting blocks that are each adapted to be separately mounted to a surface of the building adjacent the window, wherein the plurality of interchangeable blocks each defines an aperture extending therethrough; a rotatable rod having a first and a second end wherein the rotatable rod is positioned within the apertures of the plurality of mounting blocks so as to be rotatable within the apertures when the plurality of mounting blocks are mounted to the surface of the building adjacent the window, wherein the rotatable rod is comprised of a plurality of interchangeable rod sections connected together by a plurality of connectors so that a rotatable rod of varying lengths can be assembled, wherein the plurality of ladder assemblies are connected to the rotatable rod so that the plurality of slats are positioned in front of the window and so that rotation of the rod results in tilting of the plurality of slats; a tilting block containing a tilting mechanism that defines an aperture which receives the first end of the rotatable rod, such that user actuation of the tilting mechanism results in corresponding rotation of the rotatable rod within the apertures of the plurality of mounting blocks; and a vertical adjustment mechanism that is coupled to at least one of the plurality of mounting blocks so that user manipulation of the vertical adjustment mechanism results in corresponding vertical movement of the plurality of horizontal slats.

DETAILED DESCRIPTION OF THE PRESENT INVENTION

Figure 1:
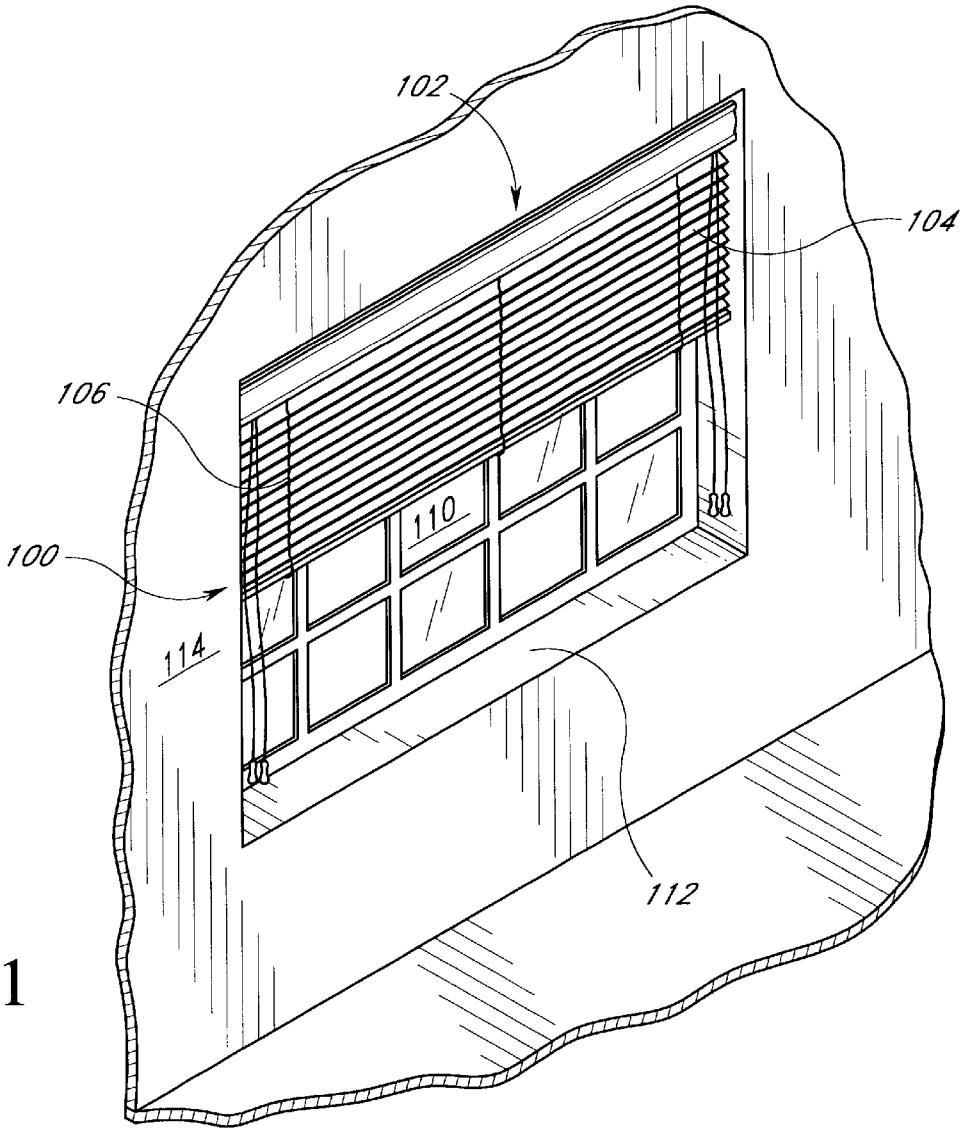
FIG. 1 is an isometric view of one embodiment of a window blind apparatus mounted in a window formed in a wall.

Reference will now be made to the drawings wherein like numerals refer to like parts throughout. FIG. 1 is a perspective view of one embodiment of a window blind apparatus 100 of the present invention as it is mounted to a window frame 112 so as to cover a window 110 formed in a wall 114. As illustrated in FIG. 1, the window blind apparatus 100 includes a mounting section 102 that is mounted to the window frame 112 in a manner that will be described in greater detail below in reference to FIGS. 2A and 2B. The mounting section 102 also includes various lifting and tilt mechanisms adapted to lift and tilt a plurality of horizontal slats 104 captured within ladder assemblies 106 that are connected to the mounting section 102 in a manner that will be described in greater detail below.

Basically, the window blind 100 is comprised of the mounting section 102 that is adapted to secure the window blind 100 in a position to cover the window 110. The mounting section 102 also contains the mechanisms that will allow a user to raise and lower the plurality of slats 104 to a desired vertical position in front of the window and then also cause the horizontal slats 104 to tilt to vary the amount of light being let in through the window 110 and the window blind apparatus 100. The plurality of horizontal slats 104 can be comprised of slats made of a number of materials including aluminum, wood, plastic and the like. Moreover, as will become more fully apparent from the following description, the dimensions of the window blind can be varied during the assembly of the window blind 100 to cover windows of a plurality of different sizes. Hence, the configuration of the window 110 in FIG. 1 should only be taken as an example of one particular application of this embodiment of the window blind apparatus 100.

Figure 2A:
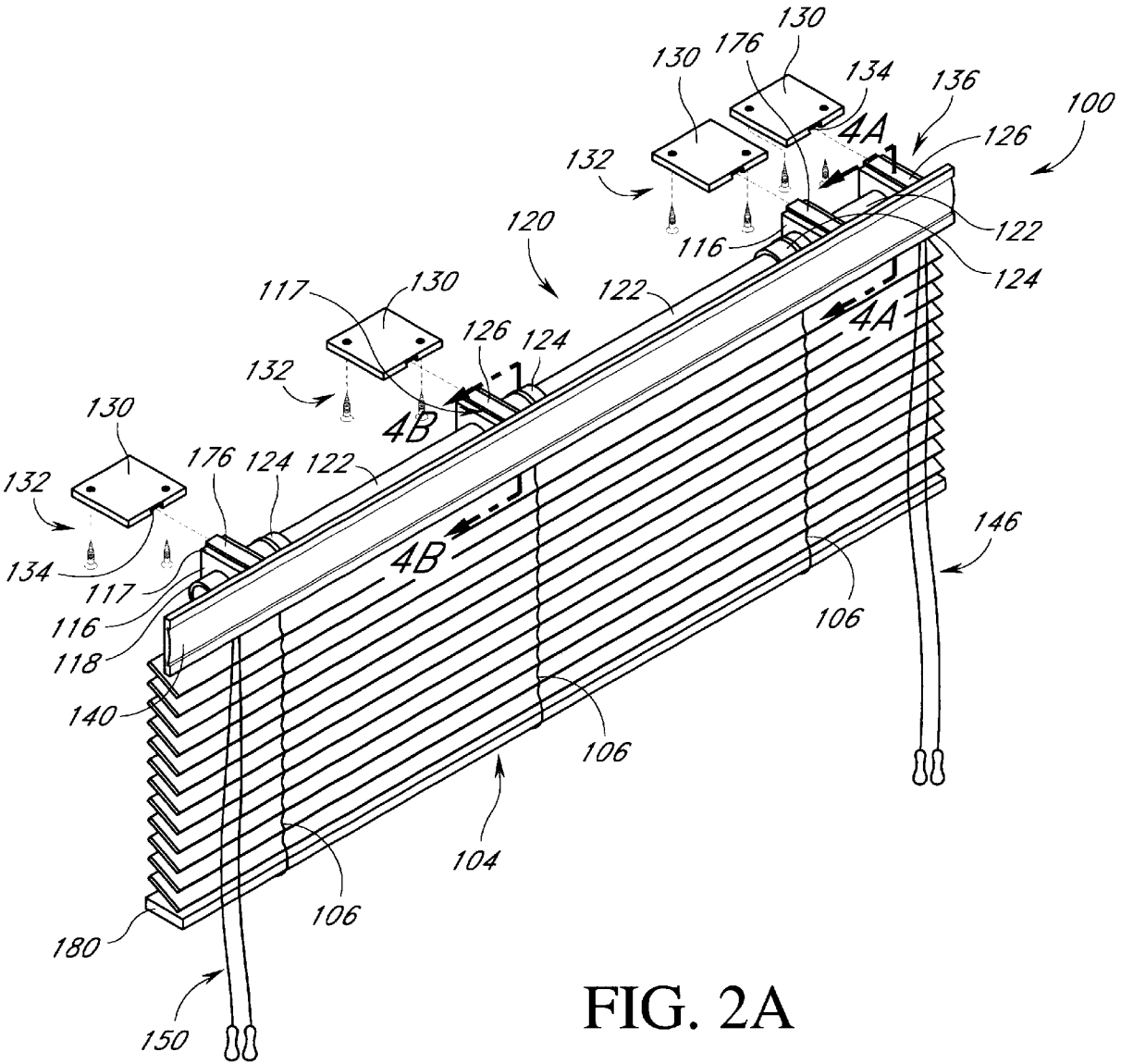
FIGS. 2A and 2B are isometric views of the window blind of FIG. 1 illustrating the manner in which the window blind assembly of FIG. 1 is mounted to the window frame.
Figure 2B:
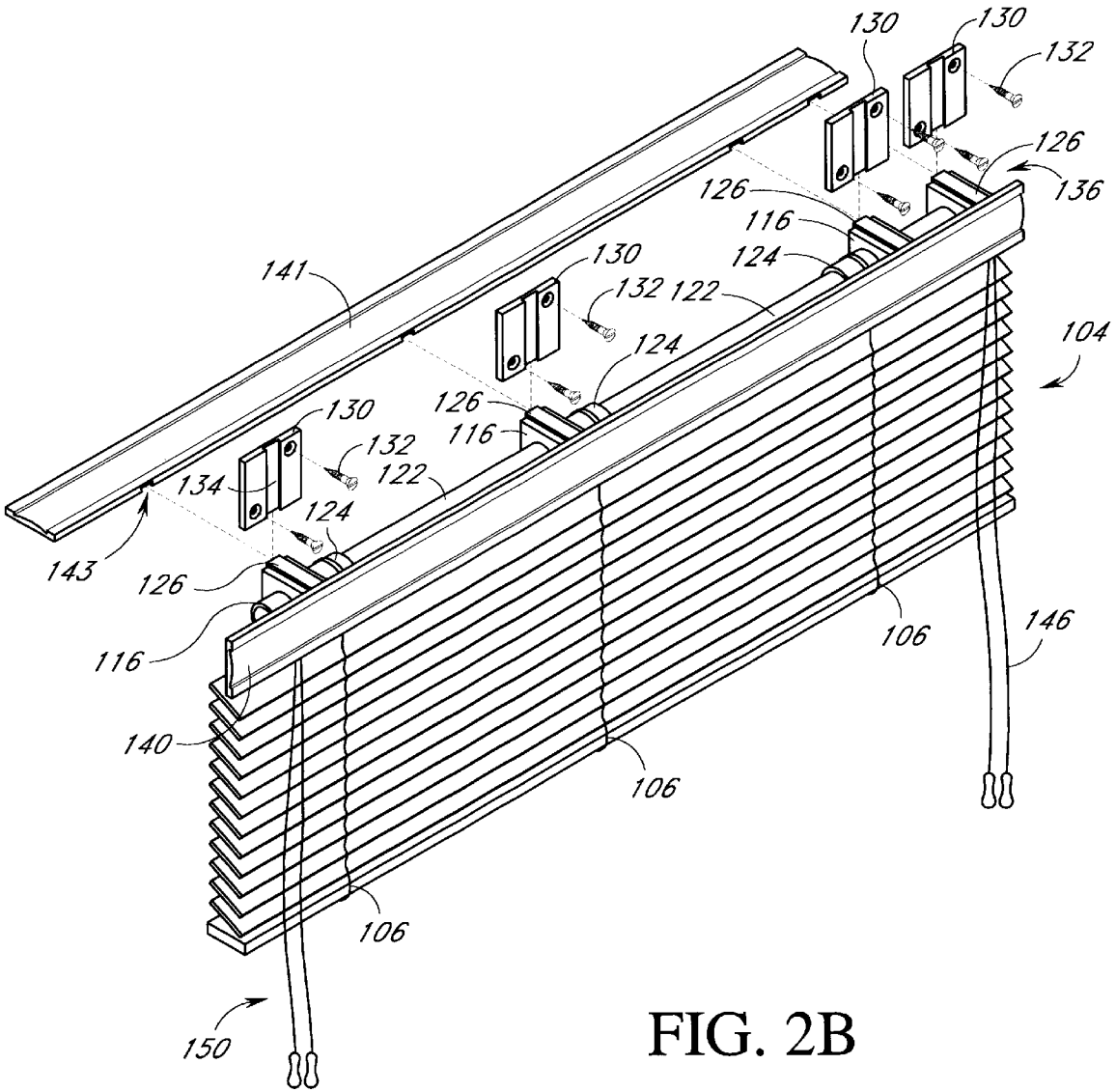

FIGS. 2A and 2B are perspective views which illustrate the components of the mounting section 102 that are adapted to allow for easy installation of the window blind 100 to the window frame 112. In particular, the mounting section 102 includes a plurality of mounting blocks 116 having apertures 118 formed therein. A rotatable mounting rod 120, comprised of a plurality of rod sections 122 interconnected by rod sleeves 124 are positioned so that rod sections 122 are positioned within the apertures 118. Preferably, the sleeves 124 can be adapted to securely retain the rod sections 122 therein, either by friction fit, the use of epoxy or a catch member (not shown) formed in the sleeve 124. As will be discussed in greater detail below, the apertures 118 are sized so as to allow rotational movement of the mounting rod 120 within the apertures 118.

The plurality of mounting blocks 116 in this embodiment can be formed out of plastic using injection molding techniques. As shown in FIGS. 2A and 2B, the mounting blocks 116 are substantially identical and are generally square in shape having the circular aperture 118 formed therein. At least one of the outer surfaces 117 of the mounting blocks 116 has a mounting wedge 126 formed thereon. The mounting wedge 126 extends outward from the outer surface 117 of the mounting block 116.

The mounting wedges 126 on the mounting blocks 116 are adapted to be positioned within grooves 134 formed on a plurality of mounting plates 130. Specifically, the mounting plates 130 are comprised of flat plates that are adapted to be secured to the window frame 112 through the use of screws 132. Each of the mounting plates defines a groove 134 that is adapted to receive the mounting wedge 126 formed on the outer surface 117 of the mounting block 116.

Figure 2C:
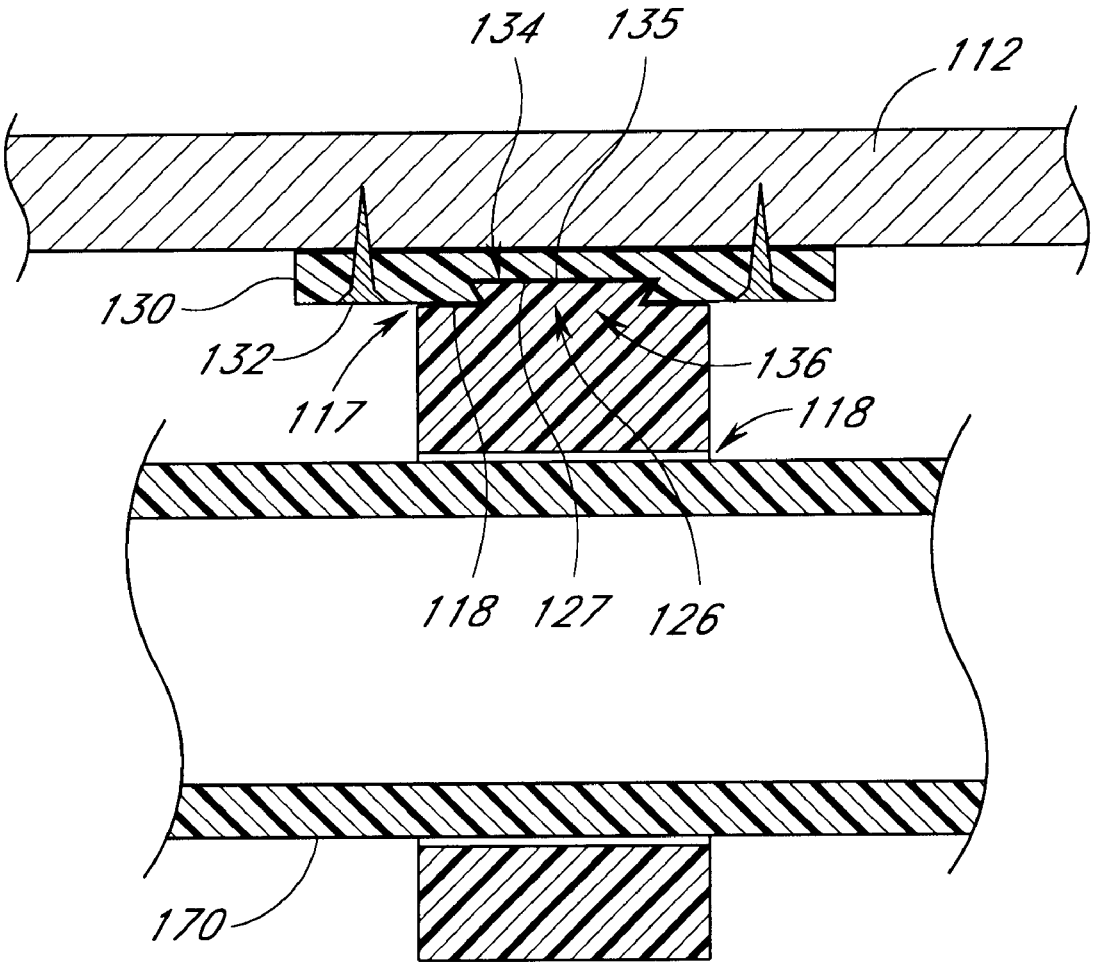
FIG. 2C is an elevational view of a detail of the window blind of FIG. 2A, further illustrating the mounting of the window blind to the window frame.

Referring to FIG. 2C, the mounting wedge 126 is tapered inward so that an outer surface 127 of the wedge 126 has a greater cross-sectional width than the cross-sectional width of the wedge 126 at the interface between the wedge 126 and the outer surface 117 of the mounting block 116. Similarly, the groove 134 is also adapted so that the width of the groove 134 at an inner surface 135 is greater than the width of the groove at the outer aperture 136 of the groove 134. The wedge 126 of the mounting block 116 is therefore mounted in the groove 134 of the mounting plates 130 by sliding the wedge 126 in a direction that is parallel to the axis of the groove 134. The tapering of both the wedge 126 and the groove 134 inhibit the mounting block 116 from being pulled away from the mounting plate 130 in a direction that is perpendicular to the plane of the groove 134.

As is also illustrated in FIG. 2C, the mounting plate 130 can be attached to the window frame 112 using the screws 132. Hence, the mounting blocks 116 are easily mounted to the window frame 112 by initially mounting the mounting plates 130 to the window frame 112 and then positioning the mounting wedges 126 of the mounting blocks 116 in the grooves 134 of the mounting plates so that the mounting block 116 is secured to the window frame 112. Typically, the rotatable rod 120 is captured in the apertures 118 of the mounting blocks 116 and the plurality of slats 104 are connected to the mounting section 102 prior to slidably engaging the wedges 126 into the grooves 134. The installer then simply has to correctly mount the mounting plates 130 to the window frame 112 and then simultaneously position the wedges 126 adjacent the openings to the grooves 134 and then slide the wedges 126 into the grooves 134 in a direction perpendicular to the plane of the window 110 to mount the window blind apparatus 100 to the window frame 112. Hence, the window blind 100 can be mounted in a position adjacent the window 110 by mounting the plates 130 to the window frame 112 and then slidably engaging the mounting blocks 116 with the plates 130.

In one embodiment, the mounting plate 130 will be positioned on the upper surface of the window frame 112. However, it will be appreciated that in some circumstances it may be desirable to mount the window blind assembly 100 directly to a wall adjacent the window 110. In this circumstance, the window blind assembly 100 and, in particularly, the mounting blocks 116 can be adapted to have the mounting wedges 126 formed on two outer surfaces 117 of the mounting block 116 in the manner shown in FIGS. 4B and 4C. The mounting blocks 116 can then be connected to the mounting plates 130 when the mounting plates 130 are attached to a wall so that the plane of the mounting plates 130 are parallel to the plane of the window 110. This alternative mounting configuration is illustrated in greater detail in FIG. 2B. As shown in FIG. 2B, the mounting plates 130 are mounted so as to be parallel to the plane of the window. The mounting blocks have wedges 126 that can be positioned in the grooves 134 by sliding the wedges 126 vertically with respect to the grooves 134. Preferably, the wedges 126 on the mounting blocks 116 are slid from the upper end of the grooves 134 downward to ensure that the wedges 126 are frictionally retained within the grooves 134 to retain the wedges 126 in the grooves 134 against the weight of the window blind assembly 100. In some circumstances, it may be desirable to taper the grooves so that the wedges 126 cannot slide through the length of the grooves 134 thereby detaching the mounting blocks 116 from the mounting plates 130.

As is also shown in FIGS. 2A and 2B, the window blind assembly 100 also includes a tilt actuator block 136 that has the same basic configuration as the mounting blocks 116 and, in this embodiment, includes the mounting wedge 126 and an aperture 222 that is adapted to receive the rod 120. However, as will be described in greater detail herein below, the tilt actuator block 136 also includes a tilt actuator mechanism (not shown) which allows the user to rotate the horizontal slats 104 captured within the ladder assemblies 106, by manipulating the tilt cords 146. The tilt actuator block 136 is attached to an end of the mounting rod 120. As is also shown in FIG. 2A, the tilt actuator block 136 is also adapted to mount to a mounting plate 130 attached to the window frame 112 to provide additional support for the window blind apparatus 100.

As will be more apparent from the following description, the length of the mounting rod 120 can be varied by using different numbers and sizes of rod sections 122 interconnect by the sleeves 124. Having a discrete tilt actuator block 136 that is adapted to attach to and end of the mounting rod 120, allows the tilt actuator block 136 and the tilt mechanism contained therein to be used with horizontal blind assemblies 100 of a plurality of different lengths. Hence, the assembly of window blinds 100 is simplified and made less expensive as substantially identical or interchangeable components, such as the mounting blocks 116 and the tilt actuator block 136, can be used to manufacture window blinds 100 of a plurality of different sizes.

FIGS. 2A and 2B illustrate that a decorative cover member 140, such as a valance, is also attached to the mounting blocks 116 and tilt actuator block 136 so as to cover the mounting blocks 116, tilt actuator block 136 and the mounting rod 120 from view. The attachment of the cover member 140 to the mounting blocks 116 will be described in greater detail in reference to FIG. 3 below. Moreover, as shown in FIG. 2B, when the window blind assembly 100 is attached directly to the wall, it may also be desirable to attach a second decorative cover member 141 so as to cover the top surface of the mounting blocks 116 and the mounting rod 120. In this embodiment, the second decorative plate 141 has a plurality of grooves 143 formed therein that are adapted to engage with the mounting wedges 126 on the mounting block 116 so as to cover the mounting blocks 116 and the mounting rod 120 from two different viewing angles.

Figure 3A:
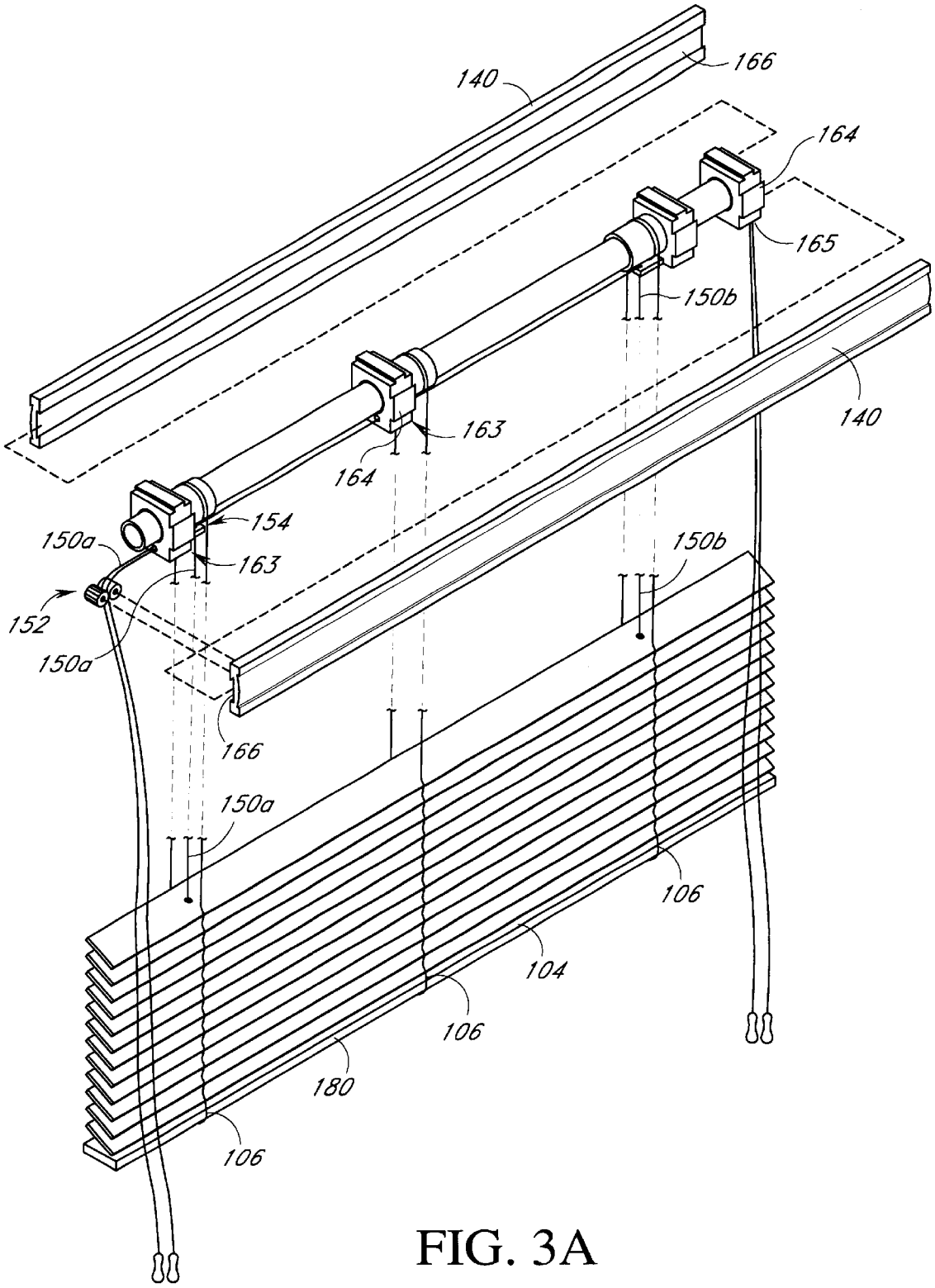
FIG. 3A is an isometric view of the window blind of FIG. 1 illustrating the attachment of an optional decorative members to the window blind assembly.

Referring now to FIG. 3A, the decorative cover member 140 has a groove 166 which preferably extends the full length of the decorative cover member 140. The mounting blocks 116 and the tilt actuator block 136 preferably include wedges 164 formed on a front face 163 that are adapted to slidably engage with the groove 166 on the decorative member 140 so as to secure the decorative cover member 140 to the mounting blocks 116 and the tilt actuator block 136. In this embodiment, the wedges 164 extend across the width of the mounting blocks 116 and the tilt actuator block 136 so that the wedges 164 are transversely slid into the grooves 166 of the first decorative cover member 140 in the manner illustrated in FIG. 3A. The configuration of the outer surfaces of the decorative cover members 140 and 141 will, of course, vary depending upon the aesthetic appearance that is intended to be portrayed by the window blind 100. For example, the outer surfaces of these members can either be flush, channeled, grooved, or have artwork painted thereon.

As is also illustrated in FIG. 3A, the mounting blocks 116 can be adapted to have wedges 164 formed on a back surface so as to be able to receive the decorative member 140 on either side of the mounting block 116. It will be appreciated that when the window blind assembly 100 is mounted to the upper surface of a window frame, placing a decorative member 140 between the mounting blocks 116 and the rotatable member 120 hides the mounting blocks 116 and the rotatable member 120 from view. As the decorative members 140 are mounted to the mounting blocks 116 through the slidable engagement of the wedges 164 and the grooves 166 of the decorative member 140, the decorative members 140 are less likely to fall off as a result of deformation of the decorative member 140 due to exposure to sunlight. Moreover, since the decorative member 140 is secured at a plurality of different places along the length of the decorative member 140, any deformation due to exposure to sunlight is also reduced.

FIG. 3A also illustrates the mechanism by which the horizontal slats 104 are raised and lowered by the user of the window blind assembly 100. In particular, there are vertical adjustment cords 150*a*, 150*b* that are accessible to the user. The cords 150*a*, 150*b* are engaged with a catch mechanism 152, of a type known in the art, that in this embodiment is mounted to an inner surface of the first cover member 140. The catch mechanism 152 inhibits movement of the cords 150*a*, 150*b* unless the user has exerted a transverse force on the cords 150*a*, 150*b* to thereby release the catch mechanism 152 to enable the user to raise or lower the plurality of slats 104 by pulling or releasing the cords 150*a*, 150*b* in a manner that is well known in the art.

After engagement with the catch mechanism 152, the cords 150*a*, 150*b* are then threaded through a cord opening 156 in the mounting block 116 positioned adjacent the catch mechanism 152. As shown in FIG. 3A, each of the mounting blocks 116 include a cord opening 156 that is adapted to receive one or both of the cords 150*a*, 150*b*. Preferably, the vertical adjustment cords 150*a*, 150*b* are adapted to engage with the slats 104 towards the outer end of the slats. The mounting blocks 116 include guides 154 that receive the cords 150*a*, 150*b* from the opening 156 and guide the cords 150*a*, 150*b* towards the attachment points of the slats 104.

Figure 5:
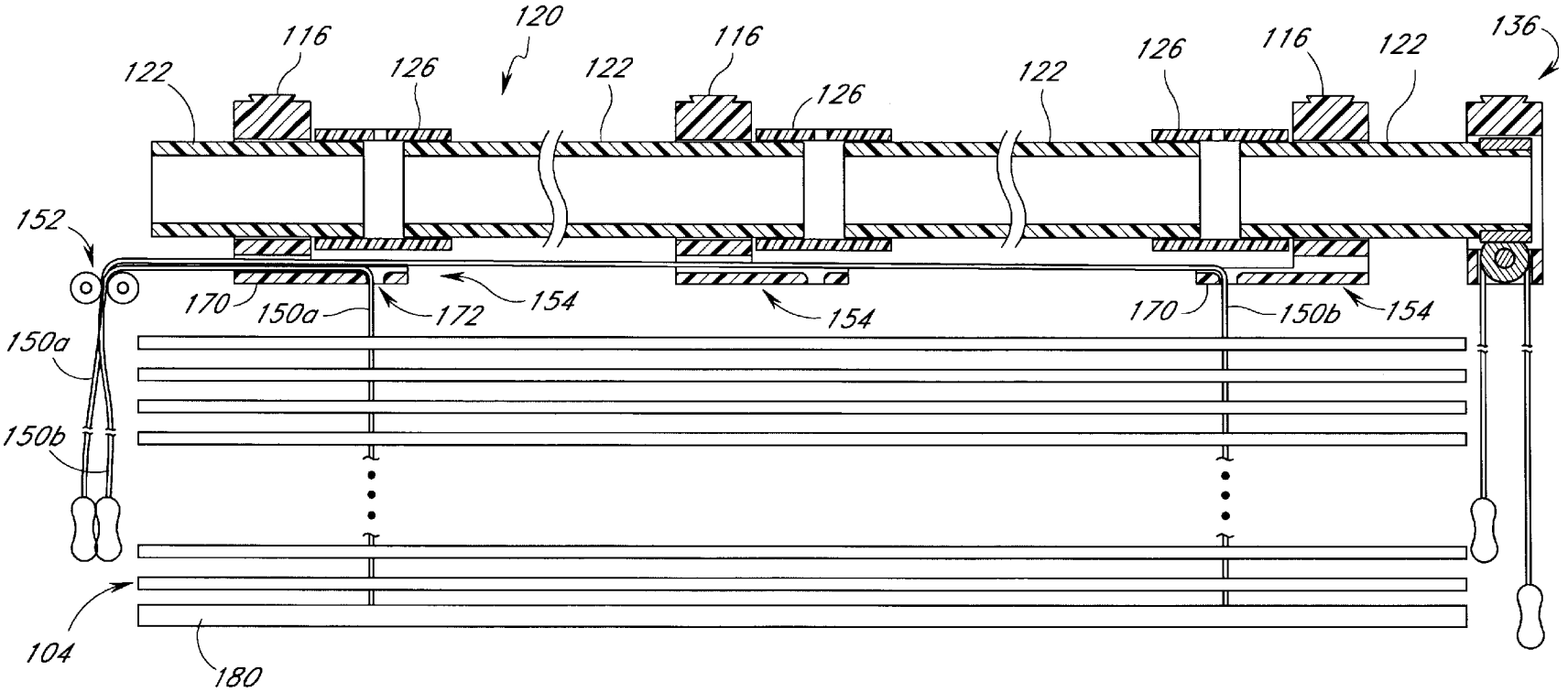
FIG. 5 is a cross-sectional view of FIG. 3A of the window blind of FIG. 1 illustrating the modular attachment of the components of the window blind assembly of FIG. 1.

The configuration of the guides 154 on the mounting blocks 116 is shown in greater detail in FIG. 5. In particular, the guides 154 are comprised of a horizontal plate 170 that extends transversely outward from the mounting block 116 in a direction parallel to the mounting rod 120. The guide plate 170 has an aperture 172 through which the cords 150*a*, 150*b* can be positioned. In particular, the cords 150*a*, 150*b* are then directed through the apertures 172 in the guides 154 and are then directed into openings 160 in each of the slats 104. As shown in FIG. 3, the cords 150*a*, 150*b* are positioned through openings 160 that are formed towards the ends of the slats 104 at a position that is approximately one-half of the way across the width of the slats 104. In this embodiment, the cords 150*a*, 150*b* are positioned so as to be interposed between two outer ladder strings 174, 176 of the ladder assemblies 106*a*, 106*b*. The vertical adjustment cords 150*a*, 150*b* are then connected to a bottom rail 180 so that when the user pulls on the cords 150*a*, 150*b* the bottom-most slat 180 and all of the intervening slats 104 are raised or lowered in a manner known in the art. As will be described in greater detail below, the outer ladder strings 174, 176 are mounted to the connectors 126 of the rotatable rod 120. In this embodiment, a connector 120 is positioned adjacent the mounting blocks 116 that the cords 150*a* or 150*b* are positioned so as to extend through the apertures 172 in the guide plate 170 to connect to the slats 104. In this way, the lift cords 150*a*, 150*b* and the ladder assemblies 106 can be vertically aligned.

As shown in FIG. 5, the guides 154 are an integral component of each of the mounting blocks 116. Making the guides 154 an integral component of the mounting blocks 116 means that during the manufacture of the window blind assembly 100, that the same mounting block 116 can be used interchangeably with any other mounting block by simply reversing the orientation of the mounting blocks 116. Preferably, the mounting blocks 116 are manufactured through the use of injection molded plastic so that a single mold can be used to make all of the blocks 116.

Figure 3B:
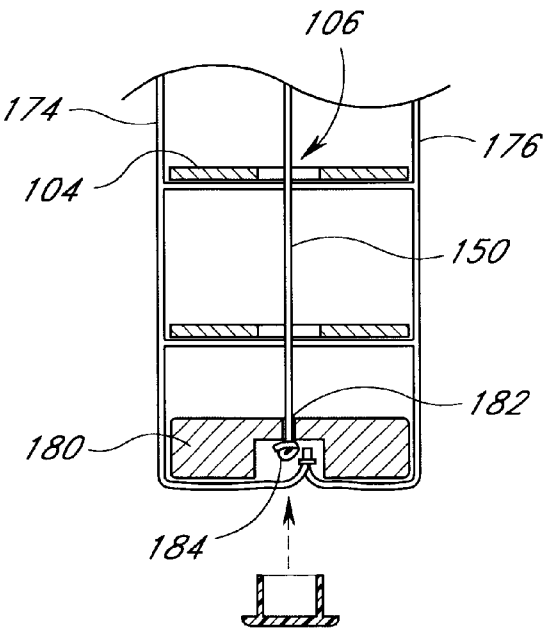
FIG. 3B is an isometric view of a detail of the window blind of FIG. 3A further illustrating how the horizontal slats are secured in the window blind.

FIG. 3B illustrates the connection of the cords 150*a*, 150*b* to the bottom rail 180. In particular, the bottom rail 180 has a hole 182 extending therethrough which has a capture recess 184 that is mounted adjacent the hole 182. The end of the cord 150*a*, 150*b* is knotted and is adapted to prevent the cord 150 from exiting the recess 184 through the hole 182 during lifting of the cord 150*a*, 150*b*. A cap 186 is adapted to be positioned within the recess 184. In this embodiment, the ends of the outer ladder strings 174, 176 are also positioned within the recess 184 so that the cap 186 can be positioned within the recess 184 to retain both the outer ladder strings 174, 176 and the vertical adjustment cords 150*a*, 150*b* in the recess 184.

Hence, the cords 150 are secured to the bottom rail 180 so that the user can raise and lower the bottom rail by pulling or releasing the free ends of the cords 150*a*, 150*b* respectively. The raising of the bottom rail 150*a*, 150*b* through the manipulation of the lift lower cords 150*a*, 150*b* results in the intervening plurality of slats 104 being raised and lowered in a manner that is similar to the operation of prior art horizontal blinds. It will be appreciated that the assembly of the vertical adjustment mechanism of this embodiment of the window blind apparatus 100 is simplified in that the assembler simply has to thread the cords 150*a*, 150*b* through the openings 156 in the mounting blocks 116 and through the apertures 172 and the guide plates 170 attached to the mounting blocks 116 at the desired locations, then thread the lift lower cords 150*a*, 150*b* through each of the openings 106 in each of the slats 104 until it is engaged with the recess 184 in the bottom rail 180. A skilled assembler should be able to accomplish this task in a very minimal amount of time thereby lowering this portion of the assembly cost of the window blind apparatus 100.

Figure 4D:
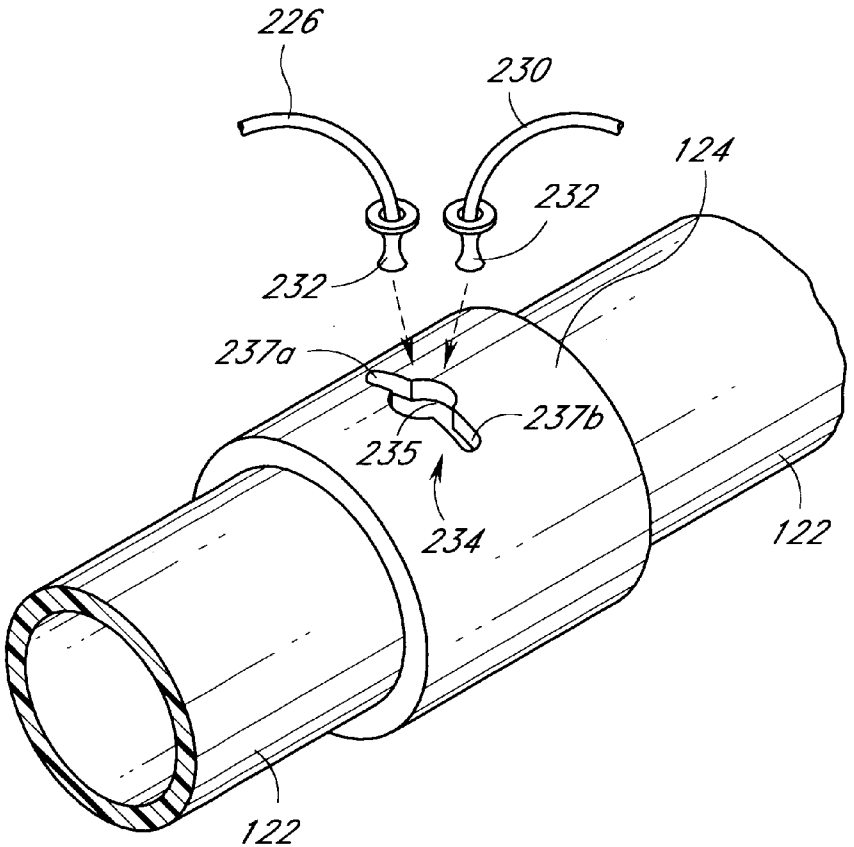
FIG. 4D is an isometric view of a detail of the window blind of FIG. 2A further illustrating the manner in which the horizontal slats are secured to the window blind apparatus.
Figures 4A, 4B, 4C:
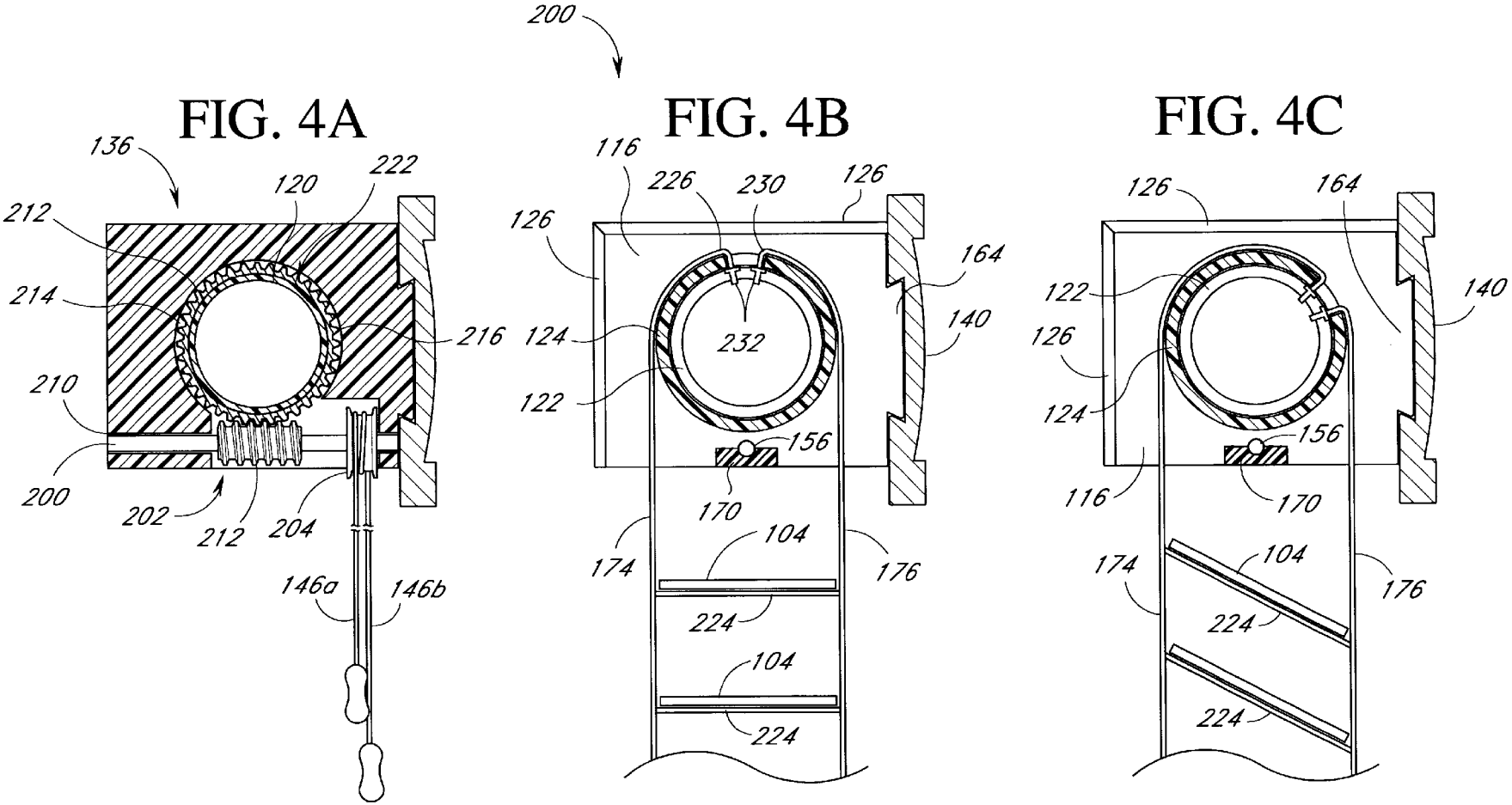
FIGS. 4A–4C are cross-sectional views, illustrating the components of a tilting mechanism of the window blind of FIG. 1.

FIGS. 4A–4D illustrate the components of a tilting mechanism 200 that is adapted to allow the user to tilt or rotate the slats 104 to vary the amount of light that will be transmitted through the window blind 100 when the window blind 100 is lowered so as to be positioned in front of the window 110. Referring initially to FIG. 4A, one embodiment of the tilt actuator 202 that is contained within the tilt actuator block 136 is shown. In particular, the tilt actuator block 136 includes a spool 204 that is fixedly attached to a shaft 206 which is rotatably mounted within an opening 210 formed in the interior of the tilt actuator block 136. The tilt cords 146 are wrapped about the spool so that vertical movement of the tilt cords 146 result in rotational movement of the spool 204 and the shaft 206. A worm gear 212 is fixedly mounted about the shaft 206 such that vertical movement of the tilt cords 146 result in rotational movement of the worm gear 212. As shown in FIG. 4A, there are, in fact, two tilt cords 146*a*, 146*b* which thereby allow the spool 204, the shaft 206 and the worm gear 212 to rotate in two rotational directions.

The tilt actuator block 136 also includes a circular opening 214 that receives a cylindrical gear 216 that is rotatably positioned within the opening 214 so as to be mechanically engaged with the worm gear 212 via an opening 220. The cylindrical gear 216 is engaged with the worm gear 212 such that rotation of the worm gear 212 results in corresponding rotation of the cylindrical gear 216. The cylindrical gear 216 includes an opening 222 that is adapted to receive the mounting rod 120. Preferably, the mounting rod 120 is frictionally engaged in the opening 222 of the radial gear 216 such that manipulation of the cords 146 causing rotation of the worm gear 212 corresponds to rotation of the mounting rod 120 in the manner shown in FIGS. 4B and 4C.

In particular, FIGS. 4B and 4C illustrate how the ladder assemblies 106 are attached to the mounting rod 120. As shown in FIG. 4B, each ladder assembly 106 is comprised of the two parallel ladder strings 174, 176 which extend vertically downward from the mounting rod 120. Brace strings 224 interconnect the vertical ladder strings 174, 176 at periodic intervals. The plurality of slats 104 are positioned on or between the brace strings 224 so as to rest on the brace strings 224 of at least two ladder assemblies 106. In the embodiment shown in FIG. 1, there are, in fact, three ladder assemblies 106. Positioning the lift lower cords 150*a*, 150*b* through the openings 160 in the slats 104 prevent the slats 104 from falling off of the brace strings 224 during raising and lowering of the slats 104. Preferably, the lifting and lowering cords 150*a*, 150*b* are alternatively woven between adjacent brace strings 224 so as to further reduce the likelihood of transverse movement of the slats 104 and dislodgment off of the brace strings 224.

A first end 226 of the ladder string 174 and a first end 230 of the ladder string 176 are each equipped with securing members 232. In this embodiment, the sleeves 124 that interconnect the rod sections 122 have an opening 234 that is adapted to receive the securing members 232. FIG. 4D illustrates the opening 234 in greater detail. In particular, the openings 234 formed in each of the sleeves 124 has a central portion 235 that is adapted to receive the securing members 232 on the ends 226, 230 of the outer ladder strings 174, 176. Two channels 237*a*, 237*b* are formed in the sleeves 124 extending outward from the central portion 235 of the opening 234. The securing members 232 are positioned within the channels 237*a*, 237*b* so that the securing members 232 are frictionally retained in the channels 237*a*, 237*b*. In this way, the outer ladder strings 174, 176 can be secured to the sleeves 124 which form a portion of the rotatable mounting rod 120. It will be appreciated that simply positioning the ends 226, 230 of the outer ladder strings 174, 176 into the channels 237*a*, 237*b* of the opening 234 greatly simplifies the task of connecting the ladder assemblies 106 top the mounting section 104 of the window blind apparatus 104.

Hence, the attachment of the securing members 232 into the opening 234 in the sleeve 122 results in the ladder assembly 106 being secured to the mounting rod 120. In this embodiment, the mounting rod 120 has a relatively large diameter, e.g., ¾" to 1", and the securing members 232 are secured to the openings 234 in the sleeve 124 at the top or "12 o'clock" position of the mounting rod 120 when the slats 104 are substantially perpendicular to the plane of the window 110 in the manner shown in FIG. 4B. Manipulation of the tilt cords 146*a*, 146*b*, however, result in rotation of the control rod 120 in the manner that was described previously in connection with FIG. 4A. As shown in FIG. 4C, rotation of the tilt rod in the clockwise direction results in the effective length of the ladder string 174 shortening while the effective length of the ladder string 176 lengthens which thereby cause the slats 104 to also rotate or tilt in a generally clockwise direction in the manner shown in FIG. 4C. Hence, the operator can adjust the tilt of the slats 104 by pulling on the tilt cords 146 which induce the mounting rod 120 to rotate within the openings 118 of the mounting blocks 116 as the mounting rod 120 is captured within the opening 218 of the cylindrical gear 216 of the tilt actuator 202. This rotation of the mounting rod 120 results in tilting of the slats 104. The tilting mechanism 200 may also include a catch mechanism which retains the slats 104 in a desired tilted orientation.

FIG. 5 further illustrates another desirable feature of this embodiment of the window blind apparatus 100. In particular, the components of the window blind apparatus 100 are all essentially modular which simplifies the assembly of the window blind apparatus 100. Moreover, as the components are all modular, the mounting section 102 of the window blind 100, which incorporates both the lifting mechanism 148 and the tilting mechanism 200, can be constructed for window blinds having a variety of different lengths using essentially the same components. In particular, the rotatable mounting rod 120 can be made from a plurality of mounting sections 122 that are interconnected with the mounting rod sleeves 124 until a mounting rod 120 of a desired length is achieved. The mounting blocks 116 can be periodically spaced along the mounting rod 120 so that adequate support is achieved for the weight of the window blind. Moreover, additional mounting blocks 116 can be added, as needed, anywhere along the mounting rod 120 to provide additional support for blinds incorporating heavier slats. The tilt actuator block 136 containing the tilting mechanism 200 can then be positioned on one end of the mounting rod 120. It will be appreciated that the tilt actuator block 136 containing the tilting mechanism 200 can be used with mounting rods having a variety of different lengths.

The lifting mechanism 148 can then be attached to the slats 104 by extending the lifting mechanism through the openings 156 in the mounting blocks 116 and then suspending the lift lower cords 154 through the apertures 172 in the guide plates 170 that are, in this embodiment, an integral portion of the mounting blocks 146. The lift cords 150 can then be attached to the bottom rail 180 in a simple manner. Further, the sleeves 126, which define the attachment location for the ladder assemblies 106 can also be positioned at any of a number of locations along the mounting rod 120 by selection of appropriately sized mounting rod sections 122.

Hence, the attachment points of the ladder assemblies 106 to the mounting section 102 can also be easily adjusted to accommodate different sizes of blinds.

Hence, the assembly of the window blind assembly 100 in this embodiment is greatly simplified over the assembly of window blinds of the prior art. There are no intricate connections that are required to interconnect the plurality of slats 104 to either the tilting mechanism or the lifting mechanism. The lack of a head rail further simplifies the assembly process, as the assembler does not have to interconnect components in the confined space of the head rail. Moreover, the components comprising the mounting section 102 of the window blinds can be used to form mounting sections 102 for window blinds having a variety of different lengths. Further, since the materials comprising the components of the mounting section 102 are discrete components made of generally robust material such as plastics, the likelihood of damage to any of the components comprising the mounting section 102, the lifting mechanism 148, or the tilting mechanism 200 is greatly reduced when compared to window blinds of the prior art.

Furthermore, the mounting of the window blind assembly 100 is also simplified in that the mounting section 102 with the attached plurality of slats 104 can be mounted by positioning the wedges 126 on the plurality of mounting blocks 116 into corresponding grooves 134 formed in mounting plates 130 that are attached to either the window frame 112 or the wall 114 in the manner described above. As the grooves extend in a direction perpendicular to the plane of the window 110, the installer simply has to correctly orient the mounting wedges 126 on the mounting blocks 116 with respect to the grooves and then push the mounting section 102 into the plane of the window to securely mount the window blind 100 to the window frame 112. Alternatively, if the mounting plates 130 are attached to the outer surface of the wall 114 surrounding the window 116, the installer simply has to slide the mounting blocks in a generally downward motion so as to engage the wedges 126 in the grooves 134 of the mounting plates 130. Consequently, the window blind 100 of the preferred embodiments illustrates a window blind assembly that is simpler to manufacture and easier to install.

Figure 6:
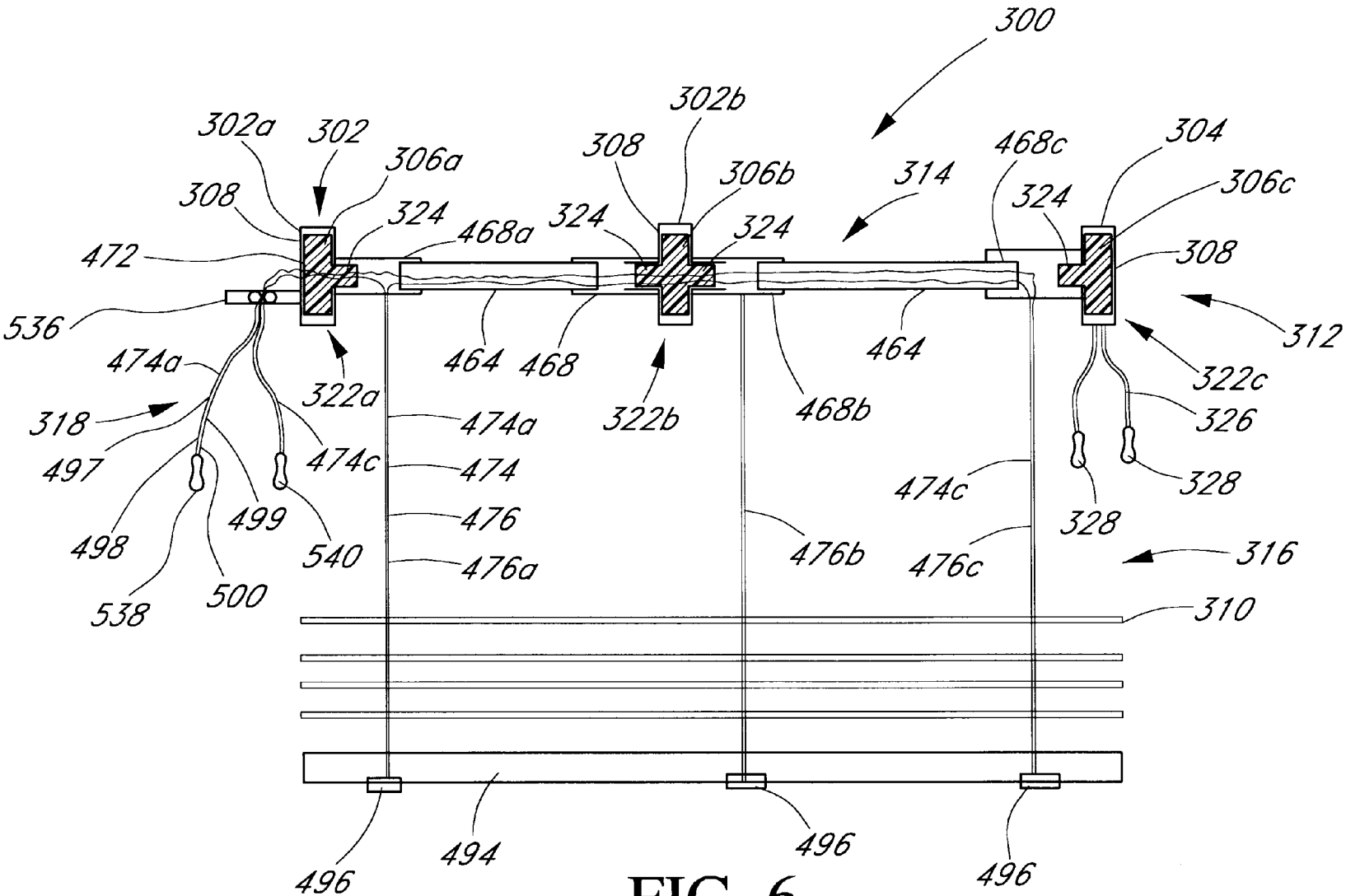
FIG. 6 is a cross-sectional view of another embodiment of a window blind apparatus.

Reference will now be made to FIG. 6 which illustrates another embodiment of a window blind 300 of the present invention that provides the same basic functionality of the window blind 100 described previously in connection with FIG. 1. However, as will be described in greater detail below, the window blind 300 comprises at least one mounting block 302 and a tilt actuator block 304 that each include a similarly formed rotatable member 306*a*–306*d* positioned within identically formed housing assemblies 308. Furthermore, the window blind 300 is designed so that a plurality of slats 310 of the window blind 300 can more effectively be maintained in a closed position.

As shown in FIG. 6, the window blind 300 comprises a mounting section 312 having the mounting blocks 302, the tilt actuator block 304, and a rod assembly 314 that extends between the blocks 302, 304. Furthermore, the window blind 300 further comprises a slat assembly 316 having the slats 310 and a lifting mechanism 318 adapted to raise and lower the slat assembly 316. Moreover, as will be described in greater detail below in connection with FIGS. 16A–C, the window blind 300 further comprises a valance assembly 320 (not shown in FIG. 6) adapted so as to cover the mounting section 312.

In the preferred embodiments, the mounting blocks 302 and the tilt actuator block 304 of the mounting section 312 separately mount to a surface of a wall adjacent a window. In one embodiment, the mounting/tilt blocks 302, 304 are mounted in the manner of the mounting blocks and tilt actuator block described previously in connection with FIGS. 2A and 2B. Specifically, in this embodiment, the mounting plates 130 of FIG. 2A are mounted to the wall and the blocks 302, 304 are adapted to couple with the mounting plates 130. However, it will be appreciated that, in other embodiments, the blocks 302, 304 could be mounted using any of a number of alternative methods without departing from the spirit of the present invention. For example, the blocks 302, 304 could be mounted by directly attaching the blocks 302, 304 to the surface of the wall adjacent the window using mounting screws known in the art.

As shown in FIG. 6, each of the mounting/tilt blocks 302, 304 includes a pivot assembly 322*a*, 322*b*, 322*c* or 322*d* having at least one mounting post 324 extending therefrom so as to provide the rod assembly 314 with pivoting means as will be described in greater detail below. Moreover, the pivot assemblies 322*c*, 322*d* of the tilt actuator blocks 304 further comprise a user input device that, when activated by a user, cause the slats 310 of the window blind 300 to rotate.

In the embodiment of FIG. 6, the mounting section 312 comprises the outer mounting block 302*a* at the upper left corner, the inner mounting block 302*b* in the middle, and the tilt actuator block 304 at the upper right corner. However, in other embodiments, the inner mounting block 302*b* may be omitted if the width of the window blind 300 is suitably short or the window blind 300 may include additional inner mounting blocks 302*b* so as to enable the window blind 300 to have an increased width.

As shown in FIG. 6, the outer mounting block 302*a* and the inner mounting block 302*b* are substantially similar except that the inner mounting block 302*b* includes the pivot assembly 322*b* having two opposing mounting posts 324 and the outer mounting block 302*a* includes the pivot assembly 322*a* having only one mounting post 324. Furthermore, in the embodiment of FIG. 6, the tilt actuator block 304 is positioned within the cord-driven pivot assembly 322*c* and the tilt activator block 304 includes the user input device in the form of a tilt cord 326 extending from the block 304 that allows a user to rotate the slats 310 of the window blind 300 by pulling on the ends 328 of the tilt cord 326. Alternatively, as will be described in greater detail below in connection with FIG. 8, the tilt actuator block 304 may instead include the wand-driven pivot assembly 322*d* having a wand 330 extending therefrom that acts as the user input device so as to enable a user to rotate the slats 310 by rotating the wand 330.

One advantage that is provided by the mounting blocks 302 and the tilt blocks 304 is that they are each comprised of the identically formed housing assembly 308. As will be described in greater detail below, the housing assembly 308 is adapted so that the mounting block 302 formed therefrom can be configured either as the inside mounting block 302*a* or the outside mounting block 302*b*. Furthermore, the housing assembly 308 also houses the tilt actuator block 304 in either the cord-driven configuration or the wand-driven configuration.

It will be further appreciated from the following discussion, that the use of interchangeable housing assemblies 308 for the mounting blocks and the two different configurations of tilt actuator blocks greatly simplifies the assembly of the window blind apparatus. At the manufacturing stage, the housing assemblies 308 can be mass produced into a single configuration and can then be easily adapted to the desired basic mounting components of the window blind apparatus. Moreover, as will be described in greater detail below, the use of additional modular components allows the same basic components to be used to form window blind apparatuses of virtually any required size while significantly reducing the need for parts custom made for particular applications.

Figure 7A:
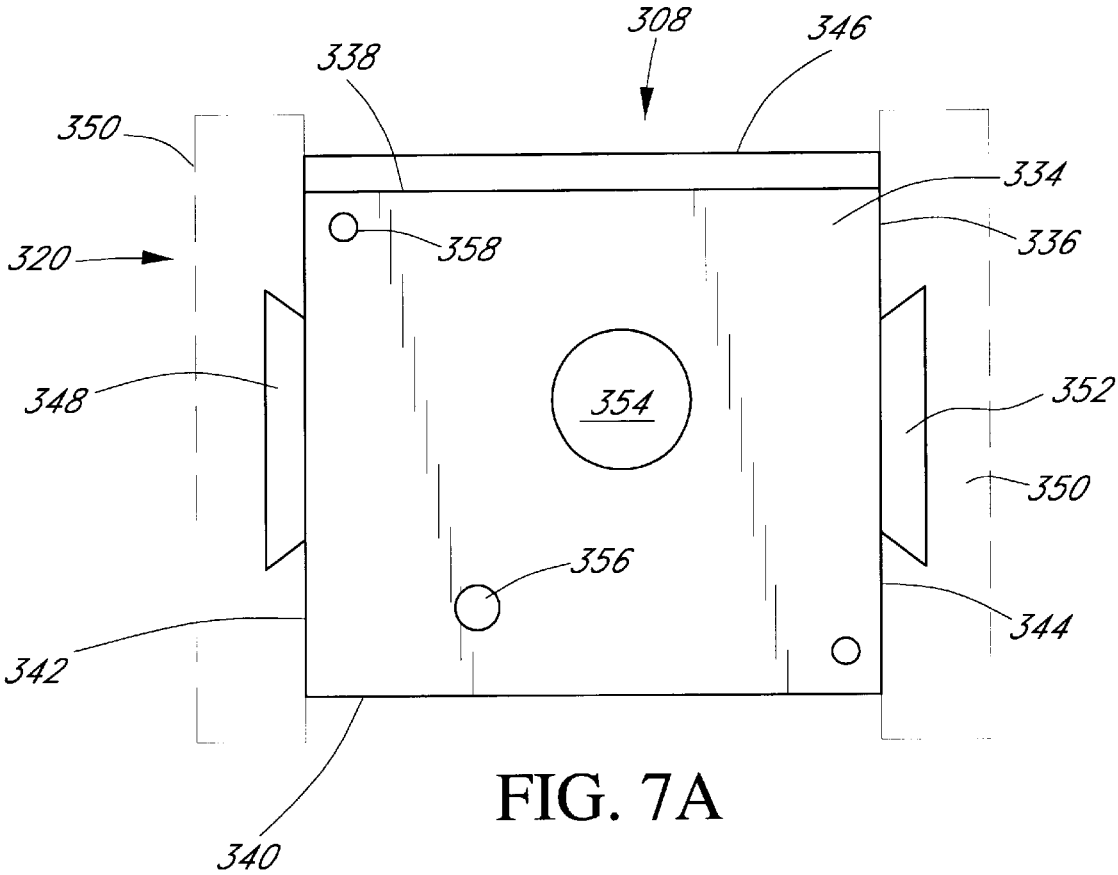
FIG. 7A is an elevational side view of a housing assembly of a mounting block of the window blind apparatus of FIG. 6.
Figure 7B:
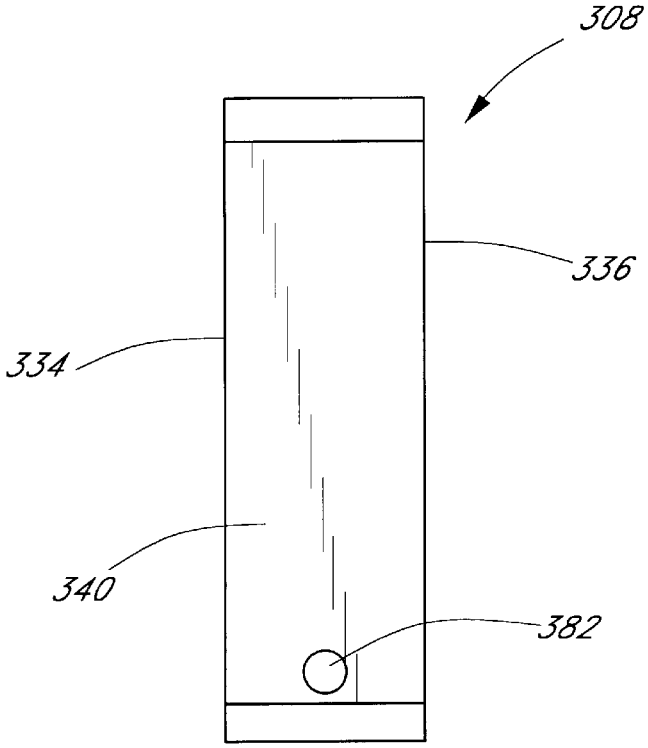
FIG. 7B is an bottom side view of the housing assembly of FIG. 7A.
Figure 7C:
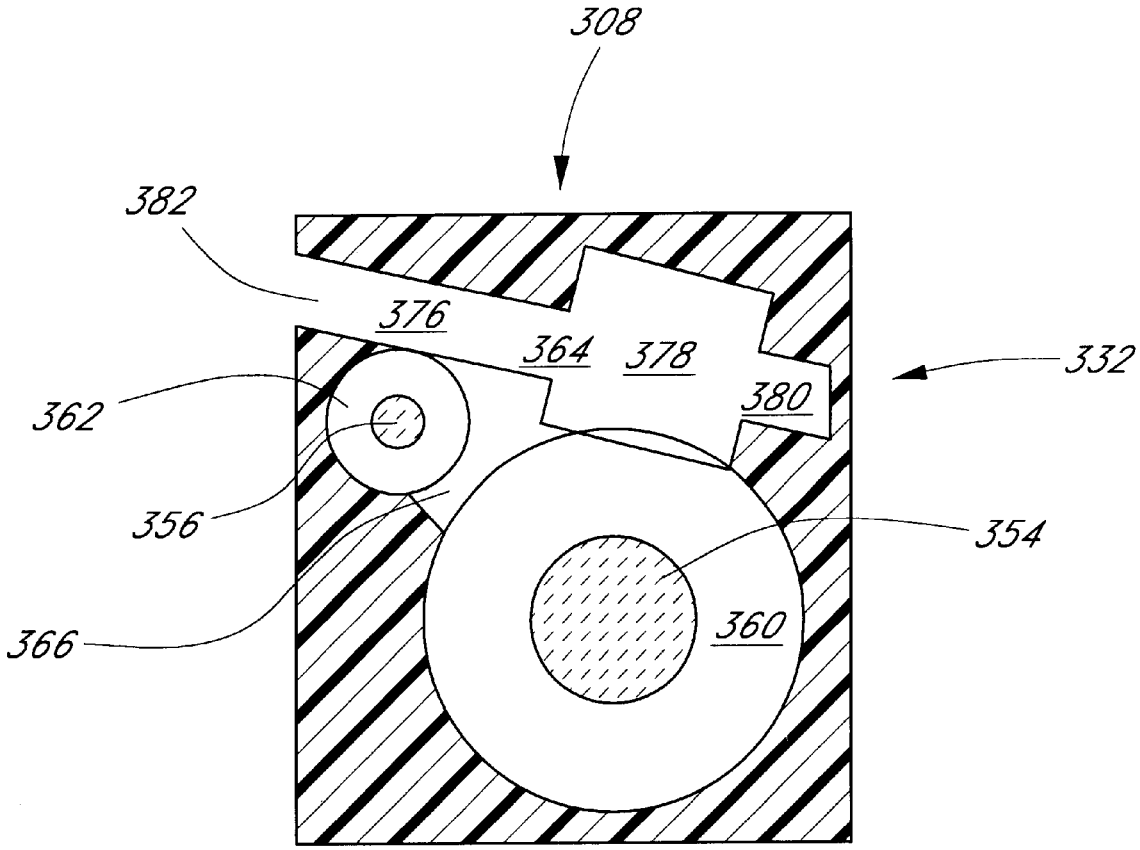
FIG. 7C is a cross sectional view of the housing assembly of FIG. 7A.

Reference will now be made to FIGS. 7A–7C which illustrate the housing assembly 308 of the mounting/tilt blocks 302, 304 in greater detail. In particular, FIGS. 7A and 7B illustrate the exterior surfaces of the housing assembly 308. Furthermore, FIG. 7C is a cross-sectional view of the housing assembly 308 which illustrates a plurality of interior spaces 332 formed within the housing assembly that are adapted to receive the pivot assemblies 322*a*–322*d* of the mounting/tilt blocks 302, 304 as will be described in greater detail below in connection with FIGS. 8–11.

As shown in FIGS. 7A and 7B, the housing assembly 308 is preferably shaped so as to comprise a first broad generally square outer surface 334, a second broad generally square outer surface 336 that opposes the first broad outer surface 334, and a plurality of narrow outer side surfaces that interconnect the broad outer surfaces 334, 336. The side surfaces preferably include an upper surface 338, a lower surface 340, a front surface 342, and a rear surface 344. Extending from the upper surface 338, in one embodiment, is a mounting wedge 346 that allows the housing assembly 308 to be mounted to the horizontally mounted plate of FIG. 2A. Extending from the front surface 342, in one embodiment, is a mounting wedge 348 that may be used to mount a decorative cover member 350 (shown in phantom) of the valance assembly 320 in the manner of FIG. 4C. Extending from the rear surface 344, in one embodiment, is a horizontally aligned mounting wedge 352 that allows the housing assembly 308 to be mounted to a vertically mounted plate having a matching horizontally aligned mounting slot. Alternatively, the wedge 352 may be used to mount a second decorative cover member 350 (shown in phantom) of the valance assembly 320 in the manner of FIG. 4C so as to provide a more aesthetically pleasing view for viewers who are looking toward the window blind 300 from outside the adjacent window.

As shown in FIG. 7A, the housing assembly 308 further comprises a plurality of apertures that extend between the broad surfaces 334, 336 of the housing assembly 308. In particular, the plurality of apertures include a mounting post aperture 354, a cord roller aperture 356, and at least one interconnect aperture 358. As will be described in greater detail below, the mounting post aperture 354 and the cord roller aperture 356 provide pivotal mounting means for internal components that are housed within the housing assembly 308. Furthermore, as will also be described below, the interconnect apertures 358 allow an interconnecting member to be extended therethrough so as to provide a means for assembling the housing assembly into an integrated unit.

As shown in FIG. 7C, the housing assembly 308 substantially encloses a cavity which comprises a plurality of spaces 332. In particular, the spaces 332 include a spool space 360, a cord roller space 362, a worm space 364, and a tilt cord space 366. The spool space 360 is positioned so as to be centered about the mounting post aperture 354 (shown in phantom) and is adapted to allow a rotatable gear 368 or hub 370, 372 (FIGS. 8–11) to be positioned therein as will be described in greater detail below such that the axis of rotation of the gear/hub 368, 370, 372 extends along the mounting post aperture 354. The cord roller space 362 is positioned so as to be centered about the cord roller aperture 356 (shown in phantom) and is adapted to allow a rotatable cord roller 374 to be positioned therein as will be described in greater detail below in connection with FIG. 9 such that the axis of rotation of the cord roller 374 extends along the cord roller aperture 356.

As shown in FIG. 7C, the worm space 364 comprises a shaft space 376, a head space 378, and a tip space 380. In particular, the shaft space 376 linearly extends from a shaft opening 382 in the lower side surface 340 to the head space 378. Moreover, the head space 378 is positioned so as to partially overlay the spool space 360. Furthermore, the tip space 380 extends from the head space 378 and is positioned so as to be aligned with the shaft space 376. Thus, the worm space 364 is formed with an elongated axis that extends from the shaft space 376 to the tip space 380 so as to provide a means for positioning a worm 384 within the housing assembly 308 as will be described in greater detail below in connection with FIG. 8.

As shown in FIG. 7C, the tilt cord space 366 extends between the spool space 360, the cord roller space 362 and the worm space 364. As will be described in greater detail below in connection with FIG. 9, the tilt cord space 366 allows the tilt cord 326 to extend from the shaft opening 382 in the lower side surface 340 of the housing assembly 308 to the spool space 360 so as to enable the housing assembly 308 to be configured as the cord-driven tilt actuator block 304*c*.

As mentioned previously, in one embodiment, the housing assemblies 308 are identically formed. However, it will be appreciated that, in another embodiment, the housing assembly 308 of the mounting blocks 302 could be formed with fewer inner spaces. In particular, since the pivot assemblies 322*a*, 322*b* of the mounting blocks 302 are preferably comprised of only the rotatable members 306*a*–306*b*, the housing assemblies 308 could be formed without the cord roller space 362, the worm space 364, and the tilt cord space 366. Furthermore, the housing assemblies 308 could be formed without the cord roller aperture 356 and the shaft opening 382.

Figure 8A:
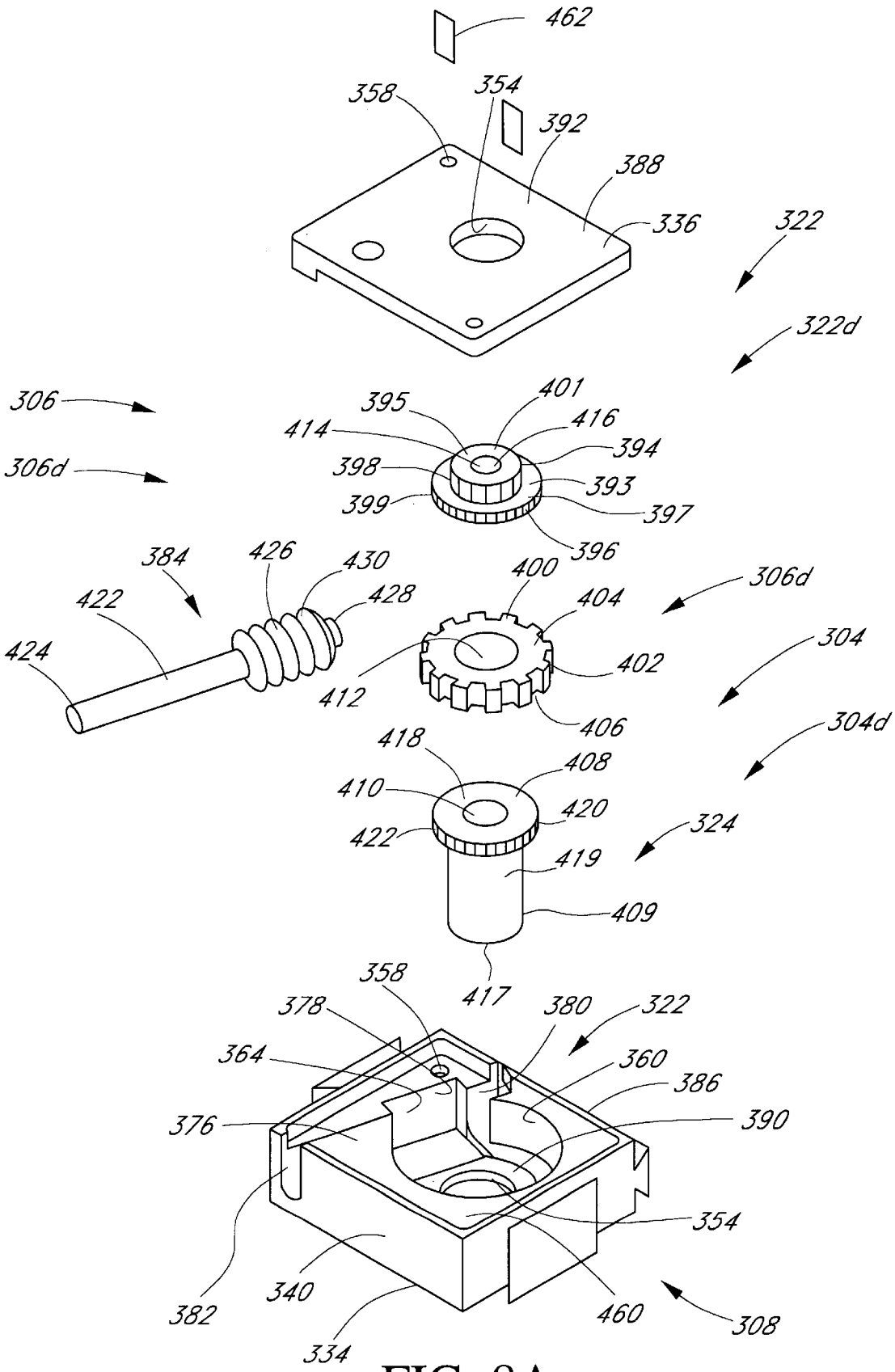
FIG. 8A is an exploded view of a wand-driven tilt actuator block of the window blind of FIG. 6.

Reference will now be made to FIGS. 8A–11B which illustrate the pivot assemblies 322*a* positioned within the housing assemblies 308 of the tilt/mounting blocks 304, 302 of the window blind 300 in greater detail. In particular, FIGS. 8A and 8B illustrate the wand-driven tilt actuator block 304d having the pivot assembly 322*d*, FIGS. 9A and 9B illustrate the cord-driven tilt actuator block 304*c* having the pivot assembly 322*c*, FIGS. 10A and 10B illustrate the outer mounting block 302*a* having the pivot assembly 322*a*, and FIG. 11A illustrates the inner mounting block 302*b* having the pivot assembly 322*b*. Furthermore, the pivot assemblies 322*d*, 322*c*, 322*a*, and 322*b* of FIGS. 8A–11A respectively comprise the rotatable members 306*d*, 306*c*, 306*a* and 306*b* that are each substantially formed of a central section interposed between and interconnected with a first and second end section as will be described in greater detail below in connection with FIG. 11B.

As shown in FIGS. 8A–11A, in one embodiment, the housing assembly 308 includes a main section 386 having the spaces 332 formed therein as previously described in connection with FIGS. 7A–7C and a cover plate 388 which attaches to the main section 386 so as to substantially enclose the spaces 322. In particular, the main section 386 includes a first wall 390 of the housing assembly 308 such that the outer surface of the first wall 390 is also the first broad outer surface 334 of the housing assembly 308.

Furthermore, the cover plate 388 forms a second wall 392 of the housing assembly 308 such that the outer surface of the second wall is also the second broad outer surface 336 of the housing assembly 308.

As shown in FIG. 8A, the wand-driven tilt actuator block 304*d* includes the wand-driven pivot assembly 322*d* comprised of the rotatable member 306*d* and the worm 384. In particular, the rotatable member 306*d* includes a symmetrically shaped cylindrical pivot hub 394 comprised of a first cylindrical wall 393 and a second cylindrical wall 395 that extends from the first cylindrical wall 393 such that the walls 393, 395 share a common axis of symmetry. Furthermore, the first cylindrical wall includes opposing first and second substantially flat lateral surfaces 396, 397 and an outer cylindrical surface 399 that extends between the first and second flat surfaces 396, 397. Extending from the second lateral surface 397 of the first wall 393, the second cylindrical wall 395 includes a cylindrically shaped outer surface 398 that extends to an outer lateral surface 401 which defines an outer lateral edge of the rotatable member 306*d*.

As shown in FIG. 8A, the rotatable member 306*d* further includes a symmetrically shaped cylindrical worm gear 400. In particular, the worm gear 400 includes a threaded side surface 402 opposing first and second lateral surfaces 404 and 406. Furthermore, the side surface 402 is threaded so as to enable the worm gear 400 to engage with a worm 384 as will be described in greater detail below.

As shown in FIG. 8A, the rotatable member 306*d* further includes the symmetrically shaped cylindrical mounting post 324 having a shape similar to that of the pivot hub 394 except that the mounting post 324 is formed with an extended length so as to enable an outer cylindrical surface 409 of the mounting post 324 to extend from the housing assembly 308 as will be described in greater detail below. In particular, the mounting post 324 comprises a first cylindrical wall 418 and a second cylindrical wall 419 that extends from the first wall 418. Moreover, the first cylindrical wall 418 includes opposing first and second lateral surfaces 408, 420 and an outer cylindrical surface 422 that extends between the lateral surfaces 408, 420. Extending from the second later surface 420 of the first wall 418 of the mounting post 324, the second cylindrical wall 419 includes the generally cylindrical outer surface 409 that extends to an outer lateral surface 417.

To form the rotatable member 306*d*, the pivot hub 394, the worm gear 400, and the mounting post 324 are fixedly attached to each other as will be described in greater detail below in connection with FIGS. 11B and 11C. In particular, the first surface 396 of the first wall 393 of the pivot hub 394 is positioned flushly adjacent the first surface 404 of the worm gear. Furthermore, the surface 408 of the mounting post 324 is positioned flushly adjacent the second surface 406 of the worm gear 400.

Thus, the worm gear 400 forms the central portion and the pivot hub 394 and the mounting post 324 form the first and second end sections of the rotatable member 306*d*. Moreover, the pivot hub 394, the worm gear 400, and the mounting post 324 are aligned so as to form the rotatable member 306*d* with an axis of symmetry that extends along the axes of symmetry of the pivot hub 394, the worm gear 400 and the mounting post 324.

Figure 8B:
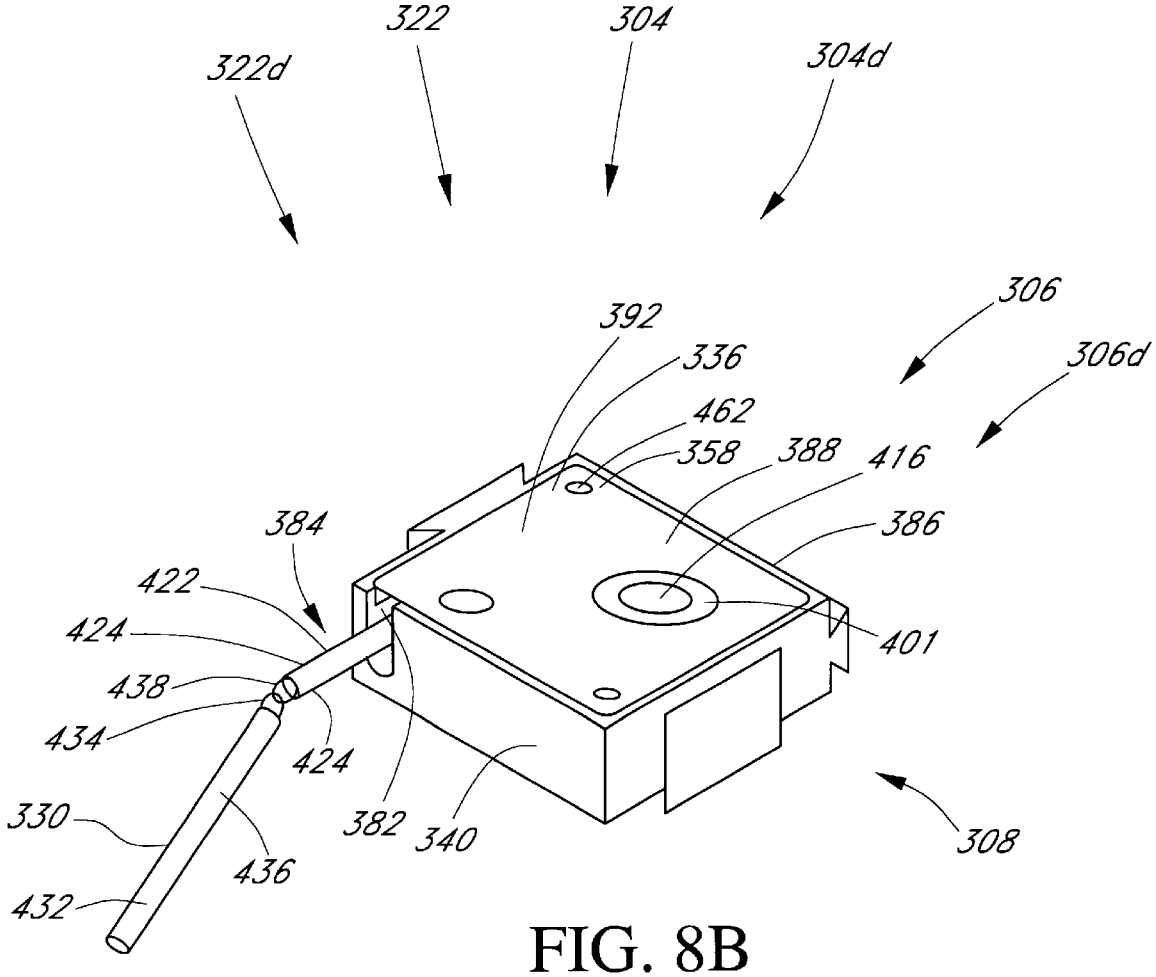
FIG. 8B is a perspective view of the wand-driven tilt actuator block of FIG. 8A.

As shown in FIGS. 8A and 8B, the rotatable member 306*d* is rotatably captured within the spool space 360 of the housing assembly 308 such that the axis of symmetry of the rotatable member 306*d* extends through the mounting post aperture 354 of the housing assembly 308. In particular, the second cylindrical wall 395 of the pivot hub 394 and the second cylindrical wall 419 of the mounting post 324 of the rotatable member 306*d* are formed with diameters that are smaller than the diameter of the mounting post aperture 354 of the housing assembly 308 so as to allow the pivot hub 394 and the mounting post 324 to extend through and to rotate within the mounting post aperture 354. Moreover, the diameter and thickness of the worm gear 400 is smaller than the diameter and thickness of the spool space 360 of the housing assembly 308 so as to enable the worm gear 400 to rotate when positioned therein. Additionally, the worm gear 400 is formed with a diameter which is larger than that of the mounting post aperture 354 so that the worm gear 400 is captured between the first and second walls 390, 392 of the housing assembly 308.

As shown in FIGS. 8A and 8B, the mounting post 324, the worm gear 400, and the pivot hub 394 of the rotatable member 306*d* are each respectively formed with a center aperture 410, 412 and 414 so that the rotatable member 306*d* is formed with an aperture 416 that extends along the axis of rotation of the rotatable member 306*d*. As will be described in greater detail below in connection with FIG. 6, the apertures 416 of the rotatable members 306 allows a plurality of draw cords 474 of the lifting mechanism 318 to be extended therethrough.

As shown in FIGS. 8A and 8B, the rotatable member 306*d* of the wand-driven pivot assembly 322*d* is positioned within the spool space 360 of the housing assembly 308 so that the pivot hub 394 extends into the mounting post aperture 354 adjacent the second broad surface 336 of the housing assembly 308 and so that the mounting post 324 extends through the mounting post aperture 354 adjacent the first broad surface 334. Furthermore, in one embodiment, the length of the second wall 394 of the pivot hub 394 substantially matches the thickness of the side walls 390, 392 of the housing assembly 308 adjacent the spool space 360 so that the outer lateral surface 401 of the pivot hub 394 is substantially coplanar with the second outer surface 336 of the housing assembly 308.

As shown in FIGS. 8A and 8B, the worm 384 of the wand-driven pivot assembly 322*d* is substantially positioned within the housing assembly 308 so as to engage with the rotatable member 306*d*. In particular, the worm 384, comprising a shaft section 422 with an end 424, a generally cylindrical head section 426 having a threaded outer surface 430, and a tip section 428, is positioned within the worm space 364 of the housing assembly 308. Specifically, the shaft section 422 of the worm 384 is positioned within the shaft space 376 of the worm space 364 such that the end 424 of the shaft 422 extends outwardly through the shaft opening 382 of the lower side 340 of the housing assembly 308. Furthermore, the surface 430 of the head 426 of the worm 384, which is adapted to engage the threaded outer surface 402 of the worm gear 400 of the rotation member 306*d*, is positioned within the head space 378 of the worm space 364 so that the head 426 engages the worm gear 400 of the rotatable member 306*d*. Moreover, the tip 428 of the worm 384 is positioned within the tip space 380 of the worm space 364 so that the worm 384 is more easily able to rotate with an axis of rotation that aligns with the elongated axis of the worm space 364. Thus, rotational movement of the worm 384 along the elongated axis of the worm space 364 results in corresponding rotational movement of the rotatable member 306*d* along the axis of symmetry of the rotatable member 306*d*.

As shown in FIG. 8B, the wand-driven tilt actuator block 304*d* further comprises the wand 330. In particular, the wand 330 comprises an elongated rod section 432 having an attachment member 434 extending from a first end 436 of the rod section 432. Furthermore, the worm 330 further comprises an attachment member 438 at the exposed outer end 424 of the shaft 422 of the worm 384. Moreover, the attachment member 434 of the wand 330 couples with the attachment member 438 of the worm 384 so that rotation of the wand 330 creates rotational movement of the worm 384. Consequently, rotational motion of the wand 330 results in rotational motion of the rotatable member 306*d* of the wand-driven tilt actuator block 304*d*.

Figure 9A:
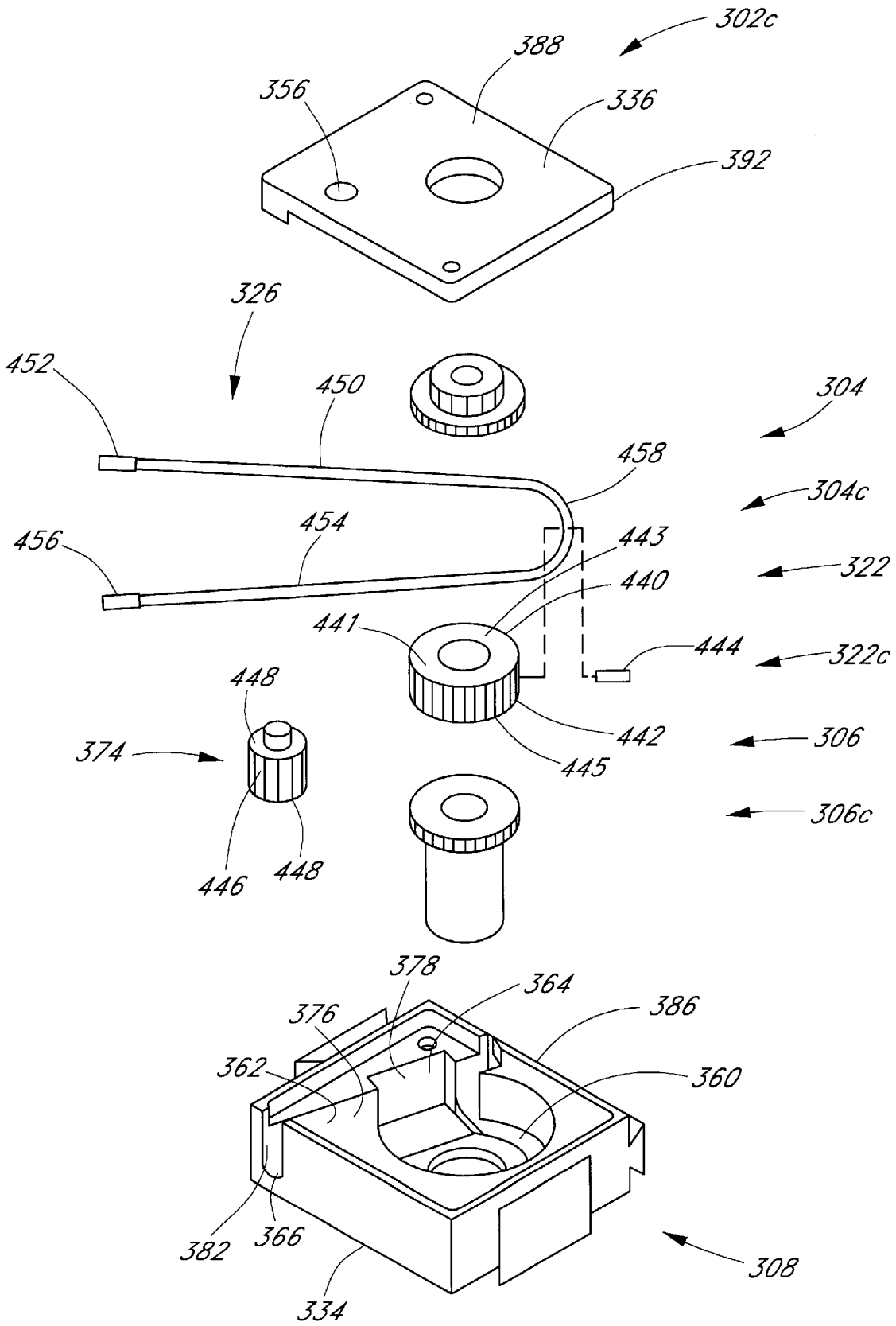
FIG. 9A is an exploded view of a cord-driven tilt actuator block of the window blind of FIG. 6.
Figure 9B:
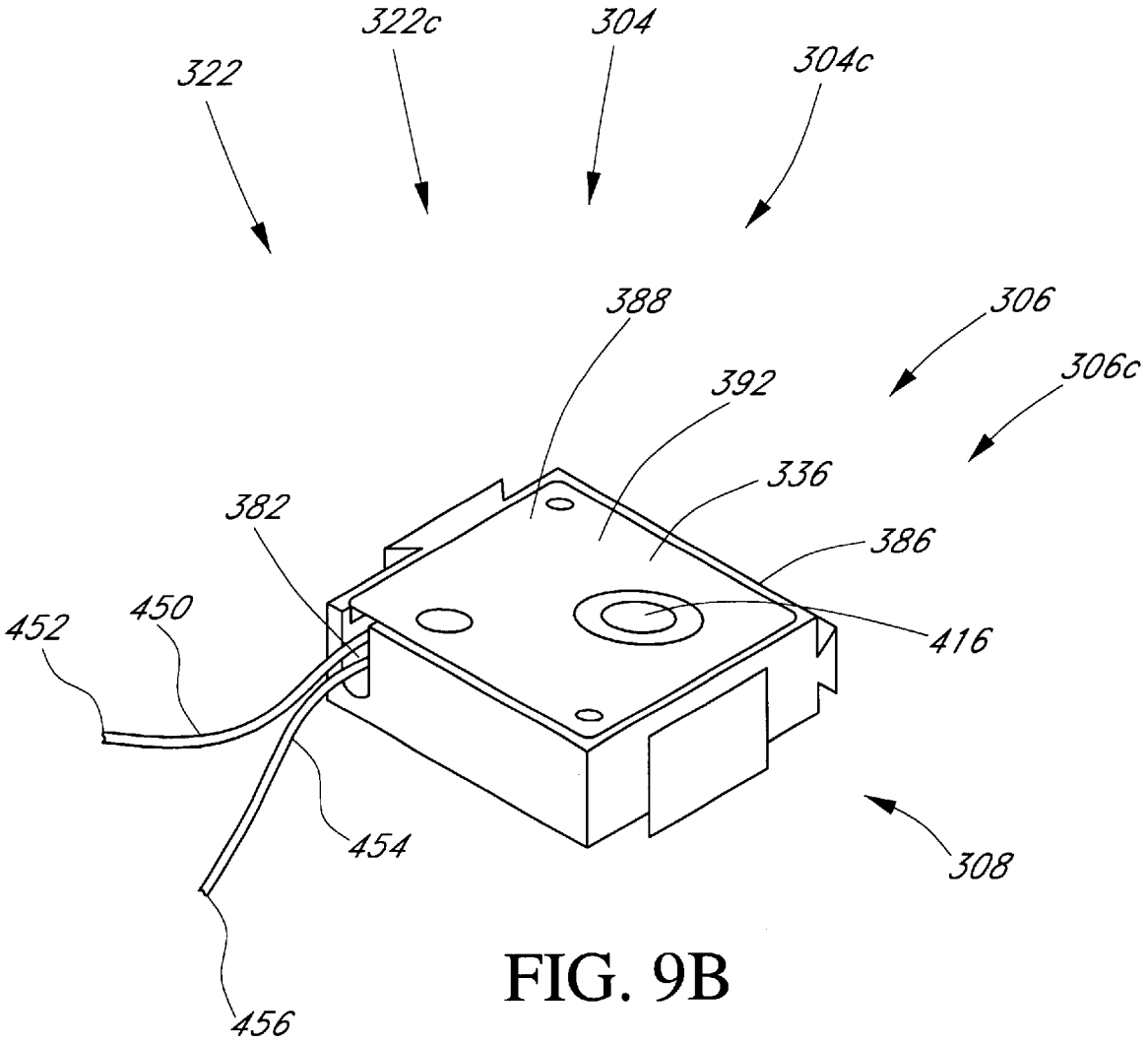
FIG. 9B is a perspective view of the cord-driven tilt actuator block of FIG. 9A.

As shown in FIGS. 9A and 9B, the cord-driven tilt actuator block 304*c* comprises the cord-driven pivot assembly 322*c* having the rotatable member 306*c* that is positioned within the housing assembly 308 in the manner of FIGS. 8A and 8B. In particular, the rotatable member 306*c* is identical to the rotatable member 306*d* of the wand tilt block 304*d* of FIG. 8A with the exception that the central section of the rotatable member 306*c* comprises a cylindrical cord hub 440 having a first annular side surface 443, a second annular side surface 445, an outer cylindrical surface 442 and a center aperture 441. However, the dimensions of the cord hub 440 are substantially similar to that of the worm gear 400 of FIG. 8A so as to enable the rotatable member 306*c* to be rotatably captured within the spool space 360 of the housing assembly 308. Furthermore, the center aperture 441 of the cord hub 440 partially forms the aperture 416 of the rotatable member 306*c*. Moreover, the cord hub 440 includes a cord retainer post 444 that mounts to the outer surface 442 of the cord hub 440. As will be described in greater detail below, the cord retainer post 444 provides a means for securing the tilt cord 326 to the cord hub 440.

As shown in FIG. 9A, the cord-driven pivot assembly 322*c* further comprises the cord roller 374 having a central cylindrical section 446 and a pair of opposing end cylindrical sections 448 such that the axes of symmetry of the sections 446, 448 are collinear. Furthermore, the cord roller 374 is adapted to be rotatably captured within the cord roller space 362 of the housing assembly 308 such that the end sections 448 outwardly extend into the cord roller aperture 356 of the housing assembly 308. As will be described in greater detail below, the cord roller 374 provides the tilt cord 326 with reduced friction so as to enable the cord-driven pivot assembly 322*c* to operate with less force applied to the tilt cord 326.

As shown in FIGS. 9A and 9B, the cord-driven pivot assembly 322*c* further includes the tilt cord 326 comprising a first length 450 having an end 452, a second length 454 having an end 456, and a midsection 458 that separates the first length 450 from the second length 454. In particular, the first and second lengths 450, 454 of the tilt cord 326 partially extend into the housing assembly 308 through the shaft opening 382 in the lower surface 340 of the housing assembly 308 such that the ends 452, 456 of the tilt cord 326 are positioned outside the housing assembly 308 and such that the mid-section 458 is positioned inside the housing assembly 308. Moreover, the tilt cord 362 is positioned so that it extends around the cylindrical surface 442 of the cord hub 440, such that the midsection 458 of the tilt cord 326 is positioned adjacent the cord hub 440 in a flush manner, such that the first length 450 extends along the shaft and head regions 376, 378 of the worm space 364, and such that the second length 454 extends along the shaft region 376 of the worm space 364 and the tilt cord space 366.

The mid-section 458 of the tilt cord 326 is secured to the cord hub 440 using the cord retainer post 444. In particular, in one embodiment, the cord retainer post 444 comprising a head section 600 and a shaft section 602 extending from the head section 600 is adapted to extend into an opening 604 that extends into the cylindrical surface 442 of the cord hub 440. Furthermore, the head 600 is adapted so that when the shaft 600 is extended into the opening 604, the midsection 458 of the tilt cord 326 can be frictionally captured between the head 600 and the cord hub 440. Moreover, the shaft 602 of the cord retainer post 444 and the opening 604 of the cord hub 440 are adapted to frictionally engage with each other in a well-known manner so that the cord hub 440 and the cord retainer post 444 continually apply oppositely directed forces onto the tilt cord 326 to thereby prevent the tilt cord 326 from slipping across the surface 442 of the cord hub 440.

Thus, the rotatable member 306*c* of the tilt cord pivot assembly 322 can be induced to rotate by pulling on either of the ends 452, 456 of the tilt cord 326. In particular, if the end 452 of the first length 450 is pulled, then the cord hub 440 will experience a first torque that induces the rotatable member 306*c* to rotate with an angular velocity that aligns with the symmetric axis of the rotatable member 306*c*. Furthermore, if the end 456 of the second length 454 is pulled, then the cord hub 440 will experience a second torque having a direction that is opposite to that of the first torque of the preceding example. Moreover, since the first and second lengths 450, 454 of the tilt cord 326 extend through the shaft space 376 of the worm space 364 so as to be positioned adjacent the cord roller 374 in a flush manner, the cord roller 374 engages with the tilt cord 326 when the tilt cord 326 is pulled so that the cord roller 374 acts as a pulley to thereby reduce frictional forces acting on the tilt cord 326.

Figure 10A:
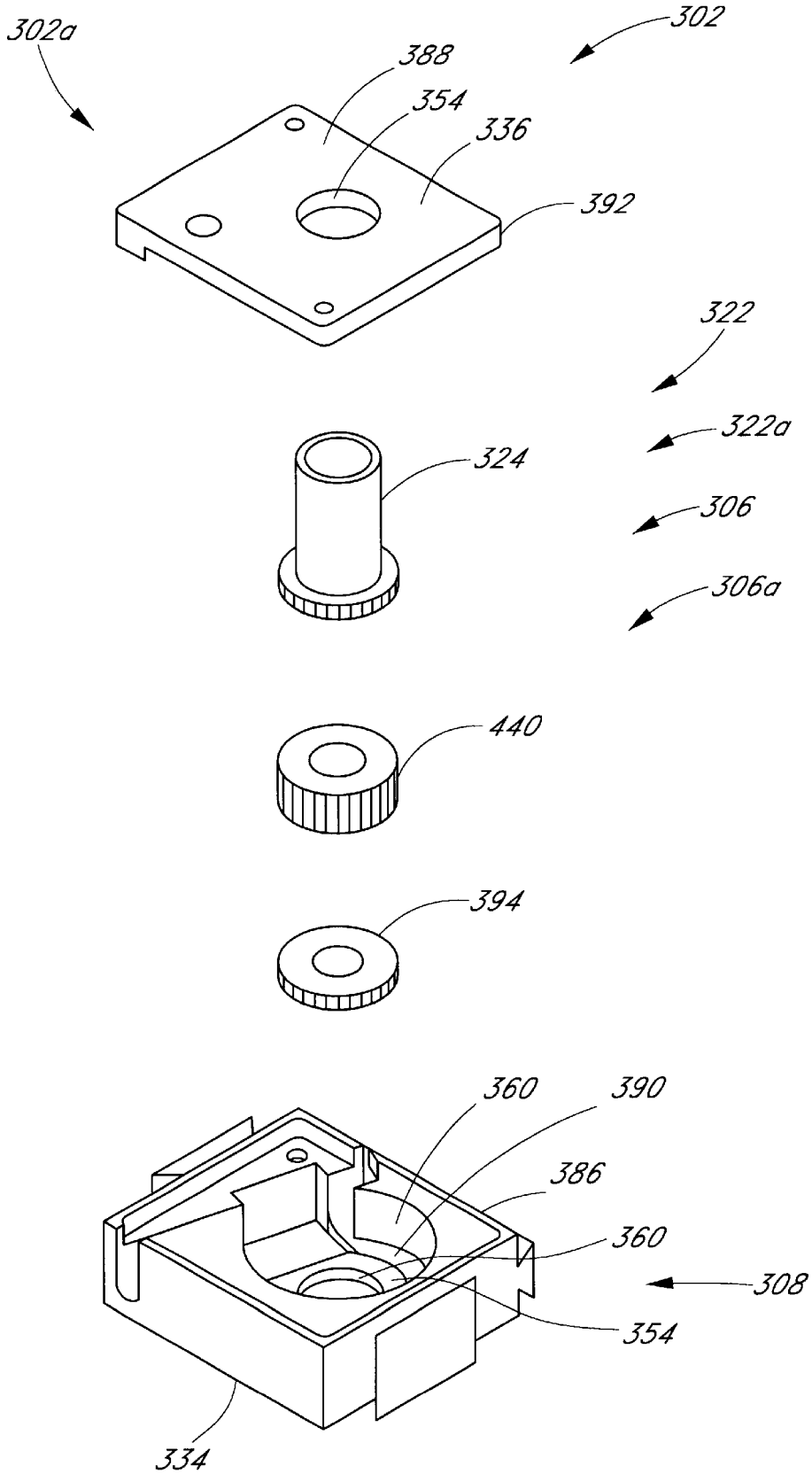
FIG. 10A is an exploded view of an outer mounting block of the window blind of FIG. 6.
Figure 10B:
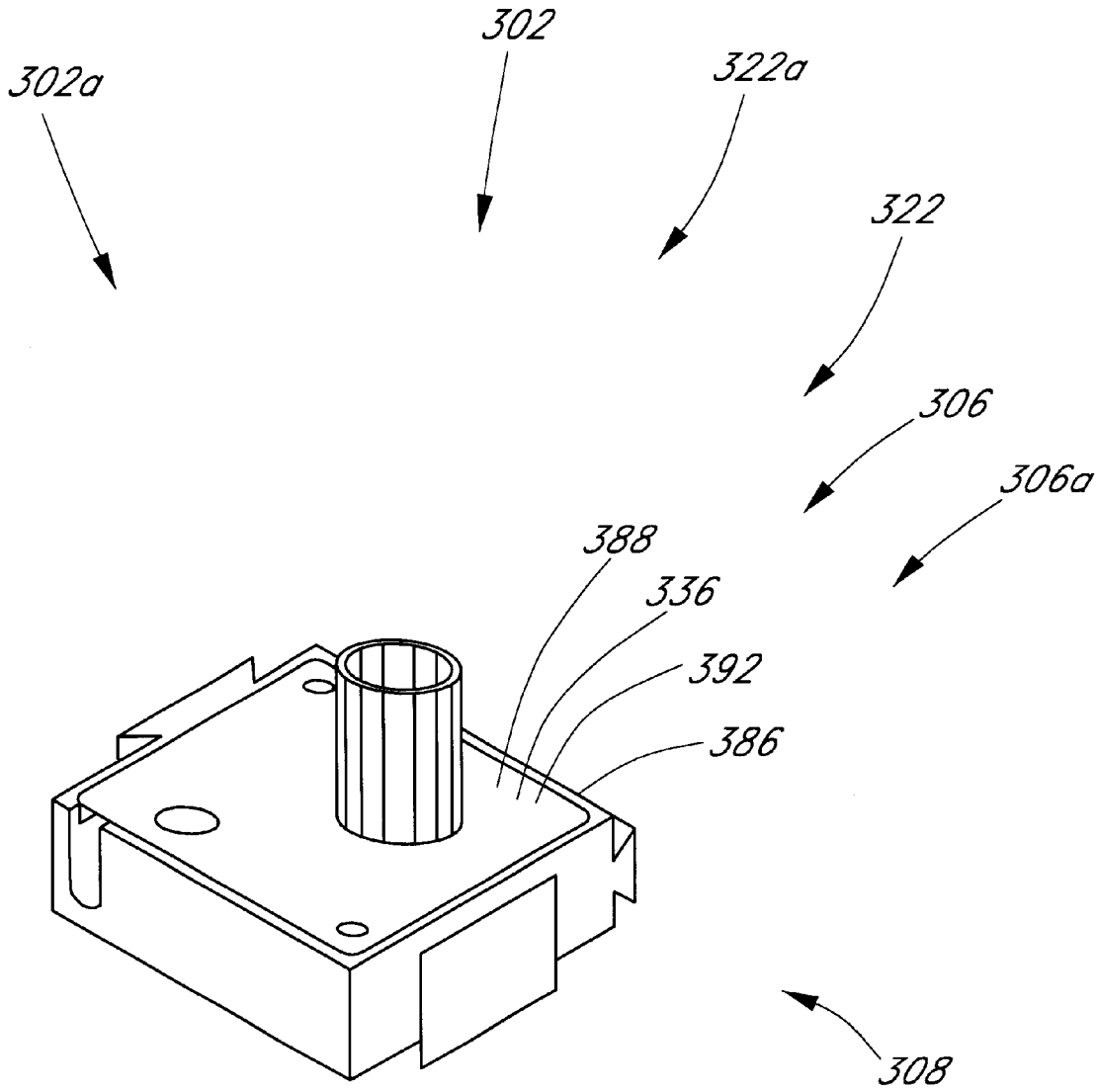
FIG. 10B is a perspective view of the outer mounting block of FIG. 10A.

As shown in FIGS. 10A and 10B, the outer mounting block 302*a* comprises the pivot assembly 322*a* having the rotatable member 306*a*. In particular, the rotatable member 306*a* is identical to the rotatable member 306*c* of the tilt cord pivot assembly 322*c* of FIG. 9A, with the exception that the cord retainer post 444 is not included. Furthermore, the rotatable member 306*a* is positioned within the spool space 360 of the housing assembly 308 such that the pivot hub 394 extends into the mounting post aperture 354 extending through the first wall 390 of the housing assembly 308 and such that the mounting post 324 extends through the mounting post aperture 354 extending through the wall 392. Thus, the rotatable member 306*a* is rotatably captured within the housing assembly 308 such that the axis of rotation of the rotatable member 306*a* substantially extends along the mounting post aperture 354 of the housing assembly 308.

Figure 11A:
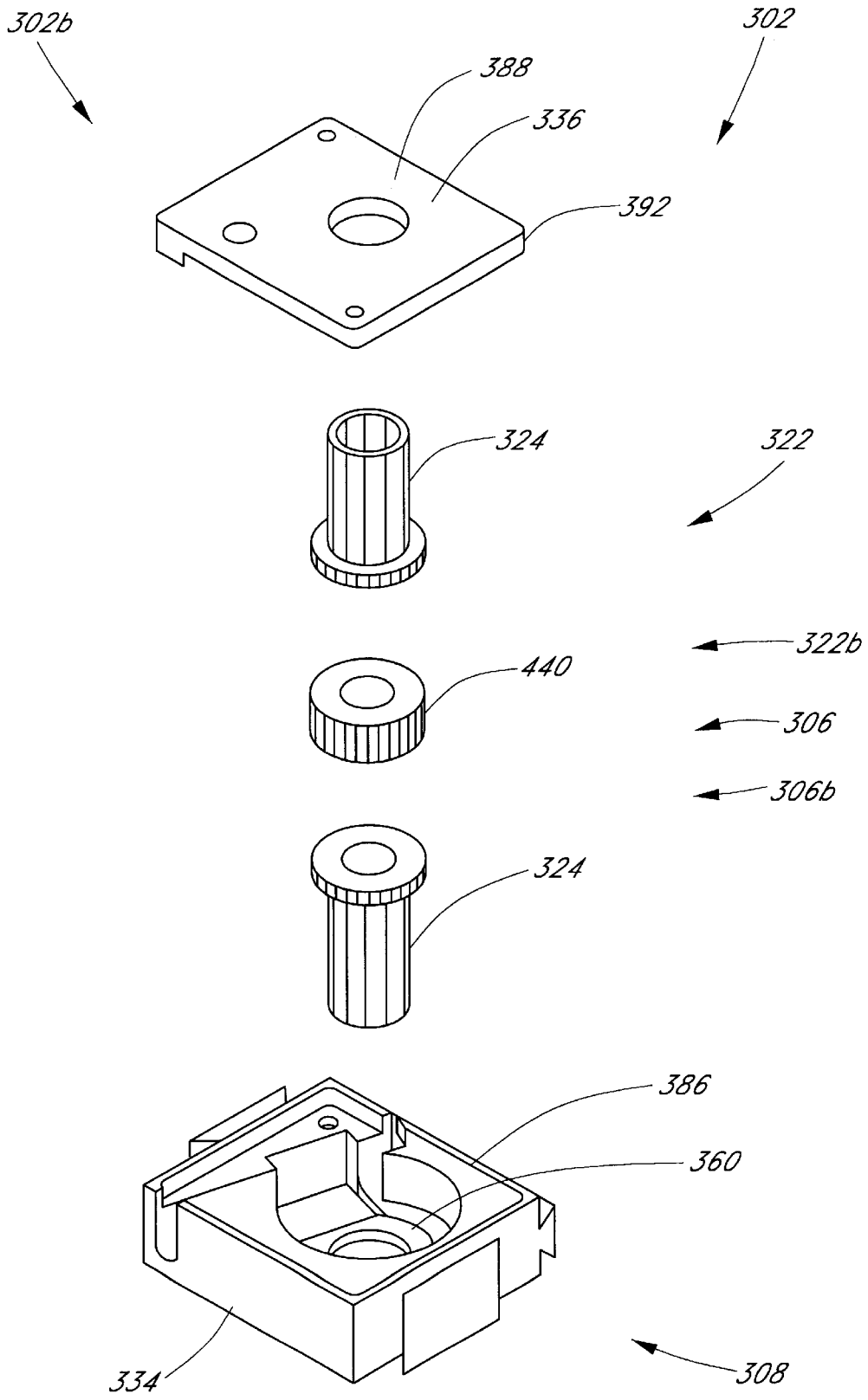
FIG. 11A is an exploded view of an inner mounting block of the window blind of FIG. 6.

As shown in FIG. 11A, the inner mounting block 302*b* comprises the pivot assembly 322*b* having the rotatable member 306*b*. In particular, the rotatable member 306*b* is identical to the rotatable member 306*a* of FIG. 10, with the exception that the second mounting post 324 replaces the pivot hub 394 of FIG. 10. Furthermore, the second mounting post 324 is secured to the rotatable member 306*b* so that the mounting posts 324 of the rotatable member 306*b* oppose each other. Therefore, the rotatable member 306*b* is rotatably captured within the housing assembly 308 such that the mounting posts 324 extend therefrom in opposing directions.

Although the tilt actuator blocks 304 of FIGS. 8A–9B are configured to be mounted on the right side of the window blind 300, it will be appreciated that the tilt actuator blocks 304 could just as easily be configured so as to be mounted on the left side of the window blind 300. In particular, the only difference is that the rotation member 306*c*, 306*d* would need to be positioned within the housing assembly 308 such that the mounting post 324 extends from the housing assembly 308 toward the right side of the window blind 300. Likewise, the outer mounting block 302*a* can just as easily be configured for use along the right side of the window blind 300 by simply reversing the direction of the rotatable member 306*a* of the pivot assembly 322*a* of the outer mounting block 302*a*.

As shown in FIGS. 8A–11A, the cover plate 386 of the housing assembly 308 mounts to the main section 386 so as to capture the pivot assembly 322 therein. In particular, the main section 386 further comprises a mounting space 460 that is adapted to receive the cover plate 388. Furthermore, when the cover plate 388 is positioned within the mounting space 460, the plate 388 is secured to the main section 386 by inserting at least one interconnecting member 462 through the interconnect apertures 358 of the cover plate 388 and main section 386.

Thus, since the mounting/tilt blocks 302, 304 are substantially formed of interchangeable components, the number of unique components required to construct the entire range of the mounting/tilt blocks 302, 304 is substantially small. In particular, the mounting/tilt blocks 302, 304 each include the housing assembly 308 and the mounting post 324. Furthermore, the outer mounting block 302*a* and the tilt actuator blocks each include the pivot hub 394. Consequently, the sharing of components of the mounting/tilt blocks 302, 304 enable them to be fabricated at a reduced financial cost.

Figure 11B:
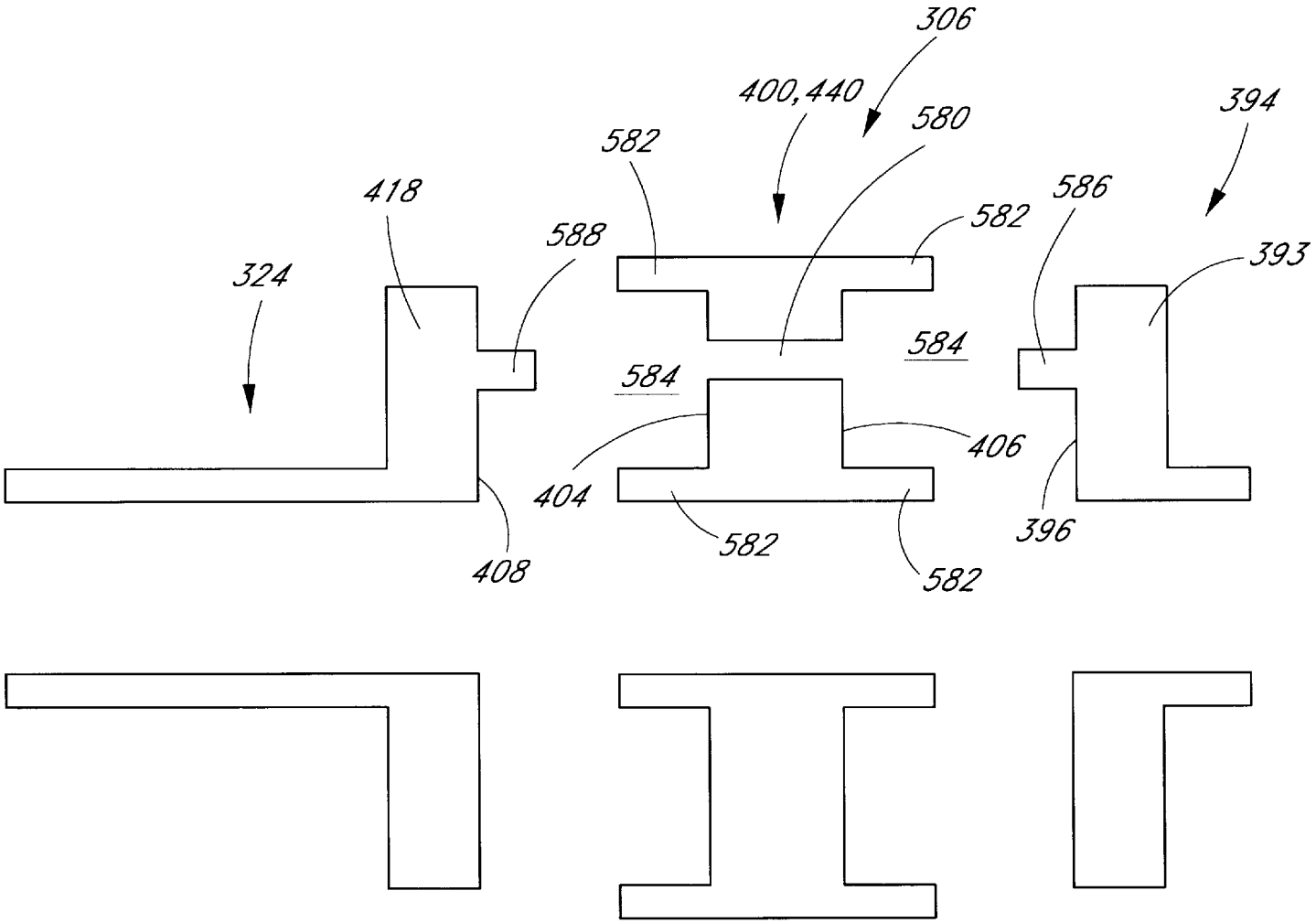
FIG. 11B is cross sectional view of one embodiment of a rotatable member of the window blind of FIG. 6 illustrating the structural features of a central member and a pair of opposing end sections of the rotatable member.
Figure 11C:
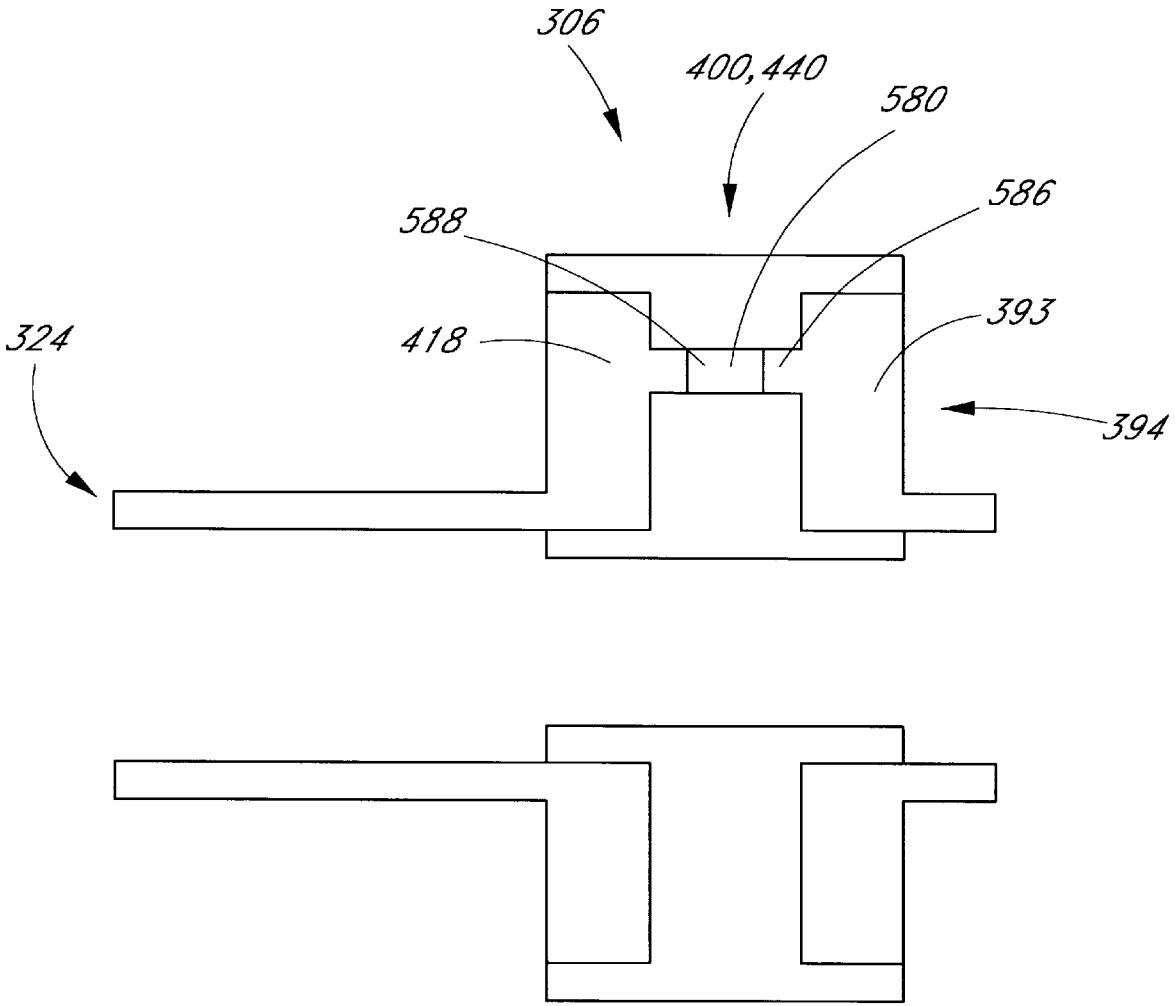
FIG. 11C is cross sectional view of the rotatable member of FIG. 11B illustrating how the central member and opposing end sections interconnect.

Reference will now be made to FIGS. 11B–11C which illustrate the rotatable members 306 of the preferred embodiment of the window blind 300 of FIG. 6. In particular, FIG. 11B illustrates the structural features of the central sections 400, 440 and the end sections 324, 394 in greater detail. Furthermore, FIG. 11C illustrates how the central sections 400, 440 and the end sections 324, 394 interconnect so as to form the rotatable members 306.

As shown in FIGS. 11B–11C, the central sections 400, 440 further comprise a second aperture 580 that extends between the first and second lateral surfaces 404, 406 of the central section 400, 440. Furthermore, the central sections 400, 440 further comprise a plurality of lips 582 that extend from the first and second lateral surfaces 404, 406 so as to form plural annular mounting spaces 584 which are adapted to engage with the first cylindrical wall 393, 418 of the end section 394, 324, respectively.

As shown in FIGS. 11B–11C, each end section 394, 324 respectively comprises an extending cylindrical finger 586, 588. In particular, the finger 586 perpendicularly extends from the first lateral surface 396 of the first wall 393 of the end section 394. Furthermore, the finger 588 extends from the first lateral surface 408 of the first wall 418 of the end section 324. Moreover, the fingers 586, 588 are adapted so that they are able to extend into the second aperture 580 of the central section 400, 440 when the surfaces 406, 408 of the end sections are respectively positioned adjacent the surfaces 406, 404 of the central section 400, 440.

As shown in FIG. 11C, to interconnect the central section 400, 440 with the end sections 394, 324, the first walls 393, 418 of the end sections 394, 324 extend into the mounting spaces 584 of the central section 400, 440 so that the end sections 394, 324 frictionally engage the central section 400, 440 and so that the fingers 586, 588 of the end sections 394, 324 extend into the second aperture 580 of the central section 400, 440. Thus, the rotatable members 306 are formed such that the end sections 394, 324 are substantially inhibited from rotating with respect to the central section 400, 440.

Referring back to FIG. 6, the rod assembly 314 of the window blind 300 extends between the mounting blocks 302 and the tilt actuator block 304 of the mounting section 312. In particular, the rod assembly 314 includes at least one elongated hollow rod section 464 having a substantially cylindrical outer surface 466, a plurality of coupling members 468 having a substantially cylindrical inner surface 470, and the rotatable members 306 of the mounting/tilt blocks 302, 304. Furthermore, the rod sections 464 are interposed between the rotatable members 306 of the mounting/tilt blocks 302, 304 so that the elongated axes of the rod sections 464 align with the axes of symmetry of the rotatable members 306. Moreover, the coupling members 468 couple the rod sections 464 with the mounting posts 324 of the rotatable members 306 so that the rod assembly 314 is able to rotate with an axis of rotation that aligns with the axis of rotation of each of the rotatable members 306 of the mounting/tilt blocks 302, 304. Additionally, since the rotatable members 306, the coupling members 468 and the rod sections 464 each comprise an aperture extending along their respective axes of rotation, the rod assembly 314 is formed with an aperture 472 extending along the axis of rotation of the rod assembly 314 so as to allow a plurality of draw cords 474 of the lifting mechanism 318 to extend therethrough.

Thus, the rod assembly 314 extends from the outer mounting block 302*a* to the tilt actuator block 304 and is rotatable in response to a torque provided by the user input device of the tilt actuator block 304 such that each of the coupling members 468 of the rod assembly 314 rotates in coincidence with the rotatable member 306 of the tilt actuator block 302, 304. As will be described in greater detail below, some of the coupling members 468 also function as ladder support devices 468 for supporting a plurality of ladder strings 476 of the slat assembly 316 such that rotation of the ladder support devices 468 cause the slats 310 of the slat assembly 316 to rotate in a uniform manner.

In the preferred embodiment, the rod sections are formed with relatively large structural strength. In particular, in the preferred embodiment, the rod sections comprise lengths of tubular material having a relatively large outer diameter, such as inexpensive and commonly available PVC pipe having an outer diameter of approximately one inch and thickness of ⅛ inch. Thus, since the outer diameter of the rod sections are formed of a cylindrical wall having a diameter which is relatively large in comparison with that of rod sections of window blinds known in the art, the rod sections are more resistant to bending in response to lateral forces. Thus, whereas window blinds of the prior art typically require a head rail to provide sufficient lateral strength, the window blind 300 is able to obtain sufficient lateral strength directly from the rod sections.

As shown in FIG. 6, the slat assembly 316 extends downward from the rod assembly 314. In particular, the slat assembly 316 comprises the plurality of slats 310 that are similar to the slats of FIG. 2A. Furthermore, the slat assembly 316 further comprises the plurality of ladder strings 476 that are substantially similar to the ladder strings of FIG. 2A. In the embodiment of FIG. 6, the plurality of ladder strings 476 comprise a first outer ladder string 476*a* that extends from the coupling member 468a attached to the outer mounting block 302*a*, a second outer ladder string 476*c* that extends from the coupling member 468c attached to the tilt actuator block 304, and an inner ladder string 476*b* that extends from the coupling member 468b attached to the inner mounting block 302*b*. However, it will be appreciated that the number of ladder strings 476 could be expanded or contracted depending on the preferred width of the window blind 300.

Figure 12:
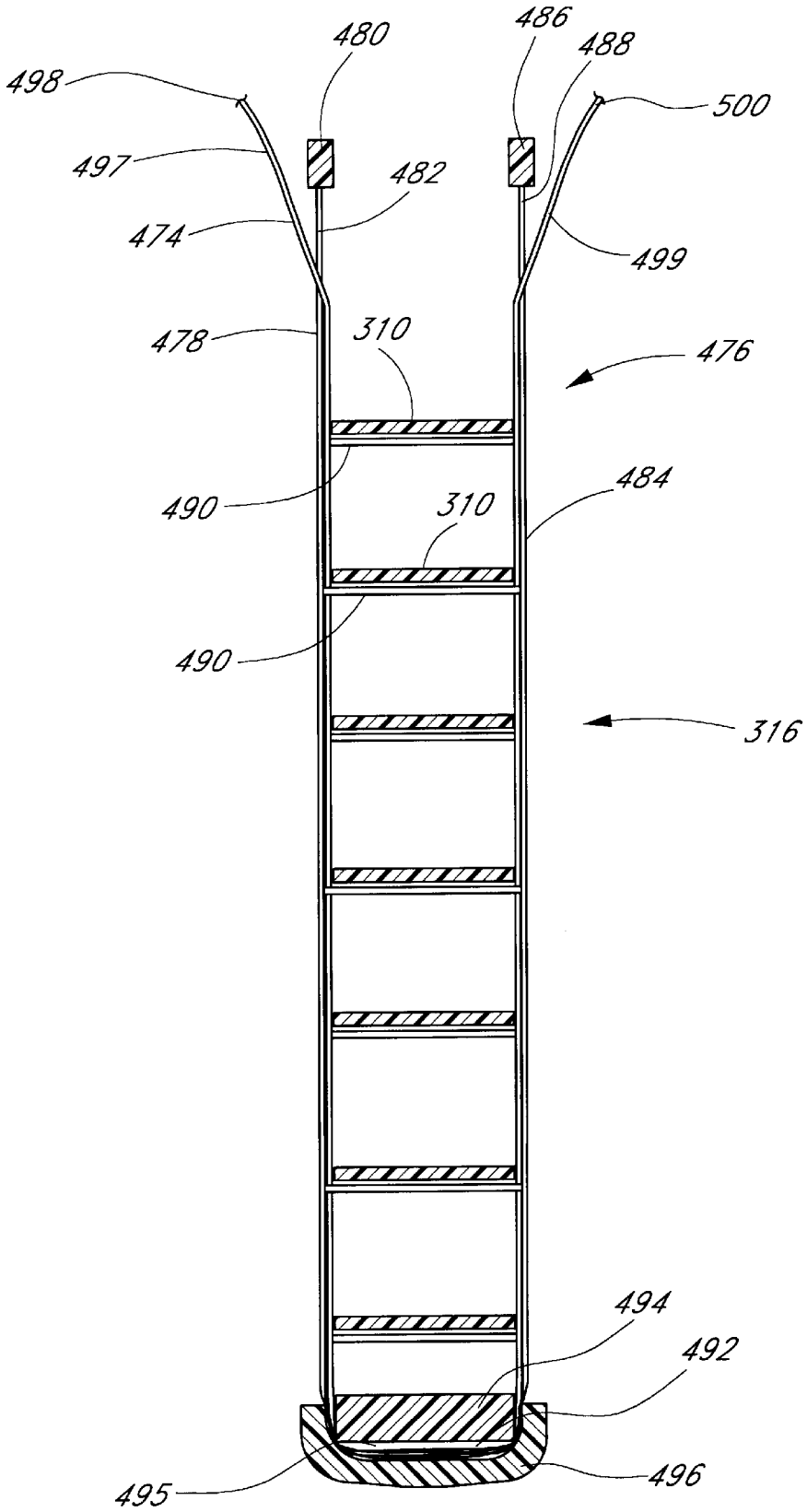
FIG. 12 is a side view of a slat assembly of the window blind of FIG. 6.

As shown in greater detail in FIG. 12, the ladder strings 476 support the slats 310 in a manner similar to that described earlier in connection with FIG. 4B. In particular, each ladder string 476 comprises a first elongate portion 478 having an attachment member 480 extending from an upper end 482 of the first elongate portion 478, a second elongate portion 484 having an attachment member 486 extending from an upper end 488 of the second elongate portion 484, and a plurality of interconnecting portions 490 that extend between the first and second elongate portions 478, 484 in a parallel manner so as to support the slats 310 in a parallel manner. Furthermore, a lowermost interconnecting portion 492 of the interconnecting portions 490 joins the first elongate portion 478 with the second elongate portion 484 at the bottom of the ladder string 476 so as to provide a means for supporting a bottom rail 494 of the window blind 300. Moreover, the lowermost interconnecting portion 492 of the ladder string 476 is secured to the bottom rail 494 using a plurality of securing clips 496 that attaches to the bottom rail 494 such that the portion 492 of each ladder string 486 is interposed between the corresponding clip 496 and the bottom rail 494 as shown in FIGS. 6 and 12.

As schematically indicated in FIG. 6, the draw cords 474 extend along the slat assembly 316. In particular, the first draw cord 474*a* vertically extends along the first outer ladder string 476*a* and the second draw cord 474*c* vertically extends along the second outer ladder string 476*c*. Furthermore, as shown in FIG. 12, each draw cord 474 comprises a first and second length 497, 499 each respectively having an end 498, 500 and a midsection 495 interposed therebetween. Moreover, each draw cord 474 wraps around the slat assembly 316 such that the first and second lengths respectively extend from the ends 498 and 500 along the first and second elongate portions 478 and 484 of the adjacent ladder string 476 so as to position the midsection 495 under the bottom rail 494. Moreover, the midsection 495 is interposed between the clip 496 and the bottom rail 494 so that the draw cords 474 are secured to the bottom rail 494 and so that the slat assembly 316 can be raised from the bottom by pulling on the ends 498, 500 of each of the draw cords 474. Thus, as will be described in greater detail below in connection with FIG. 6, the first and second draw cords 474*a* and 474*c* form a part of the lifting mechanism 318.

As shown in FIG. 12, each draw cord 474 preferably extends along the elongate portions 478, 484 of the adjacent ladder string 476 in a serpentine manner. In particular, each draw cord 474 preferably extends along the first and second elongate portions 478, 484 of the ladder string 476 so as to intertwine with the interconnecting portions 490 of the ladder string 476. Thus, since the draw cords 474 extend along the outer edges of the slats 310 instead of along the center of the slats 310, the need for center guide slots in the slats 310 is obviated. Therefore, formation of the slat assembly 316 can be achieved by simply inserting the slats through the ladder strings such that each slat 310 is positioned adjacent the corresponding interconnecting member 490 of the ladder strings 476 as will be described in greater detail below in connection with FIG. 18. Consequently, this allows the slat assembly 316 to be constructed in a shorter period of time. Furthermore, the slats 310 can be easily removed and reinstalled so as to enable a user to more easily clean the slats 310.

Figure 13:
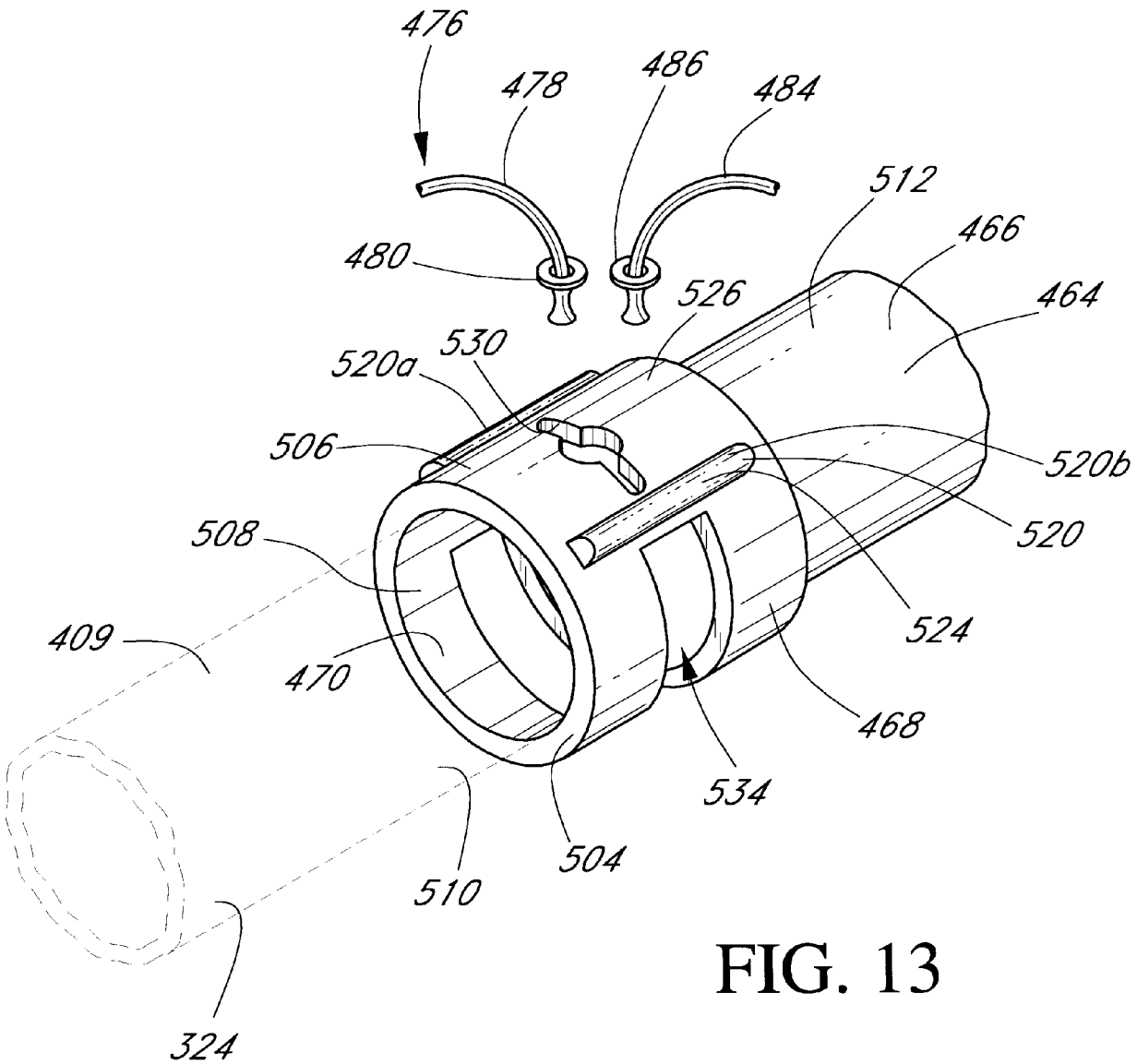
FIG. 13 is a perspective view of a coupling member of a rod assembly of the window blind of FIG. 6.

The ladder string support characteristics of the coupling members 468 will now be described in greater detail in connection with FIGS. 13–15. As shown in FIG. 13, each coupling member 468 is similar to the sleeve described earlier in connection with FIG. 4D. In particular, each coupling member 468 comprises a tubular wall 504 having the inner cylindrical surface 470, an outer cylindrical surface 506, and a cylindrical opening 508 that extends along the inner cylindrical surface 470. Furthermore, the cylindrical opening 508 of the coupling member 468 is formed with a diameter that allows an end portion 510 of the mounting post 324 (shown in phantom) and an end portion 512 of the rod section 464 to extend into the opening 508 from opposing directions so as to frictionally engage the inner surface 470 of the coupling member 468 with the outer surfaces 409, 466 of the mounting post 324 and rod section 364.

Figure 14A:
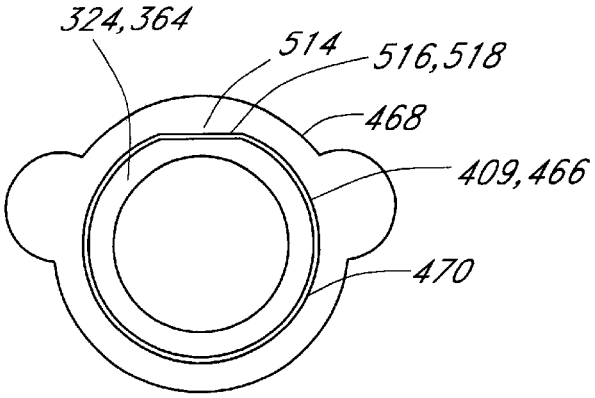
FIG. 14A is a cross sectional of the rod assembly of the window blind of FIG. 6.

In one embodiment, each coupling member 468, mounting post 324 and rod section 364 are formed with matching asymmetrical features that further prevent slippage therebetween. In particular, the inner surface 470 of the coupling member 468 includes a flat section 514 as shown in FIG. 14A. Furthermore, the outer surfaces 409, 466 of the mounting posts 324 and the rod sections 364 respectively include flat sections 516, 518 such that the flat sections 516, 518 are alignable with the flat section 514 of the coupling member so as to provide a keyed fit.

As shown in FIG. 13, each coupling member 468 further comprises a plurality of cams 520 that outwardly extend from the outer surface 506 of the coupling member 468. In particular, the cams 520 comprise the first and second cams 520*a* and 520*b* which are elongated in shape such that the elongated axis of the cams 520 are parallel with the axis of symmetry of the tubular wall 504 of the coupling member 468. Furthermore, the cams 520 each comprise a substantially identical curved outer surface 524 having a substantially uniform shape along the length of the cams 520. Moreover, the cams 520 are positioned so as to be substantially opposed to each other. As will be described in greater detail below, the purpose of the cams 520 is to substantially improve the tilting characteristics of the window blind 300.

As shown in FIG. 13, each coupling member 468 further comprises a ladder support opening 526 that is similar to the opening 234 of the sleeve of FIG. 4D. In particular, the ladder support opening 526 extends through a midsection of the tubular wall 504 of the coupling member 468 and comprises a central portion 528 that is positioned midway between the cams 520, a first channel 530 that laterally extends from the central portion 528 to an edge of the first cam 520*a*, and a second channel 532 that laterally extends from the central portion 528 to an edge of the second cam 520*b*. Thus, as will be described in greater detail below, the ladder support opening 526 is adapted to support the corresponding ladder string 476 of the slat assembly 316 of FIG. 12 so that the first elongate portion 478 of the ladder string 476 extends downwardly from the first cam 520*a* and so that the second elongate portion 484 extends downwardly from the second cam 520*b*.

As shown in FIG. 13, each coupling member 468 further comprises a cutout 534 that extends through the tubular wall 504 of the coupling member 468. In particular, the cutout 534 extends between the cams 520 such that the cutout 534 is substantially aligned with and opposed to the ladder support opening 526. Furthermore, as measured along the axis of symmetry of the tubular wall 504, the cutout 534 comprises a width that exceeds the width of the ladder support opening 526. Thus, the cutout 534 provides a space for the elongate portions 478, 484 of the ladder string 476 to extend thereinto so as to substantially improve the tilting characteristics of the window blind 300 as will be described in greater detail below. Moreover, the cutout 534 serves as an opening for the draw cords 474 of the lifting mechanism 318 to extend into the aperture 472 of the rod assembly 314 as will be described in connection with FIG. 6.

As shown in FIG. 13, each ladder string 476 of the slat assembly 316 attaches to the corresponding coupling member 468 of the rod assembly 314 in the manner of FIG. 4D. In particular, the attachment members 480, 486 of the first and second elongate portions 478, 484 of the ladder string 476 are initially inserted through the central portion 528 of the ladder support opening 526 and displaced toward the cams 520 such that the attachment members 480, 486 are captured by the channels 530, 532 of the ladder support opening 526.

Figure 14B:
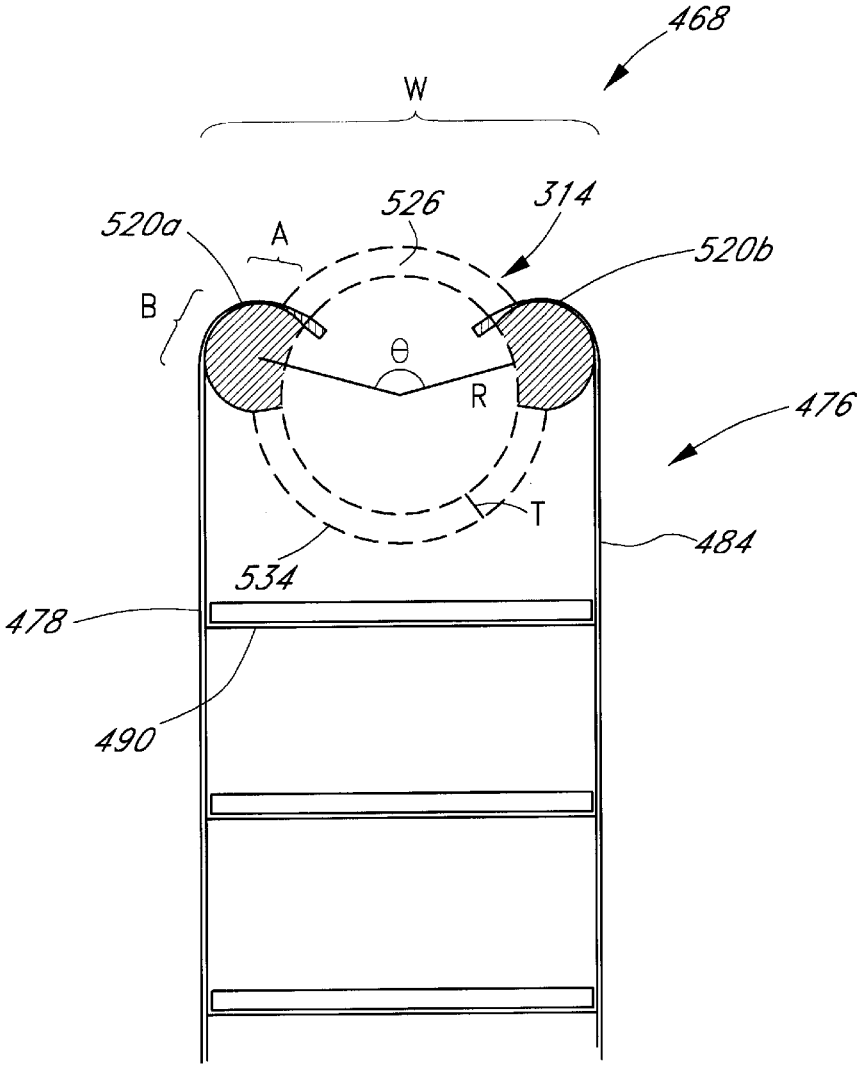
FIG. 14B is a cross sectional view of the slat assembly of the window blind of FIG. 6 illustrating the window blind in an open position.
Figure 15:
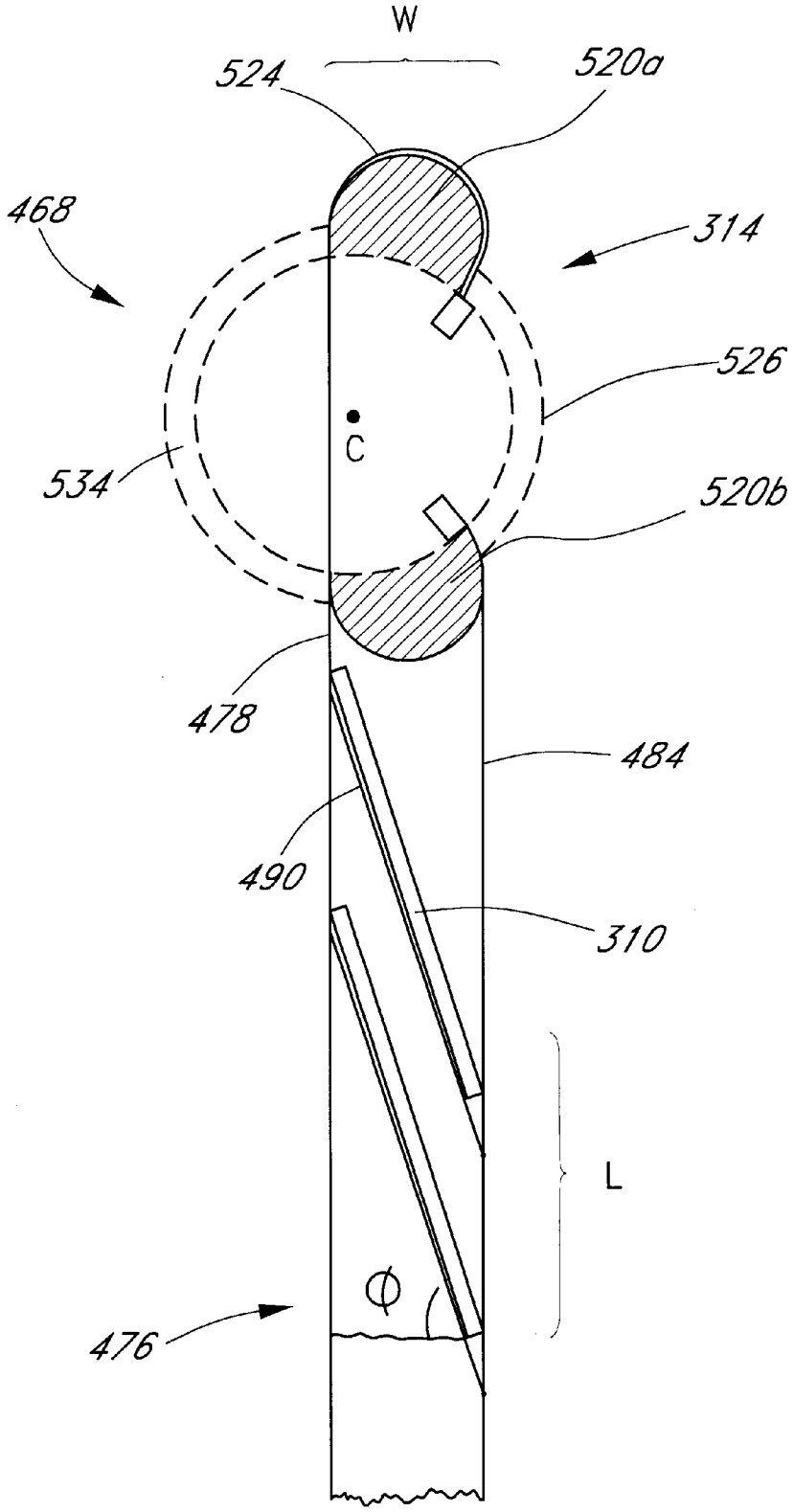
FIG. 15 is a cross sectional view of the slat assembly of the window blind of FIG. 6 illustrating the window blind in a closed position.

Thus, the first and second elongate portions 478, 484 of the ladder strings 476 extend from the coupling member 486 as shown in FIGS. 14B and 15. In particular, the first elongate portion 478 extends downward from the first cam 520*a* and the second elongate portion 484 extends downward from the second cam 520*b*. Furthermore, the angle between the interconnecting portion 490 of the ladder string 476 and a horizontal line, otherwise referred to hereinbelow as the pitch angle $\phi$ (FIG. 15), is directly related to the difference in elevation between the first and second elongate portions 478, 484 of the ladder string 476. Therefore, since rotation of the rod assembly 314 results in the first and second elongate portions 478, 484 of the ladder string 476 being vertically offset from each other, rotation of the rod assembly 476 results in rotation of the slats 310.

As shown in FIG. 14B, when the window blind 300 is placed in an open configuration such that the slats 310 are horizontally aligned, the first and second elongate portions 478, 484 of the ladder string 476 are positioned at substantially equal elevations so that the pitch angle of the interconnecting portions 490 of the ladder string 476 is substantially zero. To realize this configuration, each coupling member 468 is oriented such that the cams 520 are positioned at substantially equal heights. Consequently, the ladder support opening 526 is positioned substantially above the cams 520 and the cutout 534 is positioned substantially below the cams 520. Moreover, the first and second elongate portions 478, 484 of the ladder string 476 are separated by a distance W.

As shown in FIG. 14B, the dimensions of the coupling members are defined by the quantities R, T, $\theta$, A and B. In particular, R is the inner radius of the tubular wall and T is the thickness of the tubular wall. Furthermore, $\theta$ is the angular separation between the cams 520. Moreover, A is the radial thickness of the cams 520 and B is the lateral width of the cams. In one embodiment, the coupling members are formed so that R is approximately equal to 0.44 inches and T is approximately equal to 0.075 inches. Furthermore, in this embodiment, the cams 520 are formed so that A approximately equals 0.25 inches, B approximately equals 0.5 inches and $\theta$ approximately equals 180 degrees.

Reference will now be made to FIG. 15 which illustrates the window blind 300 in a substantially closed position such that the slats 310 are substantially aligned with a vertical plane. In particular, when the coupling members 486 are rotated by approximately 90 degrees from the orientation of FIG. 14B, the first elongate portions 478 of the ladder strings are raised and the second elongate portions 484 are lowered. This has the effect of increasing the pitch angle $\phi$ of the interconnecting portions 490 of the ladder strings 476 so that the slats 310 are supported in the closed position. Furthermore, the first elongate portion 478 of the ladder string 476 initially extends from the attachment member 480 along the perimeter of the outer surface 524 of the first cam 520*a* and then extends vertically downward along the cutout 534 so as to extend near the second cam 520*b*. Moreover, the second elongate portion 484 of the ladder string 476 initially extends from the attachment member 486 along a relatively short arc adjacent the second cam 520*b* before extending vertically downward such that the first and second portions 478, 484 are on opposite sides of the second cam 520*b*.

As shown in FIG. 15, extension of the first portion 478 of the ladder string 476 through the cutout 534 results in the distance W being reduced. In particular, the coupling members 468 are preferably adapted so that the separation distance W as measured at the second cam 520*a* substantially matches the quantity L cos $\phi$, wherein L is the transverse width of each slat 310 and $\phi$ is the pitch angle. Consequently, the first and second elongate portions 478, 484 of the ladder strings 476 are each maintained in a substantially vertical orientation.

It will be appreciated that the continued vertical orientation of the first and second elongate portions 478, 484 of the ladder strings 476 provide the window blind 300 with a substantial advantage over window blinds known in the art. In particular, since the center of mass of each slat is positioned substantially near its geometric center, the tensions in the first and second portions of the ladder string will tend to be substantially equal to each other. Thus, by maintaining the first and second portions of the ladder string with substantially equal tensions, the slats are less likely to unassistedly rotate toward the open position.

In contrast, known window blinds typically utilize ladder string support devices that do not substantially reduce the separation distance W between first and second elongate portions of each ladder string. Consequently, since the distance W in prior art window blinds does not substantially match the quantity L cos $\phi$, the first and second elongate portions usually extend from the ladder support device in a converging manner, which results in the raised elongate portion having a greater tension than that of the lowered elongate portion. Thus the ladder strings often generate a torque that causes the slats of the window blind to rotate from the closed position toward the open position.

Another advantage provided by the design of the coupling members 468 is that it is possible to form the coupling member 468 such that the ladder string 476 exerts a torque onto the coupling member 468 that biases the slats 310 from being unassistedly opened from the closed position. In particular, as shown in FIG. 15, the first elongate portion 478 of the ladder string 476 aligns more closely with the axis of rotation of the rod assembly 314 than does the second elongate portion 484. Thus, since the tension in both portions 476, 484 is substantially the same and since both portions 478, 484 are substantially vertical, the second portion 484 creates a larger torque that helps to maintain the slats in the closed position.

It will be appreciated that the strength of the biased torque is determined by the geometric configuration of the coupling member 468. In particular, the strength of the biased torque can be reduced by reducing the angular separation, $\theta$, of the cams 520 so as to position the cams 520 closer to the central portion 528 of the ladder support opening 526. Furthermore, the strength of the biased torque can be adjusted by modifying the lateral width, B, of the cams 520.

As shown in FIG. 15, the cams 520 also help to reduce a possible undesirable effect of the cutout 534. For example, in an embodiment that does not include the cams, the presence of the cutout 534 may reduce the ability of the coupling member 468 to sufficiently raise the first portion 478 of the ladder string 476. In particular, since the first portion 478 extends downward through the cutout 534 in the manner of FIG. 15 instead of along the circumference of the tubular wall 504 in the manner of FIG. 4C, rotation of the coupling member 468 will result in the first portion 478 experiencing a smaller change in elevation. Thus, without the cams 520, the maximum pitch of the interconnecting portions of the ladder strings may be insufficient to fully close the window blind.

However, it will be appreciated that the presence of the cams 520 substantially reduces the foregoing problem. In particular, since the first portion 478 of the ladder string 476 wraps around the perimeter of the first cam 520*a* when the first cam 520*a* is elevated as shown in FIG. 15, the first portion 478 of the ladder string 476 is raised to a height that is substantially above that of the embodiment that does include the cams 520. Thus, the cams 520 enable the interconnecting portions 490 of the ladder strings 476 to have a larger maximum pitch angle.

Thus, it will be appreciated that the coupling members 468 provide the window blind 300 with enhanced slat positioning characteristics. In particular, the coupling members 468 are able to maintain the pitch angle of the slats 310 at any value between zero degrees and the maximum pitch angle. In contrast, prior art window blinds often suffer from an inability to maintain the slats at or near the maximum pitch angle.

Thus, it will also be appreciated that the ladder string support characteristics of the coupling members 468 of FIG. 13 could be incorporated into a broad range of window blinds having rotatable slats, including prior art window blinds which incorporate a head rail. In particular, such window blinds often comprise a plurality of ladder string support devices that enable a plurality of ladder strings to be attached thereto such that rotation of the ladder string support device results in rotation of a plurality of slats. Furthermore, since the typical support device may not sufficiently reduce the distance between a first and second portion of the string assembly as measured at the support device when such a window blind is closed, it is often the case that the first and second portions extend downward from the supporting device in a converging and, therefore, somewhat nonvertical manner. Thus, it is often the case that the raised portion of the ladder string has a greater tension than that of the lower portion. Consequently, since both portions of the ladder string typically extend from the support device in a symmetrical manner, such a window blind has a tendency to self-rotate from the closed position in the direction of the open position.

Referring back to FIG. 6, the lifting mechanism 318 of the window blind 300 comprises the first and second draw cords 474*a*, 474*c* that wrap around the slat assembly 316 as described previously in connection with FIG. 12 and a cord locking device 536 that operates in a substantially similar manner to that of the cord locking device of FIG. 3A. In particular, the first and second lengths 497, 499 of the first draw cord 474*a* upwardly extend along the slat assembly 316 adjacent the first outer ladder string 476*a* and extend into the cutout 534 of the coupling member 468a attached to the outer mounting block 302*a* so as to extend into the aperture 472 of the rod assembly 314. Furthermore, the first and second lengths 497, 499 of the first draw cord 474*a* extend through the aperture 472 of the rod assembly 314 in the direction of the outer mounting block 302*a* so as to extend outside of the rod assembly 314. Moreover, the first and second lengths of the first draw cord 474*a* extend from the aperture 472 through the cord locking device 536 such that the ends 498, 500 of the first draw cord 474*a* terminate at a first pulling member 538.

As shown in FIG. 6, the first and second lengths 497, 499 of the second draw cord 474*c* upwardly extend along the second outer ladder string 476*c* and extend into the cutout 534 of the coupling member 468c attached to the tilt actuator block 304 so as to extend into the aperture 472 of the rod assembly 314. Furthermore, the first and second lengths 497, 499 of the second draw cord 474*c* extend through the aperture 472 in the direction of the outer mounting block 302*a* so as to extend outside of the rod assembly 314. Moreover, the first and second lengths 497, 499 of the second draw cord 474*c* extend from the aperture 472 through the locking device 436 such that the ends 498, 500 of the second draw cord 474*c* terminate at a second pulling member 540.

As shown in FIG. 6, the cord locking device 536 mounts to the outer mounting block 302*a* so as to enable the draw cord to downwardly extend along the outer edge of the window blind 300 adjacent the outer mounting block 302*a*. Furthermore, in one embodiment, the cord locking device 536 and outer mounting block 302*a* include a mounting slot and a mounting wedge, respectively, which are similar to that of the mounting plate 130 and the mounting wedge 176 of FIG. 2A so as to enable the locking device to be easily mounted to the outer mounting block.

Thus, when a user pulls on the pulling members 538, 540 of the lifting mechanism 318 in a synchronous manner so as to equally displace the first and second lengths 497, 499, 498, 500 of the draw cords 474 through the cord locking device 536, the bottom rail 494 of the slat assembly 316 is pulled upward, thereby upwardly drawing the slat assembly 316 of the window blind 300. Furthermore, by releasing the cord locking mechanism 536 and allowing the first and second lengths 497, 499 of the draw cords 474 to be displaced back into the aperture 472 of the rod assembly 314, the slat assembly 316 is lowered so as to enable the window blind 300 to cover the adjacent window.

It will be appreciated that the lifting mechanism 318 of FIG. 6 is simpler in design than the lifting mechanism of FIG. 3A. In particular, since the draw cords 474 extend through the aperture 472 of the rod assembly 314, the need for the guide plates 170 is obviated. Furthermore, since a substantial portion of the draw cords 474 are positioned within the aperture 472 of the rod assembly 314, the draw cords 474 are prevented from draping into the slat assembly 314. Thus, the draw cords 474 are less likely to tangle with the slat assembly 314.

Figure 16A:
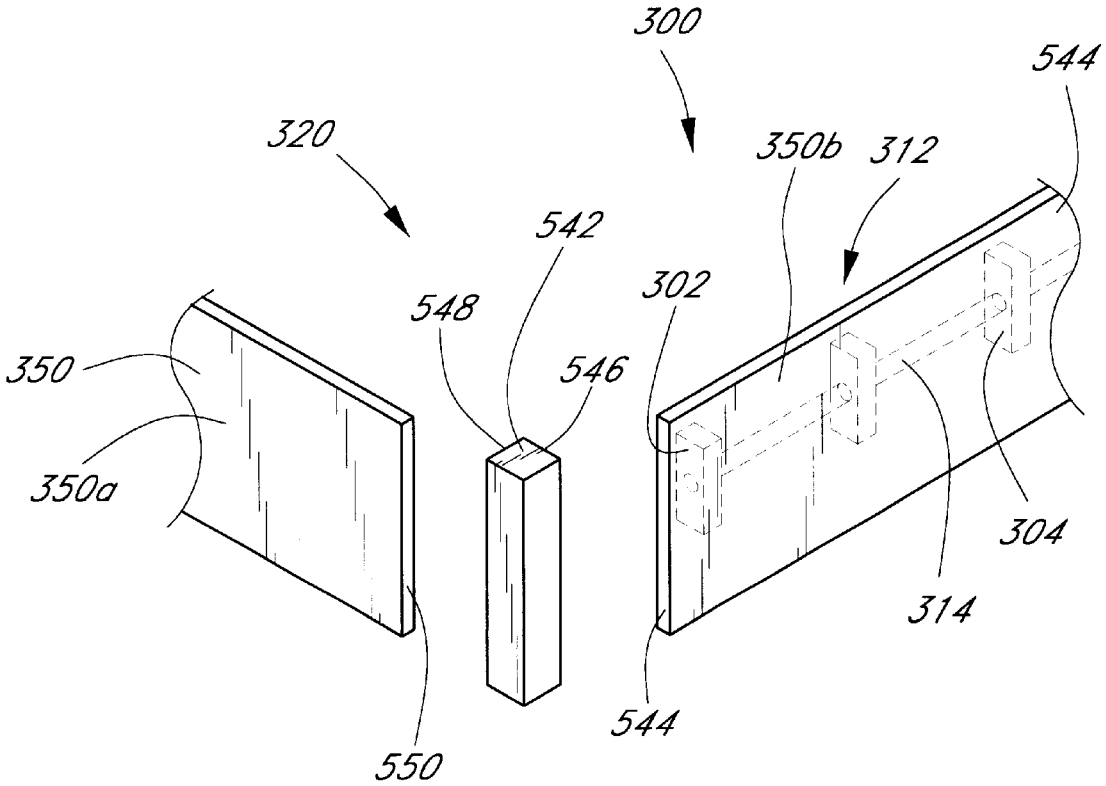
FIGS. 16A–B are perspective views of a valance assembly of the window blind of FIG. 6 illustrating a preferred method of assembling the valence assembly.
Figure 16B:
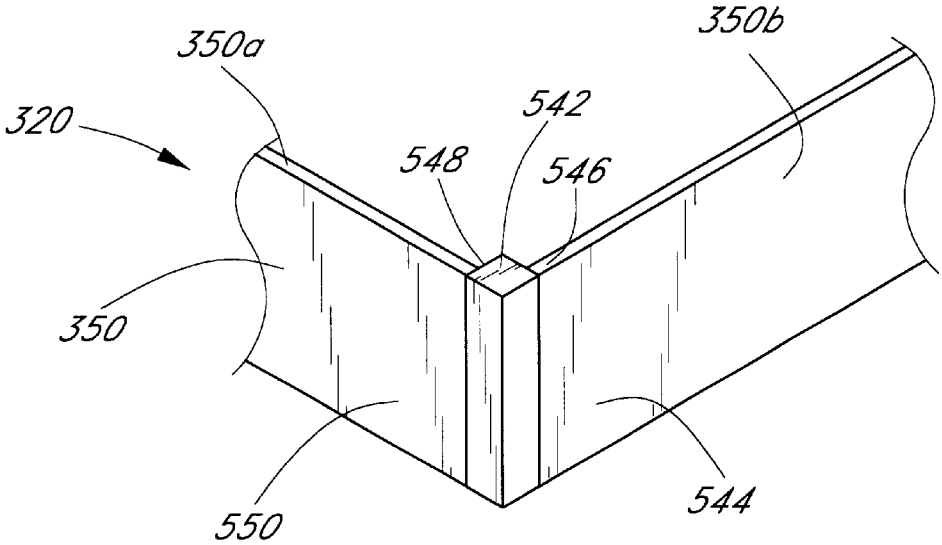
Figure 16C:
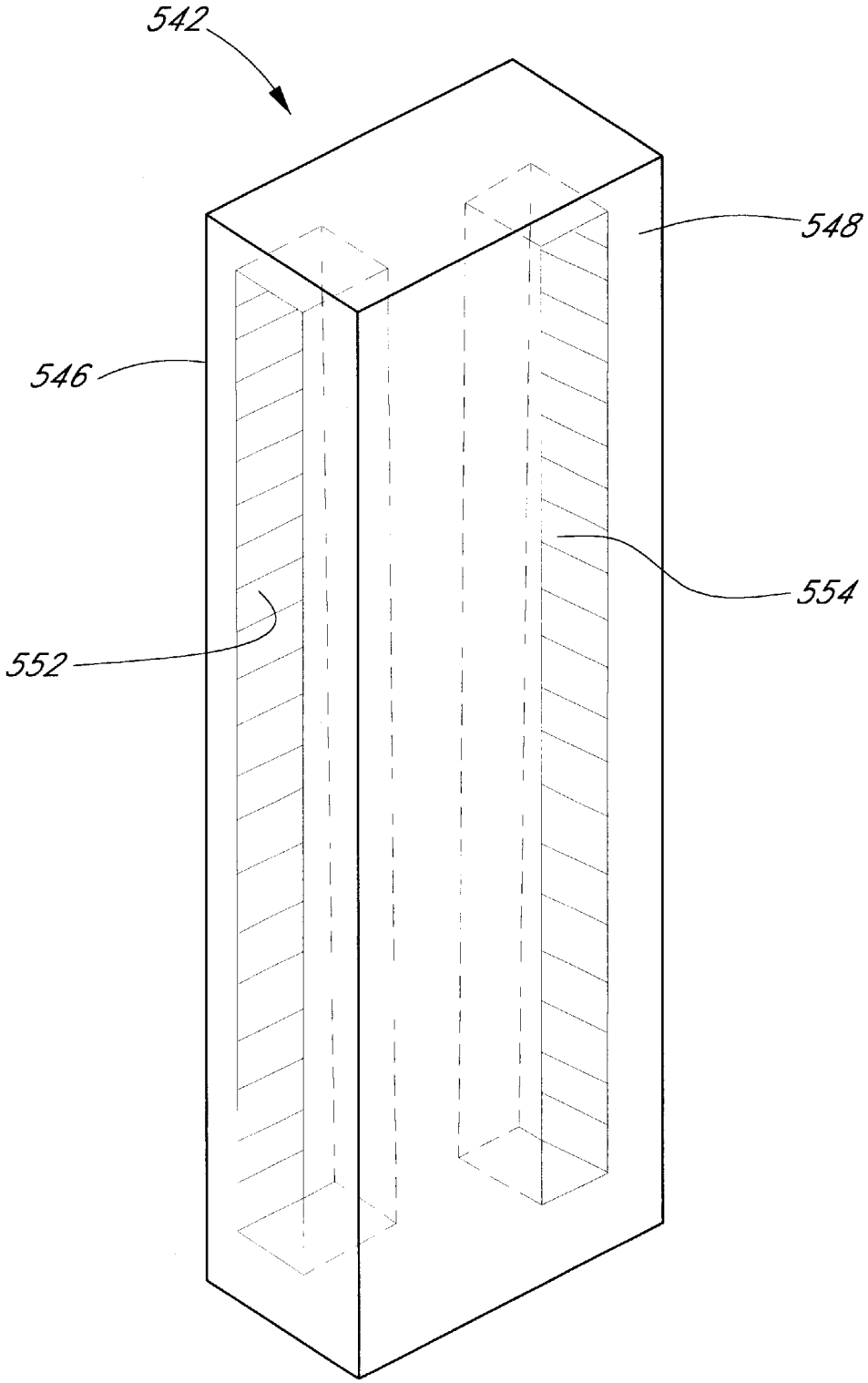
FIG. 16C is a perspective view of an attachment member of the valance assembly of FIGS. 16A–B.

Reference will now be made to FIGS. 16A–16C which illustrate the valance assembly 320 of the window blind 300 in greater detail. In particular, the valance assembly 320 comprises the plurality of decorative cover members 350 and at least one attachment members 542 that interconnects the cover members 350. Furthermore, the cover members 350 are formed with grooves (not shown) that are substantially similar to the grooves 160 of the decorative cover members 140 described previously in connection with FIG. 3A so as to provide an identical means for attaching the valence assembly 320 to the mounting/tilt blocks 302, 304. Additionally, the cover members 350 comprise at least one side cover member 350*a* adapted to cover an end portion of the mounting section 312 of the window blind 300 and at least one lateral cover member 350*b* adapted to cover an elongate portion of the mounting section 312. Moreover, the side cover member 350*a* joins with the lateral cover member 350*b* so that the valance assembly 320 is formed in a continuous manner so as to enable the valence assembly 320 to substantially cover the mounting section 312 and rod assembly 314 of the window blind 300.

As shown in FIG. 16A, the lateral cover member 350*b* attaches to the mounting/tilt blocks 302, 304 so that the lateral cover member 350*b* conceals the lateral view of the mounting section 312. In particular, to mount the cover member 350*b* to the front of the window blind 300, the front mounting wedge 348 of each block 302, 304 is positioned within the mounting groove of the lateral cover member 350*b* so as to be frictionally engaged therein. Alternatively, to mount the cover member 350*b* to the rear of the window blind 300, the rear mounting wedge 352 of each block 302, 304 is positioned within the mounting groove of the lateral cover member 350*b* in a substantially identical manner. Preferably, in either case, the lateral cover member 350*b* is attached so that at least one vertical edge 544 of the lateral cover member 350*b* extends beyond the adjacent mounting/tilt block 302, 304.

As shown in FIG. 16B, the attachment member 542 attaches to the lateral cover member 350*b*. In particular, the attachment member 542 having first and second mounting sides 546, 548 is positioned such that the first mounting side 546 of the attachment member 542 is mounted to the outer edge 544 of the lateral cover member 350*b*. Furthermore, the side cover member 350*a* having a vertical edge 550 is vertically positioned adjacent the lateral cover member 350*b* such that the edge 550 of the side cover member 350*a* is mounted to the second mounting side 548 of the attachment member 542. Thus, the side cover member 350*a* is positioned so as to conceal the side view of the mounting section 312.

Reference will now be made to FIG. 16C which illustrates one embodiment of the interconnecting member 542 of the valance assembly 320 of FIGS. 16A–16B in greater detail. As shown in FIG. 16C, the interconnecting member 542 comprises the first and second mounting sides 546, 548. In particular, the interconnecting member 542 comprises a first aperture 552 that orthogonally extends into the first mounting side 546 such that the vertical edge 544 of the lateral cover member 350*b* is able to extend into the first aperture 552 so as to frictionally engage the interconnecting member 542 with the lateral cover member 350*b*. Furthermore, the interconnecting member 542 further comprises a second aperture 554 that orthogonally extends into the second mounting side 548 such that the vertical edge 550 of the side cover member 350*a* is able to extend into the second aperture 554 so as to frictionally engage the interconnecting member 542 with the side cover member 350*a*. Moreover, in one embodiment, the first and second mounting sides extend from each other in a substantially perpendicular manner.

In one embodiment, the valance assembly 320 comprises two lateral cover members, two side cover members, and four attachment members. In particular, the lateral cover member attach to the mounting wedges of the mounting/tilt blocks in the manner of FIGS. 7B so as to interpose the mounting section and rod assembly therebetween. Furthermore, the first mounting sides of the attachment members attach to the outer edges of the lateral cover members in the manner of FIG. 16B. Moreover, the outer edges of the side cover members attach to the second mounting sides of the attachment members in the manner of FIG. 16B. Thus, in this embodiment, the valance assembly vertically surrounds the mounting section and rod assembly of the window blind 300.

As mentioned previously, the problem with prior art window blinds is that they are assembled with a fixed size at a central manufacturing facility far from the installation site. Thus, an installer must pre-measure the size of the window at the installation site, order the blinds to match the measured window size, wait many days for the blinds to arrive from the manufacturer, and return to the installation site to install the blinds.

In contrast, assembly and installation of the window blind 300 can be accomplished in a more expedient manner. In particular, as will be described in greater detail below, the window blind 300 can be formed from a kit such that the installer is able to adapt the window blind 300 with a width and height to match virtually any sized window in approximately one hour or less.

To allow expedient installation of the window blind 300, the kit preferably includes the essential elements of the window blind 300. In particular, the kit comprises the plurality of slats 310 having extended lengths that define the maximum width of the window blind 300. Furthermore, as will be described in greater detail below, the slats 310 can be reduced in length by sawing means so that the width of the slats 310 match the preferred width of the window blind 300.

The kit further comprises the remaining components of the slat assembly 316. In particular, the kit includes the ladder strings 476, the draw cords 474, and the bottom rail 494. Furthermore, the bottom rail 494 is provided with an extended length so that it can be adapted with a length that matches the length of the slats 310, as will be described in greater detail below.

The kit further comprises the components required to assemble the mounting/tilt blocks 302, 304. In particular, the kit includes the housing assemblies 308. Furthermore, the kit includes the mounting posts 324, the worm gear 368, the cord hub 372 and the pivot hub 394 so as to enable assembly of the rotatable members 306. Moreover, the kit includes the worm 384, the wand 330, the cord roller 374, the cord retainer post 444, and the tilt cord 326 so as to enable the tilt block 304 to be configured either as the wand-driven tilt block 304*d* or the cord-driven tilt block 304*c*. Additionally the kit includes the mounting plates 130 so as to enable the blocks 302, 304 to be mounted adjacent the window.

The kit further includes the remaining components of the rod assembly 314. In particular, the kit includes the coupling members 468 and the rod sections 464 that are interposed between the blocks 302, 304. Furthermore, as will be described in greater detail below, the rod sections 464 are provided with an extended length so that the width of the rod assembly 314 formed therefrom can be adapted to match the width of the slats 310.

The kit further comprises the remaining components of the lifting mechanism. In particular, the kit includes the cord locking device 536 which is adapted to mount to the outer mounting block 302*a*.

The kit further comprises the components of the valance assembly 320. In particular, the kit includes the cover members 350 and the attachment members 542. Furthermore, the lateral cover members 350*b* are provided with an extended length so that they can be cut to a desired length that substantially matches the width of the valance assembly 320 with the width of the rod assembly 314.

To facilitate assembly of the window blind 300 from the kit, the kit may further comprise a plurality of assembly tools. In particular, the kit may include a saw guide 562 and a saw 566 to facilitate cutting of the slats 310, the bottom rail 494, the rod sections 464, and the lateral cover members 350*b*, as will be described in greater detail below in connection with FIG. 17. Furthermore, the kit may include a temporary slat holder 568 so as to facilitate assembly of the slat assembly 316 as will be described in greater detail below in connection with FIG. 16.

To assemble the window blind 300 from the kit, it is preferable to first evaluate the window that is to be covered by the window blind 300 so as to determine the preferred width and height of the window blind 300. For example, if the window blind 300 is mounted to an upper horizontal mounting surface as shown in FIG. 1, then the preferred width and height of the window blind 300 may be defined by the measured width and height of the opening. Alternatively, if the window is to be mounted to a vertical mounting surface above the window, then the preferred width and surface height of the window blind 300 may be respectively defined by the measured width of the window and the measured height of the window plus the measured height of the valance assembly 320. Thus, with the preferred width and height of the window blind 300 determined in the foregoing manner, the window blind 300 can be adapted with the preferred width and height as will be described in greater detail below.

The method of assembling the kit further comprises determining the preferred number of inner mounting blocks 302*b* that are to be included in the mounting section 312 of the window blind 300. In particular, since the weight and width of the window blind 300 are approximately proportional to each other, the preferred number of inner blocks 302*b* increases approximately in proportion to the width of the window blind 300 so as to limit the load bearing forces applied by the mounting/tilt blocks 302, 304. Thus, the preferred number of inner blocks 302*b* may be determined by a mathematical equation supplied with the kit that takes into account the preferred width of the window blind 300. Alternatively, the preferred number of inner blocks 302*b* could be determined by cross-referencing the preferred width with a lookup table supplied with the kit. Furthermore, since it is preferable to have the number of ladder strings equal the number of mounting/tilt blocks so as to prevent the slats from sagging, the number of ladder strings 476 preferably matches the number of inner mounting blocks 302*b* plus two.

The method of assembling the kit further comprises determining the preferred number of slats 310 that are to be included in the slat assembly 316. In particular, since the preferred number of slats 310 is proportional to the preferred height of the window blind 300, the preferred number of slats 310 may be obtained from a mathematical equation that takes into account the preferred height of the window blind 300. Alternatively, the preferred number of slats may be obtained by referencing the height of the window with a lookup table provided with the kit. Furthermore, lower portions of the ladder strings 476 are cut so as to match the number of interconnecting sections 490 of the ladder strings 476 with the preferred number of slats 310.

Figure 17:
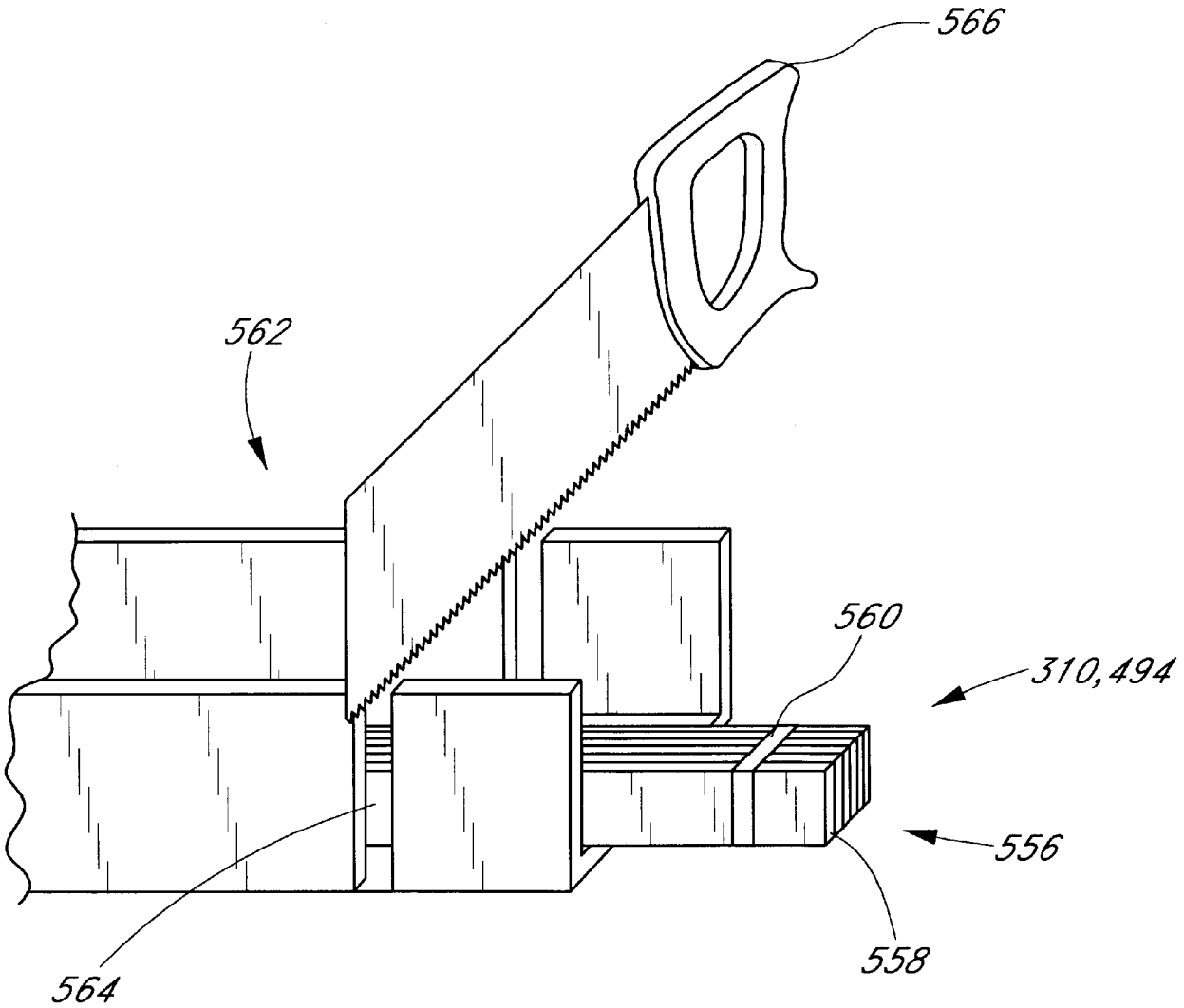
FIG. 17 is a perspective view of a plurality of the slats of the slat assembly of FIG. 6 bundled within a sawing apparatus illustrating a preferred method of reducing the length of the slat assembly of the window blind of FIG. 6.

The method of assembling the kit further includes adjusting the length of the slats 310 and the bottom rail 494, which comprises sawing the slats 310 and the bottom rail 494, preferably using the method shown in FIG. 17. In particular, the slats 310 and the bottom rail 494 are bundled adjacent each other in a slat bundle 556 having an end 558 such that broad surfaces of adjacent slats/bottom rail 310, 494 contact each other and such that a first end of each slat/bottom rail is aligned with the end 558 of the slat bundle 556. Furthermore, the slat bundle 556 is preferably maintained in the forgoing relationship by wrapping a length of adhesive tape 560 around the end 558 of the slat bundle 556. Moreover, the slat bundle 556 is marked with a cutting line that defines the amount of material that is to be removed from each slat. Next, the slat bundle 556 is positioned on a horizontal surface of a saw guide 562 having a vertical saw guide slot 564 such that the slot 564 aligns with the cutting line. Finally, a conventional wood saw 566 is used to remove excess material from the slat bundle 556 by directing the saw 566 through the slot of the saw guide 562.

The method of assembling the kit further includes modifying the lengths of the rod sections 464 so as to provide the rod assembly 314 with the preferred width. As mentioned previously in connection with FIG. 6, the rod sections 464 interconnect the rotatable members 306 of the mounting/tilt blocks 302, 304 so that rotation of the rotatable member 306*c*, 306*d* of the tilt actuator blocks 304 induce corresponding rotation of the slats 310. Thus, since the preferred lengths of the rod sections 464 are defined by the number of inner mounting blocks 302*b* and the width of the window blind 300, the preferred lengths of the rod sections 464 can be determined by a mathematical equation supplied with the kit that takes into account the preferred width of the window blind 300 and the number of inner mounting blocks 302*b*. Alternatively, the preferred lengths of the rod sections 464 can be determined by referencing the preferred width of the window blind 300 and the number of inner mounting blocks 302*b* with a lookup table supplied with the kit. Furthermore, since the rod sections 464 are preferably formed of PVC pipe material, they can be cut to size using the conventional saw 566 and the saw guide 562 of FIG. 17.

The method of assembling the kit further includes assembling the mounting section 312. In particular, the inner mounting block 302*b*, the outer mounting block 302*a*, and the tilt actuator block 304 are assembled as described previously in connection with FIGS. 811. Moreover, the tilt actuator block 304 can be configured with either the wand-driven pivot assembly 322*d* or the cord-driven pivot assembly 322*c*.

The method of assembling the kit further includes assembling the rod assembly 314. In particular, this comprises using the coupling members 468 to couple the rod sections 464 with the mounting posts 324 of the mounting/tilt blocks 302, 304 as described earlier in connection with FIG. 6. Thus, since a keyed fit is realized as described earlier in connection with FIG. 14A, the rod assembly 314 is formed so that the coupling members 468 are rotationally aligned with each other.

Figure 18:
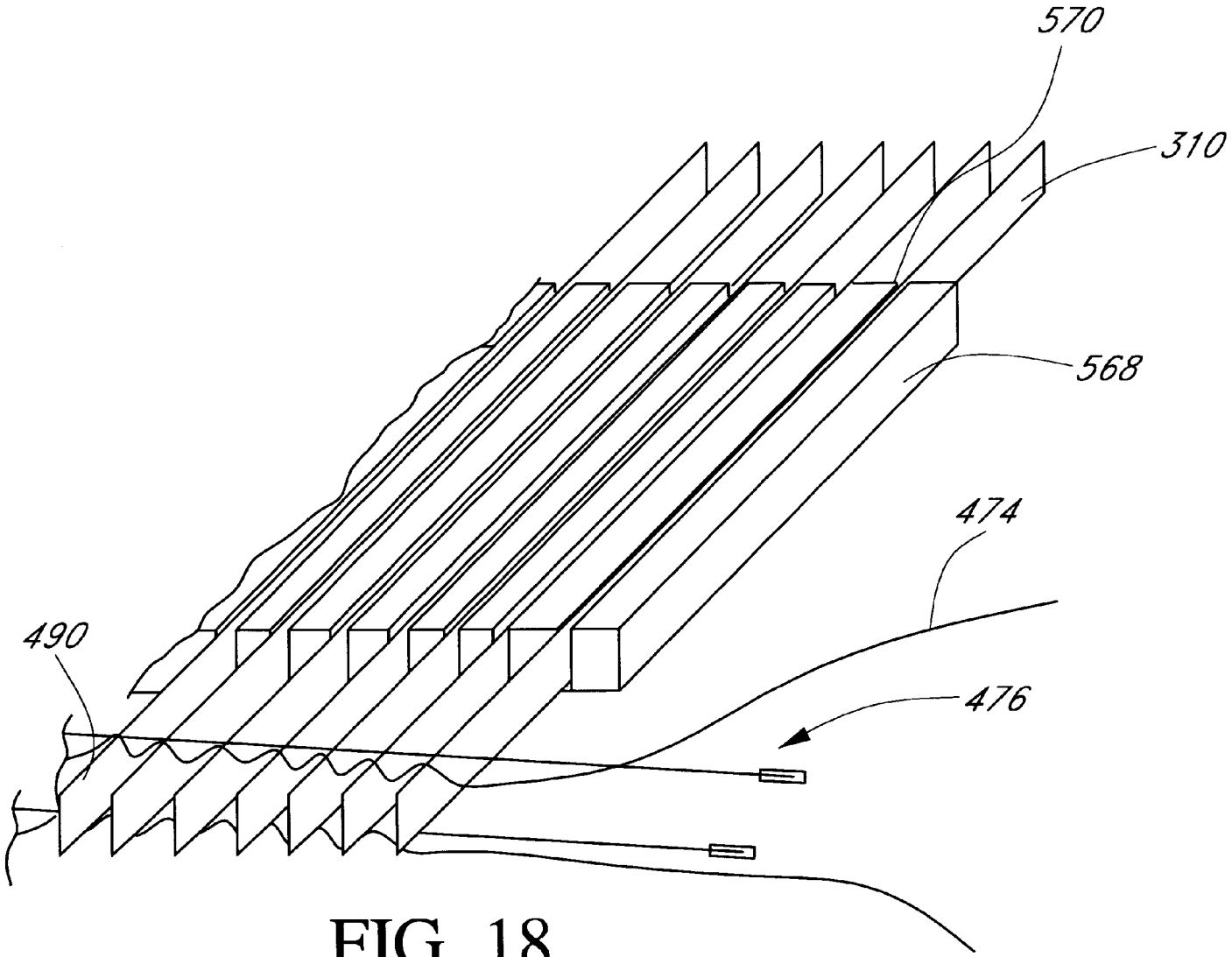
FIG. 18 is a perspective view of the plurality of slats of the window blind of FIG. 6 positioned in a temporary slat holder illustrating a preferred method of assembling the slat assembly of the window blind of FIG. 6.

The method of assembling the kit further includes assembling the slat assembly 316. In particular, this comprises positioning the slats 310 in a slat holder 568 having a plurality of parallel slots 570 so as to support each of the slats 310 in a parallel member such that the slats 310 are separated from each other as shown in FIG. 18. Furthermore, because the slats 310 are separated from each other by the holder 568, the ladder strings 476 can then be slipped over the ends of the slats so that each interconnecting section 490 of each ladder string 476 is positioned adjacent the corresponding slat 310. Moreover, the draw cords 474 are extended around the slats 310 in the serpentine manner described previously in connection with FIG. 12.

The method of assembling the kit further comprises attaching the slat assembly 316 to the rod assembly 314. In particular, with the slats 310 positioned in the temporary slat holder 568 of FIG. 18, the outer ladder strings 476*a*, 476*c* are mounted to the outer coupling members 468*a*, 468*c* as described previously in connection with FIG. 13. Furthermore, the slats 310 are then removed from the temporary slat holder 568 so that the inner ladder string 476*b* can be moved toward the middle of the slat assembly 316. Moreover, the inner ladder string 476*b* is then mounted to a centrally positioned inner coupling member 468*b* in the manner of FIG. 13. Additionally, the bottom rail 494 is then interposed between the bottommost slat 310 and the bottommost interconnecting section 492 of the ladder strings 476 so that the bottom rail 494 is aligned with the bottommost slat 310. Finally, the clips 496 are attached to the bottom rail 494 so as to secure the ladder strings 468 and the draw cords to the bottom rail 494.

The method of assembling the kit further includes assembling the lifting mechanism 318. In particular, this comprises extending the ends 498, 500 of the draw cords 474 into the aperture 472 of the rod assembly 314 as described previously in connection with FIG. 6. Moreover, the cord locking device 536 is mounted to the outer mounting block 302*a* in the manner described previously in connection with FIG. 6. Furthermore, the draw cords 474 are extended through the aperture 472 of the rod assembly 314 toward the outer mounting block 302*a*. Additionally, the draw cords 474 are extended outside of the rod assembly 314 and guided through the cord locking device 536 as shown in FIG. 6 such that the draw cords 474 terminate at the pulling members 538, 540.

The method of assembling the kit further comprises assembling the valance assembly 320. In particular, the lateral cover members 350*b* are first reduced in length so as to substantially match the preferred width of the window blind 300. Specifically, the lateral cover members may be cut to the preferred length using the conventional saw and the saw guide of FIG. 17. Thus, with the lateral member cut to the preferred width, the valance assembly may be assembled as described previously in connection with FIGS. 16A–B.

Although the preferred embodiment of the kit described above enables the window blind 300 to be assembled with a width that allows the window blind 300 to cover a window having either a standard size or a non-standard size, it will be appreciated that, in another embodiment, the kit could be configured to further facilitate assembly of the window blind 300 that is limited to only covering a window with a standard size. In particular, the slats 310, the rod sections 464, the bottom rail 494, and the cover members 350 could be provided with particular sizes that enable the window blind 300 assembled therefrom to cover the window having the standard width so as to obviate the need for reducing the lengths of the slats 310, the rod sections 464, the bottom rail 494, and the cover members 350.

The preferred method of installing the window blind 300 will now be described in greater detail in connection with FIG. 19. In particular, the preferred method enables an installer to easily mount the window blind 300 to a horizontal mounting surface 575 adjacent a window 574 so that the window blind 300 is able to substantially cover the window 574.

Figure 19:
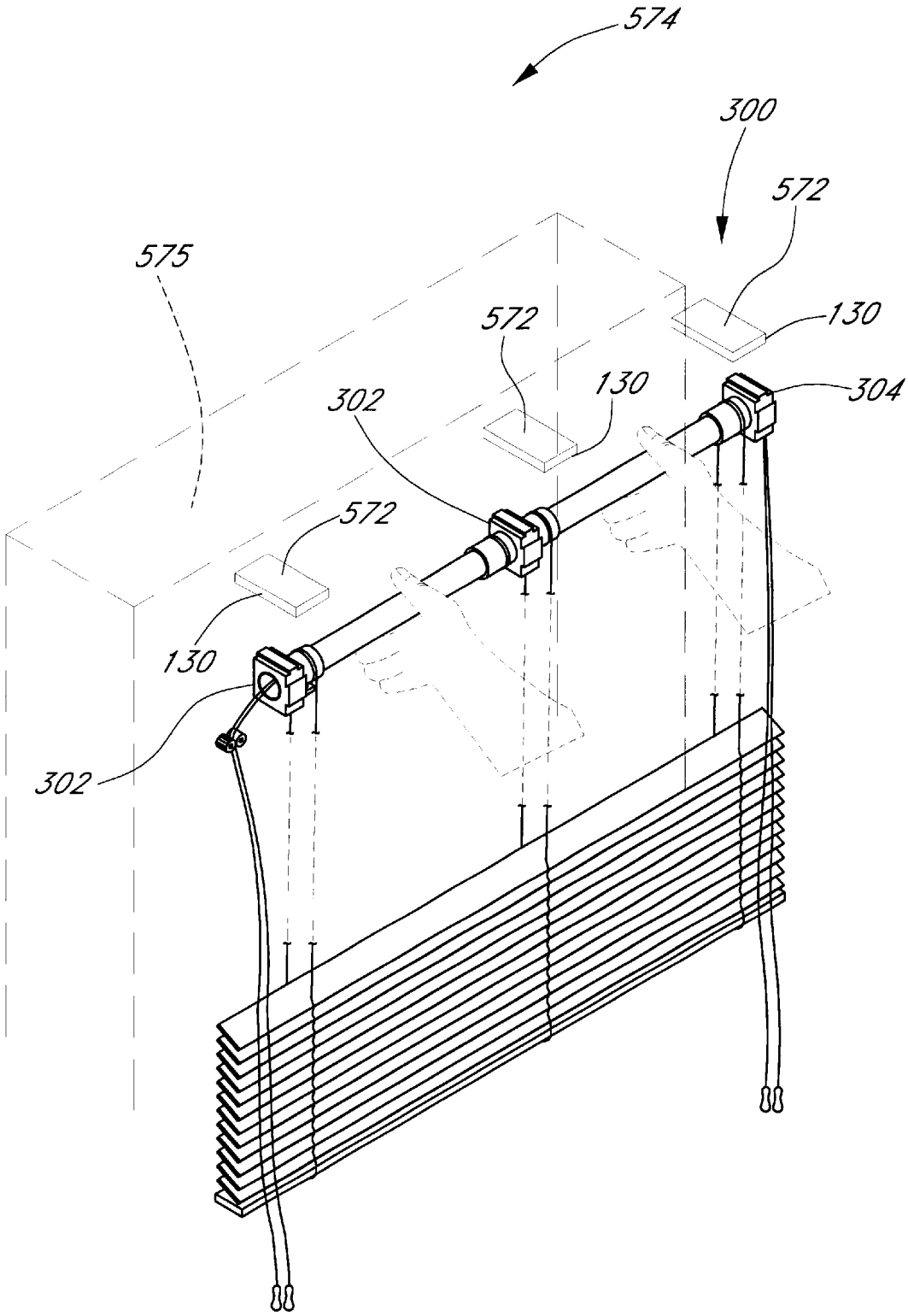
FIG. 19 is a perspective view of the window blind of FIG. 6 illustrating a preferred method of installing the window blind.

As shown in FIG. 19, the preferred method of installing the window blind 300 first comprises attaching the mounting plates 130 to the mounting wedges 346, 352 of the mounting/tilt blocks 302, 304 in the manner described earlier in connection with FIGS. 2A and 2B. In particular, since the mounting surface 575 adjacent the window 574 is horizontally oriented as shown in FIG. 19, the mounting plates 130, in one embodiment, are attached to the mounting wedges 346 extending from the upper side surface 338 of the housing assemblies 308. However, if a vertical mounting surface is more suitable, then, in another embodiment, the mounting plates 130 would be attached to the mounting wedges 352 extending from the rear side surface 344 of the housing assemblies 308. Furthermore, the exposed surfaces of the mounting plates 130 are preferably covered with a bonding material 572, such as double sided adhesive tape, so as to provide a temporary mounting means as will be described in greater detail below.

As shown in FIG. 19, the installer then positions the assembled window blind 300 adjacent the window 574 so as to determine the preferred mounting location on the mounting surface 575 adjacent the window 574. When the preferred mounting location is determined, the installer simply forces the window blind against the mounting surface 575 such that the bonding material 572 of the mounting plates 130 bonds to the mounting surface 575. Furthermore, with the mounting plates temporarily bonded to the mounting surface 575, the installer then removes the mounting/tilt blocks 302, 304 of the window blind 300 from the mounting plates 130. Moreover, with the mounting plates exposed, the installer then secures the mounting plates to the mounting surface 574 using fastening screws in the manner of FIGS. 2A and 2B. Finally, with the mounting plates attached to the mounting surface 576 in a secure manner, the mounting/tilt blocks 302, 304 are then reattached to the mounting plates.

Thus, it will be appreciated that an installer of ordinary skill is able to assemble the window blind 300 from the kit in a relatively short period of time. In particular, the installer is able to adapt the window blind 300 with a width and height that provides optimal coverage of the window by the window blind 300 in a relatively short period of time. Moreover, the kit method of assembly provides the installer with the option of configuring the tilt block 304 as the wand-driven tilt actuator block 304*d* or as the cord-driven tilt actuator block 304*c*. Furthermore, since the installer is able to adhesively attach the mounting plates to the mounting surfaces by simply holding the window blind 300 adjacent the window, the installer can then securely mount the window blind 300 with relative ease.

However, although the preferred method of installing the window blind 300 includes the use of the mounting plates 130, it will be appreciated that the window blind 300 could be installed without the mounting plates 130. For example, the housing assemblies 308 could be directly attached to the mounting surface 575 adjacent the window 574 simply by extending attachment screws through the housing assemblies 308 and into the mounting surface 575.

It will also be appreciated that the components of the window blind kit described hereinabove can be packaged and sold at retail stores to do-it-yourself installers. In particular, as mentioned previously, the kit comprises the housing assemblies 308 so as to enable the assembly of the mounting/tilt blocks 302,304 of the mounting section 312, and the pivot assemblies 322, the rod sections 464, and the coupling members 468 so as to enable the assembly of the tilt rod assembly 314 in the manner described previously. Furthermore, the kit comprises the tilt cord 326 and the wand 330 so as to enable the assembly of the desired configuration of the user input device, and the slats 310 having a finite length and the ladder strings 476 so as to enable the assembly of the slat assembly 316. Moreover, the kit comprises the saw guide 562 so as to enable the slats 310 to be selectively shortened to the desired length, and the slat holder 568 so as to temporarily position the slats 310 to thereby allow for convenient assembly of the slat assembly 316 as mentioned previously. Additionally, the kit comprises the draw cords 474 and the cord locking device 536 so as to enable the assembly of the lifting mechanism 318, and the decorative cover members 350 and the interconnecting members 542 so as to enable the assembly of the valence assembly 320.

Thus, since the components of the window blind kit are limited in number and have a relatively small size, the window blind kit can be placed into a conventional packaging container, such as a box, and placed on retail store shelves. Furthermore, since the individual consumer is able to easily assemble the window blind 300 from the kit in various configurations and easily install the window blind 300 so as to cover virtually any type of window in a relatively short period of time in the manner described previously, the window blind kit described hereinabove will likely appeal to a large number of consumers.

Although the preferred embodiment of the present invention has shown, described, and pointed out the fundamental novel features of the invention, it will be understood that various omissions, substitutions and changes in the form of the detail of the device illustrated may be made by those skilled in the art without departing from the spirit of the present invention. Consequently, the scope of the invention should not be limited to the foregoing description but is to be defined by the appended claims.

What is claimed is:

1. A window blind adapted to cover a window of a structure, the window blind comprising:

a mounting section comprising a mounting block assembly and a tilt actuator block assembly separate from the mounting block assembly, wherein the mounting block and the tilt actuator block assemblies each include a recessed spool space formed therein and a first aperture extending through the spool space, wherein each mounting block and tilt actuator block assembly separately mounts directly to a surface of the structure in a position adjacent the window;

a rotatable rod assembly comprising a first rotatable member rotatably captured within the spool space of the mounting block assembly so as to extend from the first aperture of the mounting block assembly, a second rotatable member rotatably captured within the spool space of the tilt actuator block assembly so as to extend from the first aperture of the tilt actuator block assembly, and an elongate rod section having a first and second end, wherein the first and second ends of the rod section respectively couple with the first and second rotatable members;

a slat assembly comprising a first and second ladder member supported by the rod assembly and further comprising a plurality of slats supported by the first and second ladder members wherein the ladder members are attached to the rotatable rod assembly so that rotation of the rod assembly results in orientation of the plurality of slats at a pitch angle that determines the amount of light that passes through the window blind;

wherein each ladder member of the slat assembly comprises a first and second elongate portion that extend downwardly from the rod assembly so that the first and second elongate portions move in opposing vertical directions in response to rotation motion of the rod assembly and wherein each ladder assembly further comprises a plurality of interconnection sections extending therebetween, wherein the plurality of slats are supported by the plurality of interconnection sections such that vertical movement of the first and second portions of each ladder member results in a change in the pitch angle of the slats in correlation with the angular orientation of the rod assembly; and wherein the rotatable rod assembly is adapted to support the first and second ladder members at a first and second pair of contact points on the rotatable rod assembly, wherein the rotatable rod assembly is contoured at the first and second pair of contact points so that the distance between the first and second elongate portions of each ladder member decreases in coincidence with an increase in the pitch angle of the slats so as to maintain the elongate portions in substantially vertical orientation so that the tension in the first and second elongate portions are substantially equalized with respect to each other so as to inhibit the ladder members from exerting a combined torque on the rod assembly that results in a decrease in the pitch angle of the slats.

2. The window blind of claim 1, comprising a user input device having a tilt mechanism positioned in the tilt actuator block assembly such that user activation results in rotation of the second rotatable member so as to enable the user to vary the pitch angle of the slats of the slat assembly.

3. The window blind of claim 2, wherein the first rotatable member of the rotatable rod assembly comprises a central section and at least a first end section attached to the central section such that the central section is rotatably captured within The spool space of the mounting block assembly and the first end section of the first rotatable member outwardly extends from the central section of the first rotatable member through the first aperture of the mounting block assembly.

4. The window blind of claim 3, wherein the second rotatable member of the rod assembly comprises a central section and at least a first end section attached to the central section such that the central section is rotatably captured within the spool space of the tilt actuator block assembly and the first end section of the second rotatable member outwardly extend from the central section of the second rotatable member through the first aperture of the tilt actuator block assembly.

5. The window blind of claim 4, wherein the first rotatable member of the rotatable rod assembly further comprises a second end section attached to the central section so that the central section is interposed between the first and second end sections, wherein the second end section outwardly extends from the central section through the first aperture of the mounting block assembly.

6. The window blind of claim 5, wherein the second rotatable member of the rotatable rod assembly further comprises a second end section attached to the central section so that the central section is interposed between the first and second end sections, wherein the second end section outwardly extends from the central section through the first aperture of the tilt actuator block assembly.

7. The window blind of claim 6, wherein the mounting block and the tilt actuator block assemblies each comprise an identically formed housing assembly.

8. The window blind of claim 7, wherein the housing assembly comprises a first and second section such that the first aperture extends through the first and second sections and such that the spool space is interposed between the first and second sections.

9. The window blind of claim 8, wherein the first end sections of the first and second rotatable members each comprise a first mounting post having an outer surface that extends from the housing assembly.

10. The window blind of claim 9, wherein the second end section of the first rotatable member comprises a second mounting post that is substantially identical to the first mounting post so as to enable the window blind to be formed with an increased width.

11. The window blind of claim 4, wherein the central section of the second rotatable member comprises a worm gear and wherein the tilt mechanism of the user input device comprises a worm adapted to engage with the worm gear so that rotation of the worm results in rotation of the second rotatable member.

12. The window blind of claim 11, wherein the tilt actuator block assembly further comprises a recessed worm space and a worm shaft opening that extends from the worm space so as to enable the worm having a head section and a shaft section to be positioned within the worm space such that the head section is able to engage the worm gear and such that the shaft outwardly extends from worm shaft opening of the tilt actuator block assembly.

13. The window blind of claim 12, wherein the user input device further comprises a wand adapted to engage with the worm so that rotation of the wand results in rotation of the worm.

14. The window blind of claim 4, wherein the user input device comprises a tilt cord that couples with the second rotatable member and extends out of the tilt actuator block assembly so that the second rotatable member is urged into a state of rotation in response to an external force applied through the tilt cord.

15. The window blind of claim 14, wherein the central section of the second rotatable member comprises a cord hub that is adapted to fixedly attach to the tilt cord.

16. The window blind of claim 15, wherein the central section of the second rotatable member further comprises a cord retainer post adapted to couple with the cord hub so as to fixedly attach the tilt cord to the cord hub.

17. The window blind of claim 9, wherein the rotatable rod assembly further comprises a first and second coupling member, wherein the first and second coupling members respectively couple the first and second ends of the rod section with the mounting posts of the first and second rotatable members.

18. The window blind of claim 17, wherein the first and second coupling members each comprise a substantially tubular wall having an inner surface, an outer surface, and a first opening that extends along the inner surface, and wherein the mounting posts of the first and second rotatable members extend into the first opening of the coupling members so that the outer surfaces of the mounting posts frictionally engage the inner surfaces of the coupling members.

19. The window blind of claim 18, wherein the rod section has an outer surface that extends into the first opening of the coupling members so as to frictionally engage the outer surface of the rod section with the inner surface of the coupling members.

20. The window blind of claim 19, wherein the inner surface of each coupling member is formed with a flat section and the outer surfaces of each mounting post and rod section are formed with flat sections so as to prevent relative rotational motion therebetween.

21. The window blind of claim 1, wherein the rotatable rod assembly comprises at least one tubular wall defining an interior region, wherein the at least one tubular wall is contoured with a plurality of cutouts such that each of the cutouts is positioned adjacent each of the first and second pairs of contact points, wherein the cutouts are adapted so that the first and second elongate portions of the adjacent ladder member are able to extend into the interior region of the at least one tubular wall so as to decrease the distance between the first and second elongate portions in coincidence with an increase in the pitch angle of the slats.

22. The window blind of claim 21, wherein the rotatable rod assembly is contoured at the first and second pair of contact points so as to increase the vertical displacement between the first and second elongate portions of each ladder member in response to rotation of the rotatable rod assembly to thereby increase the range of the pitch angle of the slats.

23. The window blind of claim 22, wherein the rotatable rod assembly further comprises a first and second cam section that outward extends from the at least one tubular wall at the first and second pair of contact points, wherein the first and second elongate portions of the ladder member respectively extend adjacent the first and second cam sections in a flush manner so as to increase the range of the pitch angle of the slats.

24. The window blind of claim 1, wherein the rotatable rod assembly is contoured so as to support the first and second ladder members such that the first and second portions of each ladder member are asymmetrically positioned radially with respect to the axis of rotation of the rod assembly so as to inhibit the ladder members from exerting a torque on the rod assembly that results in a decrease in the pitch angle of the slats.

25. The window blind of claim 1, further comprising a lifting mechanism adapted to allow a user to raise and lower the slat assembly.

26. The window blind of claim 25, wherein the rod assembly comprises an aperture that extends substantially along the length of the rod assembly.

27. The window blind of claim 26, wherein the lifting mechanism comprises a plurality of draw cords that extend along the slat assembly and wherein the draw cords further extend through the aperture of the rod assembly.

28. The window blind of claim 1, further comprising a valance assembly that substantially covers the mounting section and rod assembly of the window blind.

29. The window blind of claim 28, wherein the valance assembly comprises a lateral cover member having a vertical edge, a side cover member having a vertical edge, and an interconnecting member that couples the vertical edge of the lateral cover member with the vertical edge of the side cover member.

30. The window blind of claim 29, wherein the interconnecting member comprises a first mounting side having a first aperture formed therein and a second mounting side having a second aperture formed therein, wherein the vertical edge of the lateral cover member extends into the first aperture so as to be frictionally engaged therein and wherein the vertical edge of the side cover member extends into the second aperture so as to be frictionally engaged therein.

31. The window blind of claim 30, wherein the lateral cover member and the side cover member extend from the interconnecting member in a substantially perpendicular manner.

32. The window blind of claim 31, wherein the mounting block assembly and the tilt actuator block assembly each further comprise a plurality of mounting wedges extending therefrom.

33. The window blind of claim 32, wherein the lateral cover member further comprises a mounting groove adapted to frictionally engage with the mounting wedges of the mounting block assembly and tilt actuator block assembly so as to enable the lateral cover member to mount thereto.

34. The window blind of claim 33, wherein the mounting plates are interposed between the mounting and the tilt actuator block assemblies and the surface of the structure adjacent the window.

35. The window blind of claim 34, wherein the mounting plates are each formed with a slot adapted to enable the mounting wedges to extend thereinto.

36. A window blind apparatus for covering a window, the apparatus comprising:

a mounting assembly mounted to a surface adjacent the window;

a slat assembly comprising a plurality of slats and a plurality of ladder members, wherein each ladder member comprises a first and second elongate section and a plurality of interconnecting sections that interconnect the first and second elongate sections, wherein the interconnecting sections of the ladder members support the plurality of slats; and a tilt rod assembly rotatably captured by the mounting assembly, wherein the tilt rod assembly is formed with a plurality of ladder member attachment points adapted so as to support the plurality of ladder members of the slat assembly and with a plurality of cams mounted to the tilt rod assembly adjacent the ladder member attachment points, wherein the first and second elongate sections of the ladder members extend from the ladder member attachment points so that the first and second elongate sections of each ladder member is vertically displaced with respect to each other and induced to pass through the tilt rod assembly in response to a first rotation of the tilt rod assembly so as to vary the pitch angle of the plurality of slats positioned on the interconnecting sections of the ladder members, wherein the tilt rod assembly is adapted to reduce the horizontal distance between the first and second elongate sections of each ladder member in coincidence with an increase in the pitch angle of the plurality of slats so as to reduce the difference in the tensions of the first and second elongate sections of each ladder member to thereby inhibit the pitch angle of the plurality of slats from changing in the absence of an external torque applied by a user;

wherein the tilt rod assembly adjacent the ladder member attachment sections is contoured so that, when the tilt rod assembly is positioned in the closed orientation, the net torque applied by the ladder members onto the tilt rod assembly biases the tilt rod assembly to remain positioned in the closed orientation.

37. The window blind apparatus of claim 36, wherein the tilt rod assembly is rotatable between an open orientation and a closed orientation such that the pitch angle of the slats is substantially zero when the tilt rod assembly is in the open orientation and such that the pitch angle is at a maximum value when the tilt rod assembly is in the closed orientation.

38. The window blind of claim 37, wherein the tilt rod assembly comprises at least one tubular wall defining an interior region, wherein the at least one tubular wall is contoured with a plurality of cutouts adjacent the ladder member attachment points, wherein the cutouts are adapted so that the first elongate section of each ladder member is able to extend into the interior region of the at least one tubular wall when the tilt rod assembly is rotated from the open orientation so as to continually reduce the horizontal distance between the first and second elongate members of each ladder member in response to a continued rotation of the tilt rod assembly from the open orientation.

39. The window blind apparatus of claim 38, wherein each of the cutouts extends between adjacent pairs ladder member attachment points.

40. The window blind apparatus of claim 39, wherein the tilt rod assembly adjacent the ladder member attachment points is adapted so as to increase the range of the pitch angle of the slats.

41. The window blind apparatus of claim 40, wherein the plurality of cams each has an outer surface and is mounted to the tilt rod assembly adjacent the ladder member attachment points so as to outwardly extend from the at least one tubular wall adjacent the ladder member attachment points so that the first and second elongate members of each ladder member extends along the outer surface of each cam to thereby increase the relative vertical displacement between the first and second elongate members of each ladder member in response to a rotation of the tilt rod assembly from the open orientation.

42. The window blind apparatus of claim 41, wherein the plurality of cams comprise a plurality of pairs of adjacent cams, wherein the cams of each pair of adjacent cams are positioned substantially 180 degrees apart from each other about the at least one tubular wall of the tilt rod assembly.

43. The window blind apparatus of claim 42, wherein the tilt rod assembly adjacent the ladder member attachment sections define a plurality of slots each having opposing ends and a centered opening positioned between the ends, wherein the ends of the slots define the ladder member attachment points, and wherein the first and second elongate sections of each ladder member are formed with an attachment end that is adapted to extend into the centered opening of each slot and be captured at the ends of each slot.

44. The window blind apparatus of claim 43, wherein the tilt rod assembly comprises a plurality of rotatable members and a plurality of coupling members that interconnect the plurality of rotatable members.

45. The window blind apparatus of claim 44, wherein the plurality of coupling members define the ladder member attachment points.

46. A window blind assembly to be attached to a structure adjacent a window comprising:

a rotatable rod;

a plurality of mounting block assemblies adapted to be separately mounted directly to a surface of the structure adjacent the window, wherein each of the plurality of mounting block assemblies includes an interchangeable housing having a first side face and a second side face with a first aperture and a second aperture respectively formed in the first and second side faces wherein each of the interchangeable housings also includes a first recessed space wherein the plurality of mounting block assemblies are adapted to engage the rotatable rod through the first aperture in the first face in a first configuration, (ii) through the second aperture in a second face in a second configuration and (iii) through both the first and second apertures in a third configuration to thereby allow a standardized mounting block assembly to be used to support the rotatable rods at the ends of the rotatable rod or in the middle of the rotatable rod;

a tilt actuator block assembly having an aperture that extends therethrough, wherein the tilt actuator block assembly further includes a tilt mechanism that engages with the rotatable rod so as to rotate the rotatable rod in response to user activation of the tilt mechanism;

wherein the tilt actuator block assembly is adapted to engage with a cord tilt mechanism in a first configuration aid a rod tilt mechanism in a second configuration so that a single standardized tilt actuator block assembly can be used in conjunction with two different types of tilt actuator mechanisms; and a slat assembly having a plurality of slats adapted to be positioned adjacent a window, wherein the slat assembly is coupled to the rotatable rod so that rotation of the rotatable rod in response to user activation of the tilt actuator block assembly results in a change in the pitch angle of the plurality of slats which thereby varies the amount of light let through the slat assembly.

47. The assembly of claim 46, wherein the rotatable rod is comprised of a plurality of rod sections and at least one connection member wherein the plurality of rod sections are interconnected by the at least one connection member so that the rotatable rod can be formed to one of a plurality of lengths.

48. The assembly of claim 47, wherein the mounting block assemblies and the tilt actuator block assembly each comprise rotatable in members that are adapted to couple with the rod sections so as to form the rotatable rod.

49. The assembly of claim 49, wherein the tilt actuator block assembly includes a rotatable member that engage with the rotatable rod and wherein the rotatable member includes an opening that is adapted to receive a cord retaining post so that a cord can be attached to the rotatable member such that the cord extends outward of the tilt actuator block assembly so that user induced linear movement of the cord results in rotation of the rotatable member.

50. The assembly of claim 46, wherein the tilt actuator block assembly induces a geared rotatable member that is coupled with the rotatable rod such that rotation of the geared rotatable member results in rotation of the rod and wherein the tilt actuator block assembly further includes a worm gear positioned within the tilt actuator block assembly such that rotation of the worm gear results in rotation of the geared rotatable member.

51. The assembly of claim 50, further comprising a rod that attaches to the worm gear and extends out of the tilt actuator block assembly so as to permit user rotation of the rod to thereby induce rotation of the rotatable rod of the window blind assembly.

52. The assembly of claim 46, wherein the rotatable rod is configured at the coupling points of the slat assembly to the rotatable rods so as to bias the slat assemblies into a closed position and inhibit rotation of the rotatable rod away from the closed position in the absence of user activation of the tilt mechanism in the tilt actuator block assembly.

53. The assembly of claim 52, wherein the slat assembly includes at least two ladder members each having two vertical members with a plurality of lateral interconnecting members connecting the two vertical members wherein the slats are positioned on the lateral interconnecting members and wherein the two vertical members are connected to the rotatable member so that rotation of the rotatable member results in a change in the pitch angle of the slats positioned on the lateral interconnecting members.

54. The assembly of claim 53, wherein the rotatable rod is contoured at the coupling points of the two vertical members of the ladder members so that the distance between the vertical members is decreased when the rotatable rod is rotated to a position corresponding to the closed position of the slats to decrease the disparity in the tension exerted by the two vertical members on the rotatable rod to thereby inhibit the ladder members from inducing the rotatable rod to rotate away from the position corresponding to the closed position of the slats.

55. The assembly of claim 54, wherein the rotatable rod includes a cut out adjacent the coupling points of the vertical members of the ladder members, wherein a first vertical member of the ladder member extends through the cutout so as to be closer to the axis of rotation of the rotatable rod than a second vertical member the rotatable rod is in the position corresponding to the closed position so that the torque exerted on the rotatable rod by the first vertical member is decreased with respect to the torque exerted by the second vertical member.

56. The assembly of claim 55, wherein the rotatable rod is further contoured at the coupling points so that one of the vertical member is more vertically displaced with respect to the other vertical members when the slats are in the closed position so as to increase the pitch angle of the plurality of slats in the closed position to further reduce the amount of light transmitted through the plurality of slats.

57. The assembly of claim 56, wherein a first and a second cam section is positioned on the rotatable member adjacent the coupling points of the two vertical members so that a first vertical member of the ladder member extends over the outer surface of the cam when the rotatable rod is in the position corresponding to the closed position to vertically raise the first vertical member with respect to the second vertical member to thereby increase the pitch angle of the plurality of slats in the closed position.

58. A window blind assembly kit adapted to permit installation of window blinds of varying sizes to windows, the kit comprising in combination:

a plurality of mounting blocks adapted to be mounted to a surface of a wall adjacent a window;

a tilt mechanism block adapted to be mounted to a surface of a wall adjacent a window;

a tilt mechanism adapted to be positioned within the tilt mechanism block;

a plurality of rod sections and connectors wherein the plurality of rod sections and connectors can be coupled together to form a rotatable rod of one of a number of possible sizes corresponding to the width of the window and wherein the plurality of rod sections can be coupled to the selected mounting blocks such that when the selected mounting blocks are secured to the surface of the wall adjacent the window, the rotatable rod is retained adjacent the surface of the wall and wherein the plurality of rod sections can be coupled to the tilt mechanism block such that user activation of the tilt mechanism results in rotation of the rotatable rod;

a plurality of ladder members adapted to be attached at coupling points to the rotatable rod wherein the plurality of ladder members have two elongate members that are attached to coupling points of the rotatable rod such that rotation of the rotatable rod results in vertical displacement of one vertical member with respect to the other;

a plurality of slats of a first length adapted to be engaged with the plurality of ladder members so that rotation of the rotatable member results in a change of pitch of the slats engaged with the plurality of ladder members wherein the slats can be cut to a desired length corresponding to the width of the window;

an assembly rack adapted to receive the plurality of slats of the desired length to permit installation of the plurality of slats into the plurality of ladder assemblies; and wherein the kit is adapted to permit a single kit to be used to form a window blind assembly that is dimensioned to fit a window of a first size selected from a range of window sizes.

59. The kit of claim 58, further comprising a plurality of mounting plates adapted to be positioned on the surface of the wall and further adapted to engage with the mounting blocks to permit mounting of the mounting blocks to the surface of the wall adjacent the window.

60. The kit of claim 59, wherein each of the plurality of mounting plates includes an adhesive to permit temporary mounting of the plates on a surface adjacent the window such that the plates can be temporarily mounted in desired locations while attached to an assembled window blind and then detached from the assembled window blind and fixedly secured to the surface adjacent the window.

61. The kit of claim 58, further comprising a stand for retaining the plurality of slats while the slats are being cut to a desired size.

62. The kit of claim 58, further comprising a lifting mechanism that is coupled to one of the mounting blocks so as to permit vertical movement of the plurality of slats between a an open position and a closed position over the window.

63. The kit of claim 58, wherein the tilt mechanism block is pre-assembled to have the tilt mechanism contained therein.

64. The kit of claim 58, wherein the tilt mechanism block is adapted to receive in a first configuration a cord tilt mechanism and in a second configuration a rod tilt mechanism and wherein the kit includes both a cord tilt mechanism and a rod tilt mechanism.

65. The kit of claim 59, further comprising a plurality of valance components adapted to be cut to size to fit a particular window size and mounted to the mounting blocks so as to at least partially shield the mounting blocks and rotatable rod from view.

* * * * *